US007062187B2

(12) United States Patent
Peng et al.

(10) Patent No.: US 7,062,187 B2
(45) Date of Patent: Jun. 13, 2006

(54) FIXING DEVICE FOR USE IN IMAGE FORMING APPARATUS

(75) Inventors: Youbao Peng, Hino (JP); Atsushi Takahashi, Akishima (JP); Norio Joichi, Higashimurayama (JP); Shinobu Kishi, Hachioji (JP); Akifumi Isobe, Hidaka (JP); Yoshiki Katayama, Hachioji (JP); Yoshihito Sasamoto, Hachioji (JP)

(73) Assignee: Konica Minolta Holdings, Inc., Tokyo (JP)

( * ) Notice: Subject to any disclaimer, the term of this patent is extended or adjusted under 35 U.S.C. 154(b) by 76 days.

(21) Appl. No.: 10/692,267

(22) Filed: Oct. 23, 2003

(65) Prior Publication Data

US 2004/0086295 A1 May 6, 2004

(30) Foreign Application Priority Data

| | | |
|---|---|---|
| Oct. 31, 2002 | (JP) | JP2002-317881 |
| Dec. 24, 2002 | (JP) | jp2002-371216 |
| Jan. 14, 2003 | (JP) | JP2003-005523 |
| Jan. 29, 2003 | (JP) | jp2003-020329 |
| Jun. 5, 2003 | (JP) | jp2003-160634 |

(51) Int. Cl.
*G03G 15/20* (2006.01)

(52) U.S. Cl. ..... 399/69

(58) Field of Classification Search ..... 399/33, 399/67, 69, 91, 94, 320, 328, 330
See application file for complete search history.

(56) References Cited

U.S. PATENT DOCUMENTS

| | | | | |
|---|---|---|---|---|
| 4,672,177 | A * | 6/1987 | Headrick | 399/33 X |
| 4,822,977 | A * | 4/1989 | Leising et al. | 399/33 X |
| 5,768,654 | A * | 6/1998 | Noguchi et al. | 399/69 |
| 6,389,247 | B1 * | 5/2002 | Chung | 399/69 |
| 6,684,037 | B1 * | 1/2004 | Tamaoki | 399/69 |
| 6,724,999 | B1 * | 4/2004 | Kikuchi et al. | 399/69 |

FOREIGN PATENT DOCUMENTS

| | | |
|---|---|---|
| EP | 0 670 531 A2 | 9/1995 |
| JP | 05-289574 | 11/1993 |
| JP | 07-013461 | 1/1995 |
| JP | 2000-259033 A | 9/2000 |
| JP | 2001-034109 A | 2/2001 |
| JP | 2001-215843 A | 8/2001 |
| JP | 2001-242743 A | 9/2001 |
| JP | 2002-372892 A | 12/2002 |

* cited by examiner

*Primary Examiner*—Sandra L. Brase
(74) *Attorney, Agent, or Firm*—Frishauf Holtz Goodman & Chick P.C.

(57) ABSTRACT

In a fixing device of an image forming apparatus including a heating roller and a temperature detecting device spaced apart from the roller, having a first sensor for detecting the surface temperature of the roller, and a second sensor for detecting the ambient temperature, the first sensor being placed at a first position in a casing having an opening through which the heat radiation of the roller is directly incident and the second sensor being enclosed by the casing and placed at a second position to which the heat radiation of the roller is not directly incident, the temperature is calculated on the basis of the outputs of the two sensors, and the opening is disposed so as not to enter a region between the vertical plane containing the central axis of the roller and a tangential plane to the circumferential surface of the roller parallel to the vertical plane.

38 Claims, 38 Drawing Sheets

FIG. 12 ( a )
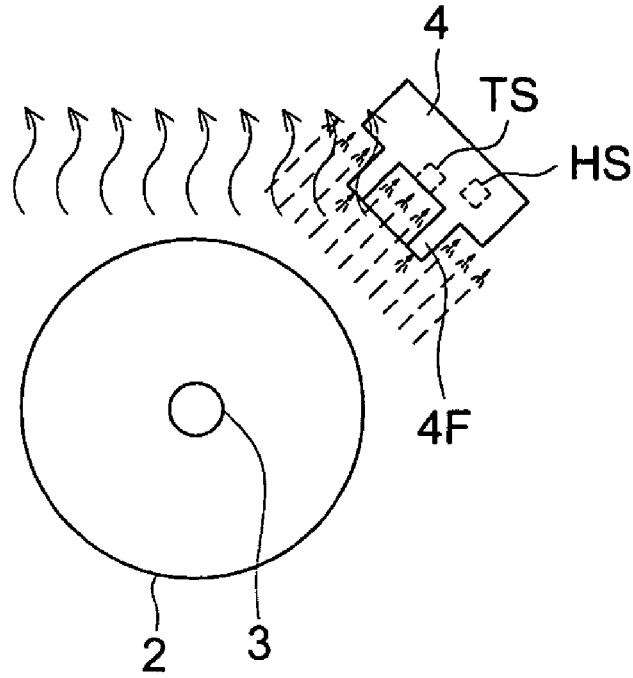
FIG. 12 ( b )
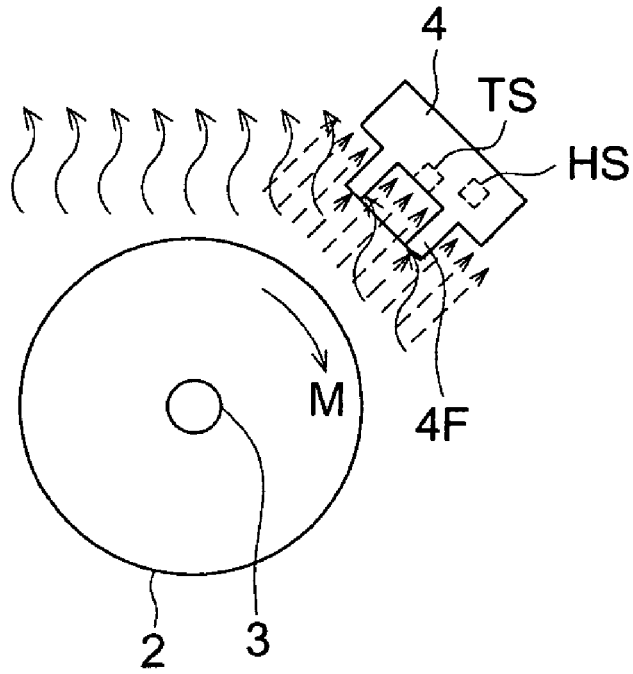

FIG. 22 (a)

611

| SURFACE TEMPERATURE INFORMATION | | INFORMATION OF ROLLER DETECTING SENSOR | | | | | | |
|---|---|---|---|---|---|---|---|---|
| | | • • • | X1 | X2 | X3 | X4 | • • • | Xn |
| INFORMATION OF PERIPHERAL TEMPERATURE DETECTING SENSOR | • • • | • • • | • • • | • • • | • • • | • • • | • • • | • • • |
| | Y1 | • • • | T11 | T21 | T31 | T41 | • • • | • • • |
| | Y2 | • • • | T12 | T22 | T32 | T42 | • • • | • • • |
| | Y3 | • • • | T13 | T23 | T33 | T43 | • • • | • • • |
| | Y4 | • • • | T14 | T24 | T34 | T44 | • • • | • • • |
| | • • • | • • • | • • • | • • • | • • • | • • • | • • • | • • • |
| | Yn | • • • | • • • | • • • | • • • | • • • | • • • | Tnn |

FIG. 22 (b)

612

| SURFACE TEMPERATURE INFORMATION | | INFORMATION OF DIFFERENCE BETWEEN ROLLER DETECTING SENSOR AND PERIPHERAL TEMPERATURE DETECTING SENSOR | | | | | | |
|---|---|---|---|---|---|---|---|---|
| | | • • • | Z1 | Z2 | Z3 | Z4 | • • • | Zn |
| INFORMATION OF PERIPHERAL TEMPERATURE DETECTING SENSOR | • • • | • • • | • • • | • • • | • • • | • • • | • • • | • • • |
| | Y1 | • • • | T11 | T21 | T31 | T41 | • • • | • • • |
| | Y2 | • • • | T12 | T22 | T32 | T42 | • • • | • • • |
| | Y3 | • • • | T13 | T23 | T33 | T43 | • • • | • • • |
| | Y4 | • • • | T14 | T24 | T34 | T44 | • • • | • • • |
| | • • • | • • • | • • • | • • • | • • • | • • • | • • • | • • • |
| | Yn | • • • | • • • | • • • | • • • | • • • | • • • | Tnn |

FIG. 26

| DETECTING SENSOR OUTPUT ER / COMPENSATING SENSOR OUTPUT EH (COMPENSATING SENSOR TEMPERATURE) | ROLLER TEMPERATURE TR | | | | |
|---|---|---|---|---|---|
| | 0 | 80 | 140 | 200 | 260 |
| $EH_0$ (0) | | | | | |
| $EH_n$ (70) | OPERATION FORMULA 1 | | | | |
| $EH_{150}$ (150) | | | | | |

FIXING DEVICE FOR USE IN IMAGE FORMING APPARATUS

BACKGROUND OF THE INVENTION

This invention relates to a fixing device for use in an image forming apparatus equipped with a temperature detecting device for accurately detecting the surface temperature of a heating roller as a fixing roller in the fixing device.

In a conventional technology, it has been adopted for a temperature detecting device for detecting in a non-contact way the surface temperature of the heating roller in a fixing device to control it, means for determining the temperature of a measurement object on the basis of the correlation between two sensors, a surface temperature detection sensor detecting the surface temperature of a heating roller mainly by radiation heat and a compensation temperature sensor detecting the ambient temperature mainly by the heat conduction in air; however, depending on the placement position of the two sensors, the detected temperature tends to be subject to the influence of convection and conduction, and it sometimes becomes impossible to detect accurately the true surface temperature of the measurement object, that is, the heating roller.

As regards such a temperature detecting device, means for measuring the temperature of a measurement object which eliminates the influence of the smudging of the sensors making up the temperature detecting device in cases where the smudging happens is described in the Japanese publication of the unexamined patent application 2001-034109. However, there is no reference in which means for detecting the surface temperature accurately and stably by specifying the positional relationship between the heating roller, the measurement object, and the temperature detecting device at its surface is described.

Further, this invention relates to an image forming apparatus such as a copying machine or a printer employing an electrophotographic method, and in particular, to an image forming apparatus equipped with a fixing device for fixing a toner image formed on the basis of image information on a recording material.

Heretofore, in an image forming apparatus such as a copying machine or a printer using an electrophotographic method, in order to fix a toner image formed on the basis of image information on a recording material such as a paper sheet, generally, a heat roller fixing method is used.

This heat roller fixing method is a method in which toner particles are fused by the heat of a fixing roller with its surface layer formed of a metal having a halogen heater as a heat source arranged inside and fixed on a recording material.

In fixing, if toner particles are fixed at temperatures not lower than a specified temperature, the toner particles adhere to the fixing roller, and in the case of fixing at temperatures not higher than a specified temperature, it becomes the cause of producing a noise called a fog, which degrades the image quality. Further, if toner particles are fixed at temperatures not higher than a specified temperature, it occurs a poor fixing phenomenon in which some toner particles are stripped off the recording material due to the friction against it.

Accordingly, in fixing, it is necessary to carry out temperature control through the detecting of the temperature of the fixing roller accurately in order that the temperature of the fixing roller may fall within a specified temperature range.

However, it sometimes happens an accident such that, for the purpose of detecting the temperature of a fixing roller, during fixing operation, when an operator, having an intention to measure the actual temperature (hereinafter referred to as the surface temperature) of the fixing roller by bringing a contact-type temperature sensor in contact with the surface of the fixing roller, brings the sensor into contact with the rotating fixing roller, the fixing roller is damaged, or an accident such that toner particles adheres to the temperature sensor and the adhering toner particles smudge a recording material.

Therefore, there has been a problem that, in order to prevent such an accident, if the surface temperature of a fixing roller is measured by means of a non-contact type temperature sensor, because the fixing roller is distant from the non-contact type temperature sensor, which is subject to the influence of the temperature of the environment in which the fixing roller is placed, for example, the temperature of the machine parts inside the image forming apparatus or the like, the accurate actual surface temperature cannot be measured.

Thus, as regards a fixing device carrying out a fixing operation by controlling the temperature of the fixing roller within a specified temperature range to avoid the above-mentioned accident, it is disclosed a technology (refer to the Japanese publication of the unexamined patent application H7-13461, for example) to make it possible to carry out fixing always under a constant temperature distribution by it that, for example, with a structure such that a movable contact-type temperature sensor is brought into contact with the fixing roller to detect the surface temperature of the fixing roller during its stopping in warm-up, and during its rotation, the movable contact-type temperature sensor is retracted off the fixing roller, while a non-contact type temperature sensor detects the temperature of the fixing roller, the temperature difference between the surface temperature detected by the contact-type temperature sensor and the surface temperature detected by the non-contact type temperature sensor is obtained as a correction value, and by the addition of the above-mentioned correction value to the surface temperature detected by the non-contact type temperature sensor, the surface temperature of the fixing roller is detected, while the speed of the fixing roller is varied in accordance with the rising rate or falling rate of the detected surface temperature of the fixing roller.

However, this technology, although using a non-contact type temperature sensor, has a problem that the drive mechanism for retracting the movable contact-type sensor off the fixing roller when the fixing roller starts to rotate from the stopping state and varying the speed of the fixing roller in accordance with the rising rate and falling rate of the detected surface temperature of the fixing roller is complex, and also the control for driving the drive mechanism is complex.

Further, it is disclosed a technology (refer to the Japanese publication of the unexamined patent application 2001-242743) such that an appropriate temperature control of a fixing roller is practiced by it that a non-contact type temperature sensor is disposed in the neighborhood of the outer circumferential surface in the central part of a fixing roller, a contact-type temperature sensor being in contact with the outer circumferential surface is disposed at the end part of the fixing roller, in a state where the fixing roller is kept at a specified temperature, the temperature at the end part of the fixing roller is obtained by the contact-type temperature sensor, the temperature at the central part of the fixing roller is obtained by the non-contact type temperature sensor, and using this temperature difference as a correction value, by the addition of this correction value to the non-contact detection temperature at the central part detected by the non-contact temperature sensor, a corrected surface temperature approximating the actual surface temperature at the central part is obtained.

However, because this technology, although using a non-contact type temperature sensor, has a contact-type temperature sensor being in contact with the outer circumferential surface disposed at the end part of the fixing roller, there is a problem that, during the rotation of the fixing roller, or in the case of long term use, due to the friction in the contact area of the fixing roller and the contact type sensor, the fixing roller or the contact-type temperature sensor is damaged, or toner particles adhere to the contact part to make it impossible to detect an accurate temperature.

Therefore, it has been desired the development of an image forming apparatus equipped with a fixing device capable of detecting the temperature of the fixing roller without making the temperature sensor become in contact with the fixing roller, having a simple drive mechanism and a simple temperature control circuit for the fixing roller, and practicing a stable accurate temperature control of the fixing roller.

Further, this invention relates to an image forming apparatus having a fixing device of a heat roll method and a control method of said image forming apparatus.

(i) In a conventional fixing device of a heat roll method, for the control means of the surface temperature of the heating roller, it has been adopted means such that the surface temperature of the heating roller is measured by the use of a non-contact type temperature sensor in order to eliminate damages such as scratches on the coating layer of the heating roller surface, and the surface temperature of the heating roller is controlled on the basis of the measurement value.

In this case, as regards the actual temperature of the heating roller surface and the measured temperature by the temperature sensor which has measured the surface temperature of the heating roller, the measured temperature generally shows a temperature which is lower than the actual temperature by $\Delta T$ ° C.; therefore, it has been put into practice a temperature control of the heating roller surface such that a temperature which is lower than the surface temperature of the heating roller by $\Delta T$ ° C. is set as a control target temperature, which is compared with the measured temperature by the temperature sensor, and the difference is made to be zero (so as to make the surface temperature of the heating roller to become the target temperature as the result).

(ii) Further, it is disclosed a method in the Japanese publication of the unexamined patent application 2000-259033 a method in which the surface temperature of a fixing roller detected by a non-contact type surface temperature detection means is corrected by the detection of the surface temperature of the fixing roller using a contact-type surface temperature detection means being brought into contact with the fixing roller at a specified timing.

In the case of (i), between the temperature of the heating roller surface and the temperature by the temperature sensor for measuring the surface temperature of the heating roller, in the case where the surface temperature of the heating roller is varied, a temperature difference due to the time-lag of first order is produced on top of the temperature difference which is produced constantly.

For this reason, there is a defect that, near the end of warm-up for example, or even during printing, a large temperature difference between the two is produced during the heating of the heating roller, which causes the heating roller to be heated more than required, to raise a possibility that the heating roller is deteriorated or damaged, or an offset is produced.

In the case of (ii), although the above-mentioned defect is solved because the surface temperature of the fixing roller detected by a non-contact type surface temperature detection means is corrected by the detection of the surface temperature of the fixing roller using a contact-type surface temperature detection means to be brought into contact with the fixing roller, there is a defect that the fixing roller is possibly damaged because a contact-type surface temperature detection means is brought into contact with the fixing roller.

Heretofore, in a fixing device of a heat roll method, in practicing a control of the surface temperature of a heating roller, in order to eliminate scratches etc. on the coating layer of the heating roller surface, it has been adopted a method in which the surface temperature of a heating roller is measured by the use of a non-contact type detection sensor (a roller temperature detecting means), and the surface temperature of the heating roller is controlled on the basis of the measured value.

However, there is a problem that a non-contact type detection sensor has a slow response and its accuracy is low; as regards a method of solving this problem, (iii) it is proposed a fixing device (the Japanese publication of the unexamined patent application 2001-215843) using a method in which the values of the surface temperature corresponding to a detection signal of an infrared ray receiving element (temperature detection sensor) of a non-contact type and a detection signal of a thermistor element (temperature compensation sensor) are used to compose a data table, and the detection output of the detection sensor and the detection output of the temperature compensation element are fitted to the data table, to correct the surface temperature of the fixing rotary body (heating roller) detected by the detection sensor.

(iv) Further, it is proposed (Japanese publication of the unexamined patent application H5-289574) a fixing device in which a target design temperature (target control temperature) for controlling the temperature of a fixing roller (a heating roller) is calculated as a function of a time measurement value of the passage of the time from the turning-on of the power source measured by a timer, and the control of the surface temperature of the heating roller is carried out on the basis of the target control temperature which has been obtained from the result of the calculation.

In the case of (iii), a correspondence table of the surface temperature values TRn of the heating roller for the detection output values ERn of the detection sensor and the detection output values EHn of the compensation sensor as shown in FIG. 25 for example (a drawing of a data table for calculating surface temperature values on the basis of detection output values and compensation output values) is necessary; however, the fixing device has a defect that, in order to carry out a minute temperature control, it is necessary to prepare a large data table corresponding to various combinations of temperatures, a great deal of operation is required for the data preparation, and the data table requires a very large storage capacity.

In the case of (iv), because the surface temperature of a fixing roller is detected by a non-contact type sensor only, the device has a defect that the detection sensor of a non-contact type is subject to the influence of the ambient temperature and the condition of operation of the device, which makes it impossible to detect the correct surface temperature, and as the result, the target control temperature which is the calculation result for the correction of the surface temperature does not take a correct value; therefore, the device has a defect that also the surface temperature of the heating roller to be controlled on the basis of the target control temperature tends to become inaccurate.

In order to eliminate such defects, it has been studied also a method in which a detection sensor for detecting the temperature of a heating roller and a correction sensor for it are provided, and as shown in FIG. 26 for example (an illustrative drawing of calculation of a surface temperature by a conventional single operation equation), a single operation equation 1 for calculating the surface temperature over the whole range of the roller temperature is defined, and the surface temperature is calculated from the operation equation 1 on the basis of the output of the detection sensor and the output of the correction sensor, but it has been found that this method has a defect that the difference between the actual temperature and the result of calculation is large.

Further, this invention relates to an image forming apparatus such as a copying machine, a facsimile machine, a printer, and a complex machine of these, and in particular, to an abnormal temperature detecting device of a fixing device.

Generally speaking, in an image forming apparatus of an electrophotographic method, an image is read by a scanner, a toner image of the read image is produced on a recording material in the image forming part, the recording material having the image formed is sent to a fixing device, where the unfixed toner image on the recording material is fixed by heating, and a print image is obtained.

The fixing device is equipped with a heating roller as a heating member equipped with a heating source inside, and a pressing roller as a pressing member making a pressure contact with said heating roller to form a fixing nip. The heating roller is driven for rotation by a drive source and the pressing roller is rotated in compliance with the heating roller. The heating roller and the pressing roller heat and press a recording material while they grip it to convey by the fixing nip, and fuse to fix a toner image on the recording material. As regards the heating roller, its surface temperature is detected and a temperature control is carried out to keep the temperature always proper.

Heretofore, for the temperature detection of the heating roller, it has been used a contact temperature detection method in which a temperature sensor such as a thermistor is brought into contact with the surface of a heating roller, to detect its surface temperature by the output of said temperature sensor. However, in a contact temperature detection method, because a temperature sensor is brought into a direct contact with the heating roller, it sometimes happens that the heating roller is damaged.

Therefore, in recent years, non-contact type temperature detecting devices which carry out the detection without being in contact with the heating roller have been proposed. As one of such non-contact type temperature detecting devices, it is known a detecting device equipped with a detection temperature sensor for detecting the temperature of the heating roller, and in addition to it, a compensation temperature sensor for the compensation of the detection temperature sensor for detecting the ambient temperature in the neighborhood of the detection temperature sensor.

As a method of detecting an abnormality of the temperature of a fixing device using such a temperature detecting device, for example, a method described in the Japanese publication of the unexamined patent application 2002-372892 is known.

However, because a fixing device is a high-temperature part, it is necessary to detect an abnormality of its temperature more closely and accurately.

As described in the above, it is the first object of this invention to provide a fixing device for use in an image forming apparatus in which a temperature detecting device which detects the surface temperature of a heating roller as a measurement object from the correlation between two different temperatures, a temperature detected by a surface temperature detection sensor for detecting the temperature mainly by heat radiation and a temperature detected by a compensation temperature sensor for detecting the ambient temperature mainly by heat conduction in air is made to accurately detect the surface temperature of said heating roller, with the conditions of its material and its placement position with respect to the above-mentioned heating roller established without breaking the relationship of said correlation.

It is the second object of this invention, in view of the above-mentioned problems, to provide an image forming apparatus equipped with a fixing device capable of practicing a stable accurate temperature control of the fixing roller.

It is the third object of this invention to provide an image forming apparatus which never produces the breakage of the heating roller or a fixing abnormality such as an offset by quickly detecting the surface temperature of the heating roller.

It is the fourth object of this invention to provide an image forming apparatus which does not require a large number of working hours for data preparation and a large storage capacity for data storage and is capable of quickly detecting the surface temperature of the heating roller and practicing the control without producing a breakage of the heating roller or a fixing abnormality such as an offset.

It is the fifth object of this invention to provide an abnormal temperature detecting device of a fixing device and an image forming apparatus capable of detecting abnormal temperatures minutely over a broader range in diversified ways.

The above-mentioned first object can be accomplished by any one of the following structures (1) to (4).

(1) A fixing device of an image forming apparatus having a heating roller provided with a heating means for heating a toner image formed on a transfer material and a temperature detecting device placed in a non-contact way with said heating roller, characterized by said temperature detecting device comprising a surface temperature detecting sensor for detecting the temperature of the surface of said heating roller, a compensation temperature sensor for detecting the ambient temperature, said surface temperature detecting sensor being placed at a first position in a case having an opening portion to which the heat radiation of said heating roller is directly incident through said opening and said compensation temperature sensor being enclosed by said case and placed at a second position to which the heat radiation of said heating roller is not directly incident, and means for calculating the surface temperature of said heating roller on the basis of the outputs of said two sensors, and said opening portion of said case for said surface temperature detecting sensor being disposed in such a way as not to enter a region between the vertical plane containing the central axis of said heating roller and the nearer one of two tangential planes to the circumferential surface of said heating roller parallel to said vertical plane.

(2) A fixing device of an image forming apparatus as set forth in the structure (1), characterized in that each angle made by each straight line drawn from the central position of each of the aforesaid two sensors perpendicularly to the central axis of the aforesaid heating roller, which represents the shortest distance between the central position and the central axis, and a plane containing the sensor surface of the corresponding one of said two sensors is 90 degrees±5 degrees.

(3) A fixing device of an image forming apparatus as set forth in the structure (1) or (2) characterized by the aforesaid case for accommodating the aforesaid two sensors of the aforesaid temperature detecting device and a mounting member to be attached to said case being made of a material having a good thermal conductivity.

(4) A fixing device of an image forming apparatus as set forth in any one of the structures (1) to (3), characterized by the aforesaid two sensors being fitted in such a way as to be covered by the part of said case excluding the aforesaid opening portion.

In order to accomplish the above-mentioned second object, as set forth in the structures (5) and (6) of this invention, in a state where a non-contact type temperature sensor was used and the fixing roller was standing still or rotating, investigations were repeatedly carried out in various ways in order that the temperature sensor placed at a position off the fixing roller may detect the temperature of the fixing roller accurately; then, it was found that the degree of the influence of the infrared rays, heat convection, etc. given to the temperature sensor in the environment where the fixing roller was arranged became different between two conditions of the fixing roller still standing and rotating, and it was also found that a higher temperature than the actual temperature of the fixing roller was detected in the condition of the rotating fixing roller because of the higher degree of the influence of heat given to the temperature sensor.

Further, it was found that, also during the rotation of the fixing roller, the degree of the above-mentioned influence of the heat convection etc. given to the temperature sensor, depending on the difference of the number of rotations, was higher for the higher number of rotations than for the lower number of rotations; therefore, correction values which became different dependently on the number of rotations were obtained by experiments etc., and by the practice of the temperature control of the fixing roller, in which the reference temperature of the temperature control means was set at a temperature obtained by the addition of the correction value to the set temperature of the fixing roller in order to correct the temperature difference, it was actualized to make it possible to keep the temperature of the fixing roller constant irrespectively of the number of rotations of the fixing roller.

That is, the invention set forth in the structure (5) is as follows.

(5) An image forming apparatus equipped with a fixing roller having a heater means inside for fixing a toner image formed on the basis of image information to a recording material, a temperature detecting means for detecting the temperature of said fixing roller in a condition of non-contact with said fixing roller and outputting the detection value of said temperature, and a temperature control means for practicing a temperature control of said fixing roller by making said heater means operate in such a way as to make said fixing roller come to be at a set temperature determined beforehand, on the basis of a reference temperature set beforehand and said detection value of said temperature, characterized by said temperature control means practicing a temperature control of said fixing roller, with said reference temperature during the rotation of said fixing roller made to have a temperature value obtained by the addition of a correction value $\alpha$ set beforehand to the set temperature value of said fixing roller.

By this structure, because a reference temperature having it taken into consideration that the temperature detecting means is subject to the influence of the turbulence of the rising convection heat flow produced by the rotation of the fixing roller during the rotation of the fixing roller is set in the temperature control means, it is possible to provide an image forming apparatus which is capable of keeping the surface temperature of the fixing roller always constant at the set temperature during the rotation of the fixing roller, and forming a high-quality image without producing a poor fixing etc.

(6) An image forming apparatus as set forth in the structure (5), characterized by the aforesaid temperature control means practicing the temperature control of the aforesaid fixing roller, when said fixing roller is rotating at a number of rotations smaller than the number of rotations of said fixing roller at the time the aforesaid reference temperature is made to have the temperature value obtained by the addition of the aforesaid correction value $\alpha$ to the set temperature value of said fixing roller, with said reference temperature made to have a value obtained by the addition of a correction value $\beta$ set beforehand which is smaller than said correction value $\alpha$ to the set temperature value of said fixing roller.

By this structure, even in the case where the number of rotations of the fixing roller is changed, the surface temperature of the fixing roller is always kept constant during the rotation of the fixing roller irrespectively of the number of rotations of the fixing roller; thus, it is possible to provide an image forming apparatus capable of forming a high-quality image without producing a poor fixing etc.

The third object of this invention can be accomplished by any one of the structures (7) to (10) described below.

(7) An image forming apparatus equipped with a heating roller heated by a heat generating body, a roller heat detecting sensor for detecting the heat radiated from said heating roller, an ambient temperature detecting sensor for detecting the ambient temperature of said roller heat detecting sensor, a surface temperature calculating means for calculating the surface temperature information of said heating roller, and a heating control means for controlling the heating of said heating roller on the basis of the surface temperature information calculated by said surface temperature calculating means, characterized by said surface temperature calculating means calculating the surface temperature information of said heating roller by bringing the detection information of said roller heat detecting sensor and the detection information of said ambient temperature detecting sensor into correspondence with data table information in which the surface temperature information of the heating roller corresponding to the detection information of the roller heat detecting sensor and the detection information of the ambient temperature detecting sensor is written, and calculating the average value of the plural values of said surface temperature information calculated.

(8) A control method of an image forming apparatus characterized in that the moving average value of detection information obtained by a roller heat detecting sensor for detecting the heat radiated from a heating roller heated by a heat generating body and the moving average value of detection information obtained by an ambient temperature detecting sensor for detecting the ambient temperature of said roller heat detecting sensor are calculated, the surface temperature information of the heating roller corresponding to both the calculated moving average values is calculated from a data table in which the surface temperature information of the heating roller corresponding to the detection information of the roller heat detecting sensor and the detection information of the ambient temperature detecting sensor is written, the average value of the values of the calculated surface temperature information is calculated and is determined to be the roller surface temperature, which is compared with the fixing roller target temperature, and the temperature control of said heating roller is carried out on the basis of the result of the comparison.

(9) An image forming apparatus equipped with a heating roller heated by a heat generating body, a roller heat detecting sensor for detecting the heat radiated from said heating roller, an ambient temperature detecting sensor for detecting the ambient temperature of said roller heat detecting sensor, a surface temperature calculating means for calculating the surface temperature of said heating roller, and a heating control means for controlling the heating of said heating roller on the basis of the surface temperature information calculated by said surface temperature calculating means, characterized by further comprising a difference calculating means for calculating the difference between the detection information of said roller heat detecting sensor and the detection information of said ambient temperature detecting sensor, and said surface temperature calculating means calculating the surface temperature of said heating roller by bringing the output information of said difference calculating means and the detection information of said ambient temperature detecting sensor into correspondence with data table information in which the surface temperature information of the heating roller corresponding to the output information of the difference calculating means and the detection information of the ambient temperature detecting sensor is written, and calculating the average value of the plural values of said surface temperature information calculated.

(10) A control method of an image forming apparatus characterized by it that, by a difference calculating means for calculating the difference between output information obtained by a roller heat detecting sensor for detecting the heat radiated from a heating roller heated by a heat generating body and output information obtained by an ambient temperature detecting sensor for detecting the ambient temperature of said roller heat detecting sensor, the difference of the output information between both the sensors is calculated, the moving average value of the output information of said difference calculating means and the moving average of the detection information of said ambient temperature detecting sensor are calculated, the surface temperature information of the heating roller corresponding to both the calculated moving average values is calculated from a data table in which the surface temperature information of the heating roller corresponding to the output information of the difference calculating means and the detection information of the ambient temperature detecting sensor is written, the average value of the values of the calculated surface temperature information is calculated and is determined to be the roller surface temperature, which is compared with the fixing roller target temperature, and the temperature control of said heating roller is carried out on the basis of the result of the comparison.

Further, the inventors of the present invention are willing to provide an image forming apparatus having a structure such that an operation equation for calculating the surface temperature in a temperature range requiring accuracy is provided, calculations are carried out on the basis of the output values of a detection sensor and a compensation sensor obtained from time to time, and the temperature control of a heating roller is carried out by the comparison between the calculated surface temperature of the heating roller and a target control temperature.

Further, as shown in FIG. 24 (a graph of the result of calculation of plural equations), for the purpose of raising the detection accuracy of temperature, a temperature range A requiring accuracy (a temperature range where the temperature control of a heating roller is to be practiced) is further divided into two parts, for example; then, it is found in a graph showing the result of calculation by operation equations prepared corresponding to the respective temperature ranges B and C obtained by the dividing that the lines representing the calculation result are not parallel and cross each other like lines b and c, and in this case, it is to be remarked that the calculation result of the smaller values is nearer to the line a of the actual surface temperature. Thus, in the case where the calculation of the surface temperature is carried out for the same temperature range by means of plural operation equations, the result having the smaller values should be made to be the surface temperature.

In the above description, "a temperature range where the temperature control of the heating roller is to be carried out" means a temperature range of 80° C. to 220° C. in terms of the surface temperature of the heating roller requiring a temperature control with a good accuracy (for example, ±2° C. to 3° C. of the target value) as in the standby time, printing time, energy-saving operation time, etc. except for the warm-up time, and "a roller temperature range where normal printing is carried out" means, for example, a temperature range of 160° C. to 200° C. in terms of the surface temperature of the heating roller as in the normal printing time; these are to be determined suitably by the specification of the image forming apparatus including the developer material.

The above-mentioned fourth object of this invention can be accomplished by any one of the structures (11) to (16) described below.

(11) An image forming apparatus equipped with a heating roller heated by a heating source, a detection sensor for detecting the surface temperature of said heating roller in a non-contact way, and a compensation sensor for detecting the temperature of said detection sensor, characterized by further comprising a storage means having stored an operation equation defined in correspondence with a region determined by the roller temperature range where normal printing is practiced, a calculation means for calculating the surface temperature of said heating roller by means of said operation equation, and a control means for practicing a control of the application of electric current to said heating source on the basis of the calculation result and a target control temperature.

(12) An image forming apparatus equipped with a heating roller heated by a heating source, a detection sensor for detecting the surface temperature of said heating roller in a non-contact way, and a compensation sensor for detecting the temperature of said detection sensor, characterized by a roller temperature range where a temperature control of the heating roller is to be practiced being undivided, or divided into two or more temperature ranges, the detection output range of said compensation sensor being undivided, or divided into two or more ranges, and said image forming apparatus further comprising a storage means having stored two or more operation equations defined in correspondence with two or more regions determined by the one roller temperature range or two or more divisional roller temperature ranges and the one detection range or two or more divisional detection ranges of the compensation sensor respectively, a selection means for selecting an operation equation corresponding to one of said regions including a target control temperature and the detection temperature of said compensation sensor, a calculation means for calculating the surface temperature of said heating roller by means of the selected operation equation on the basis of the detection output of said detection sensor and the detection output of said compensation sensor, and a control means for practicing a control of the application of electric current to said heating source on the basis of the calculation result and the target control temperature.

(13) An image forming apparatus equipped with a heating roller heated by a heating source, a detection sensor for detecting the surface temperature of said heating roller in a non-contact way, and a compensation sensor for detecting the temperature of said detection sensor, characterized by a roller temperature range where a temperature control of the heating roller is to be practiced being divided into two or more temperature ranges, the detection output range of said compensation sensor being undivided, or divided into two or more ranges, and said image forming apparatus further comprising a storage means having stored operation equations defined in correspondence with regions determined by the divisional roller temperature ranges and the one detection range or two or more divisional detection ranges of the compensation sensor respectively, a calculation means for calculating the surface temperature of said heating roller by means of said defined plural operation equations on the basis of the detection output of said detection sensor and the detection output of said compensation sensor, a comparison judgement means for determining one having the smaller value to be a final surface temperature out of the plural calculation results, and a control means for practicing a control of the application of electric current to said heating source on the basis of said final surface temperature and a target control temperature.

(14) A control method of an image forming apparatus characterized by it that a detection output of a detection sensor for detecting the temperature of a heating roller and a detection output of a compensation sensor for detecting the temperature of said detection sensor are read, an operation equation stored beforehand for calculating the surface temperature of said heating roller set within a roller temperature range where normal printing is practiced is read, a calculation by said operation equation is carried out in accordance with the detection output of said detection sensor and the detection output of said compensation sensor, the calculation result is determined to be the surface temperature of said heating roller, which is compared with a target temperature, and a temperature control of said heating roller is practiced on the basis of the result of the comparison.

(15) A control method of an image forming apparatus characterized by it that a detection output of a detection sensor for detecting the temperature of a heating roller and a detection output of a compensation sensor for detecting the temperature of said detection sensor are read, a plurality of operation equations stored beforehand for calculating the surface temperature of said heating roller set within a temperature range where a temperature control of the heating roller is to be carried out are read, an operation equation corresponding to a target control temperature and the detection value of the compensation sensor is selected out of the read operation equations, a calculation by said selected operation equation is carried out in accordance with the detection output of said detection sensor and the detection output of said compensation sensor, the calculation result is determined to be the surface temperature of said heating roller, which is compared with a target temperature, and a temperature control of said heating roller is practiced on the basis of the result of the comparison.

(16) A control method of an image forming apparatus characterized by it that a detection output of a detection sensor for detecting the temperature of a heating roller and a detection output of a compensation sensor for detecting the temperature of said detection sensor are read, a plurality of operation equations stored beforehand for calculating the surface temperature of said heating roller set within a temperature range where a temperature control of the heating roller is to be carried out are read, a plurality of operation equations corresponding to the detection values of the compensation sensor are selected out of the read operation equations, a calculation by said selected operation equations is carried out in accordance with the detection output of said detection sensor and the detection output of said compensation sensor, the smallest one out of the calculation results is determined to be the surface temperature of said heating roller, which is compared with a target temperature, and a temperature control of said heating roller is practiced on the basis of the result of the comparison.

The above-mentioned fifth object of this invention can be accomplished by any one of the structures (17) to (28) described below.

(17) An abnormal temperature detecting device of a fixing device of an image forming apparatus for heating and fixing a toner image formed on a transfer material by a heating roller heated by a heating means, characterized by comprising a temperature detecting means having a first temperature sensor for detecting the surface temperature of said heating roller and a second temperature sensor for detecting the ambient temperature of said first temperature sensor, a comparison means for comparing a detection signal value of said first temperature sensor with a reference value set beforehand, and a judgement means for judging a temperature abnormality of said heating roller or an abnormality of said first temperature sensor from the comparison result of said comparison means.

According to the invention described in the structure (17), the abnormal temperature detecting device has a first temperature sensor for detecting the surface temperature of the heating roller and a second temperature sensor for detecting the ambient temperature of the first temperature sensor, compares a detection signal value of the first temperature sensor with a reference value set beforehand, and judges a temperature abnormality of the heating roller or an abnormality of the first temperature sensor. Accordingly, even if the second temperature sensor is not used, a temperature abnormality of the heating roller or an abnormality of the first temperature sensor can be detected.

(18) An abnormal temperature detecting device as set forth in the structure (17), characterized by the aforesaid judgement means judging the temperature to be abnormal in the case where a state that the detection signal value of the aforesaid first temperature sensor does not exceed the aforesaid reference value set beforehand lasts for a period of time not shorter than a reference time set beforehand as the result of the aforesaid comparison.

(18) According to the invention described in the structure (18), in the invention of the structure (17), the abnormal temperature detecting device judges the temperature to be abnormal in the case where a state that the detection signal value of the aforesaid first temperature sensor does not exceed the aforesaid reference value set beforehand lasts for a period of time not shorter than a reference time set beforehand. Accordingly, it is possible to detect a temperature abnormality of the heating roller or an abnormality of the first temperature sensor more accurately.

(19) An abnormal temperature detecting device of a fixing device of an image forming apparatus for heating and fixing a toner image formed on a transfer material by a heating roller heated by a heating means, characterized by comprising a temperature detecting means having a first temperature sensor for detecting the surface temperature of said heating roller and a second temperature sensor for detecting the ambient temperature of said first temperature sensor, a differential amplification means for differentially amplifying a detection signal value of said first temperature sensor and a detection signal of said second temperature sensor to obtain the difference value, and a judgement means which judges the temperature to be abnormal in the case where a state that the difference value does not exceed a reference value set beforehand lasts for a period of time not shorter than a reference time set beforehand.

According to the invention described in the structure (19), the abnormal temperature detecting device comprises a first temperature sensor for detecting the surface temperature of said heating roller and a second temperature sensor for detecting the ambient temperature of said first temperature sensor, differentially amplifies a detection signal value of said first temperature sensor and a detection signal of said second temperature sensor to obtain the difference value, and judges the temperature to be abnormal in the case where a state that the difference value does not exceed a reference value set beforehand lasts for a period of time not shorter than a reference time set beforehand. Accordingly, it is possible to detect an abnormality concerning the heating roller or the two sensors.

(20) An abnormal temperature detecting device of a fixing device of an image forming apparatus for heating and fixing a toner image formed on a transfer material by a heating roller heated by a heating means, characterized by comprising a temperature detecting means having a first temperature sensor for detecting the surface temperature of said heating roller and a second temperature sensor for detecting the ambient temperature of said first temperature sensor, a differential amplification means for differentially amplifying a detection signal value of said first temperature sensor and a detection signal of said second temperature sensor to obtain the difference value, and a judgement means which judges the temperature to be abnormal in the case where a state that the detection signal of the first temperature sensor does not exceed a first reference value set beforehand lasts for a period of time not shorter than a first reference time set beforehand, in the case where a state that the detection signal of the second temperature sensor does not exceed a second reference value set beforehand lasts for a period of time not shorter than a second reference time set beforehand, or in the case where a state that the difference value does not exceed a third reference value set beforehand lasts for a period of time not shorter than a third reference time set beforehand.

According to the invention described in the structure (20), the abnormal temperature detecting device comprises a first temperature sensor for detecting the surface temperature of said heating roller and a second temperature sensor for detecting the ambient temperature of said first temperature sensor, differentially amplifies a detection signal value of said first temperature sensor and a detection signal of said second temperature sensor to obtain the difference value, and judges the temperature to be abnormal in the case where a state that a detection signal of the first temperature sensor does not exceed a first reference value set beforehand lasts for a period of time not shorter than a first reference time set beforehand, in the case where a state that a detection signal of the second temperature sensor does not exceed a second reference value set beforehand lasts for a period of time not shorter than a second reference time set beforehand, or in the case where a state that the difference value does not exceed a third reference value set beforehand lasts for a period of time not shorter than a third reference time set beforehand. Accordingly, because an abnormality is detected by the use of outputs from the two sensors and the difference value of outputs of the two sensors, it is possible to detect an abnormality more accurately.

(21) An abnormal temperature detecting means as set forth in the structure (20), characterized by it that with the aforesaid first reference time denoted by t1, the aforesaid second reference time denoted by t2, and the aforesaid third reference time denoted by t3, these reference times are set in such a way as to satisfy the inequality t1<t2<t3.

According to the invention described in the structure (21), in the invention described in the structure (20), with the aforesaid first reference time denoted by t1, the aforesaid second reference time denoted by t2, and the aforesaid third reference time denoted by t3, these reference times are set in such a way as to satisfy the inequality t1<t2<t3. Accordingly, it is possible to carry out the abnormality judgement in the order of importance as the abnormality detection.

(22) An abnormal temperature detecting device of a fixing device of an image forming apparatus for heating and fixing a toner image formed on a transfer material by a heating roller heated by a heating means, characterized by comprising a temperature detecting means having a first temperature sensor for detecting the surface temperature of said heating roller and a second temperature sensor for detecting the ambient temperature of said first temperature sensor, a differential amplification means for differentially amplifying a detection signal value of said first temperature sensor and a detection signal of said second temperature sensor to obtain the difference value, a positive-and-negative source voltage supply means for supplying a positive source voltage and a negative source voltage for making the operation region of said differential amplification means cover a range extending from a negative voltage to a positive voltage to said differential amplification means, and a judgement means which judges the temperature to be abnormal in the case where the signal polarity of said difference value is negative.

According to the invention described in the structure (22), the abnormal temperature detecting device comprises a temperature detecting means having a first temperature sensor for detecting the surface temperature of said heating roller and a second temperature sensor for detecting the ambient temperature of said first temperature sensor, differentially amplifies a detection signal of said first temperature sensor and a detection signal of said second temperature sensor to obtain the difference value, and judges the temperature to be abnormal in the case where the signal polarity of the difference value is negative. Accordingly, it is possible to detect an abnormality in the abnormal temperature detecting device such as an abnormality of the temperature of the heating roller, the two sensors, the circuit structure.

(23) An abnormal temperature detecting device as set forth in the structure (22), characterized by the aforesaid judgement means judging the temperature to be abnormal in the case where a state that the signal polarity of the aforesaid difference value is negative lasts for a period of time not shorter than a reference time determined beforehand.

According to the invention described in the structure (23), in the invention described in the structure (22), the judgement means judges the temperature to be abnormal in the case where a state that the signal polarity of the aforesaid difference value is negative lasts for a period of time not shorter than a reference time determined beforehand. Accordingly, it is possible to detect an abnormality more certainly.

(24) An abnormal temperature detecting device as set forth in any one of the structures (17) to (23), characterized by further comprising a control means which, in the case where the result of the judgement by the aforesaid judgement means indicates an abnormality, once stops the operation of the aforesaid heating means and later actuates it again and if said judgement means judges the temperature to be abnormal again, judges the temperature to be abnormal.

According to the invention described in the structure (24), in the invention described in any one of the structures (17) to (23), in the case where the result of the judgement by the judgement means indicates an abnormality, the control means once stops the operation of the heating means and later actuates it again, and if the judgement means judges the temperature to be abnormal again, judges the temperature to be abnormal. Accordingly, it is possible to detect whether an abnormality is true or false more certainly.

(25) An abnormal temperature detecting device as set forth in any one of the structures (17) to (23), characterized by the aforesaid temperature detecting means includes a third temperature sensor placed at another position different from the placement position of the aforesaid first temperature sensor for detecting the surface temperature at the another position of the aforesaid heating roller, and said abnormal temperature detecting device further comprising a confirmation means for confirming an abnormality on the basis of a detection signal value of said third temperature sensor and a third reference value set beforehand.

According to the invention described in the structure (25), in the invention described in any one of the structures (17) to (23), the abnormal temperature detecting device has a third temperature sensor placed at another position different from the placement position of the aforesaid first temperature sensor for detecting the surface temperature at the another position of the aforesaid heating roller, and confirms an abnormality on the basis of a detection signal value of said third temperature sensor and a third reference value set beforehand, in the case where the result of the judgement by the judgement means indicates an abnormality. Accordingly, it is possible to detect whether an abnormality is true or false more certainly.

(26) An abnormal temperature detecting device as set forth in the structure (25), characterized by further comprising a control means which, in the case where the result of the confirmation by the aforesaid confirmation means indicates an abnormality, once stops the operation of the aforesaid heating means and later actuates it again and if said judgement means judges the temperature to be abnormal again, judges the temperature to be abnormal.

According to the invention described in the structure (26), in the invention described in the structure (25), in the case where the result of the confirmation by the aforesaid confirmation means indicates an abnormality, the control means once stops the operation of the aforesaid heating means and later actuates it again and if said judgement means judges the temperature to be abnormal again, judges the temperature to be abnormal. Accordingly, it is possible to detect whether an abnormality is true or false more certainly.

(27) An abnormal temperature detecting device as set forth in any one of the structures (18) to (21), and (23), characterized by further comprising a switching means for changing the length of the reference time set in the aforesaid judgement means.

According to the invention described in the structure (27), in the invention described in the structures (18) to (21), and (23), the abnormal temperature detecting device further comprises a switching means for changing the length of the reference time set in the aforesaid judgement means. Accordingly, in the case where a uniformly determined reference time results in the damage of the fixing device, for example, in the case where there are different destination lands, it is possible to set different reference times in accordance with the conditions.

(28) An image forming apparatus characterized by being equipped with an abnormal temperature detecting device of a fixing device as set forth in any one of the structures (17) to (27).

According to the invention described in the structure (28), by being equipped with an abnormal temperature detecting device of a fixing device as set forth in any one of the structures (17) to (27), the image forming apparatus can detect a temperature abnormality minutely over a broad range in diversified ways.

BRIEF DESCRIPTION OF THE PREFERRED EMBODIMENT

Figure 4:
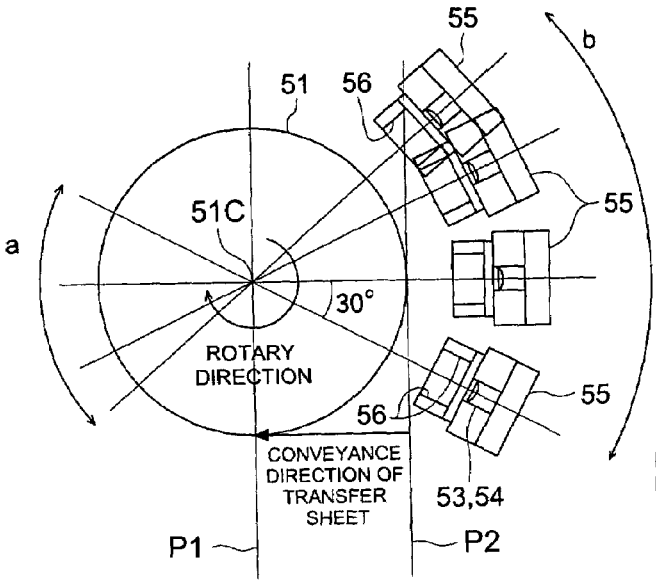
Figure 4:
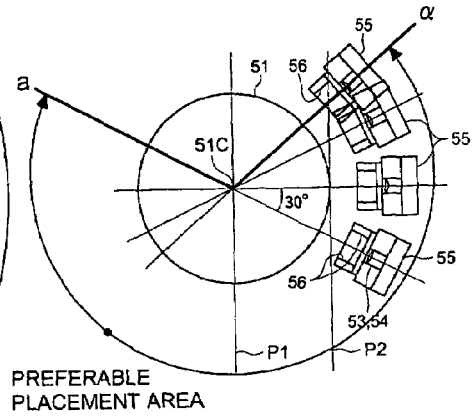
Figure 5:
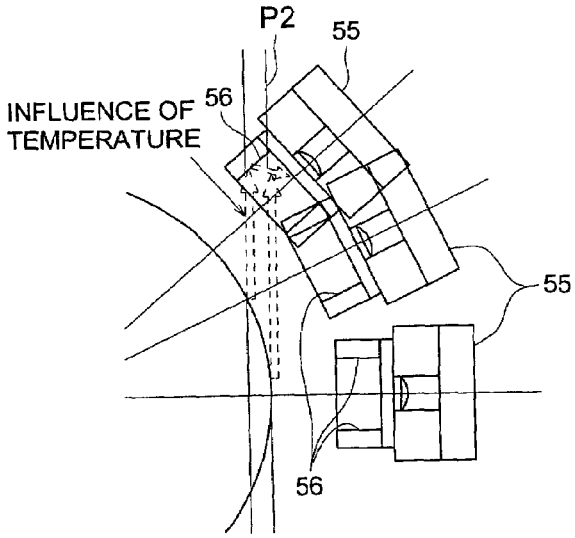
Figure 6:
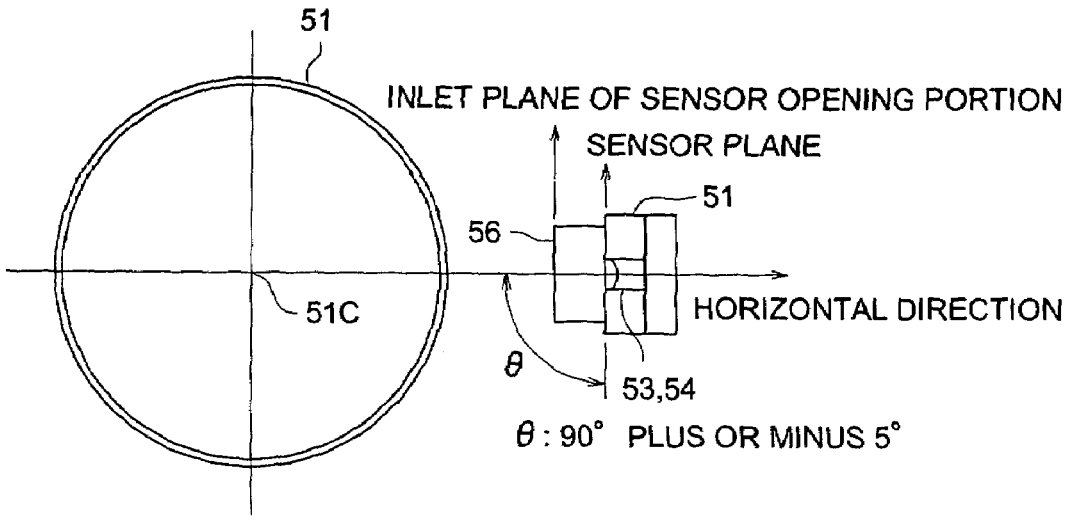
Figure 7:
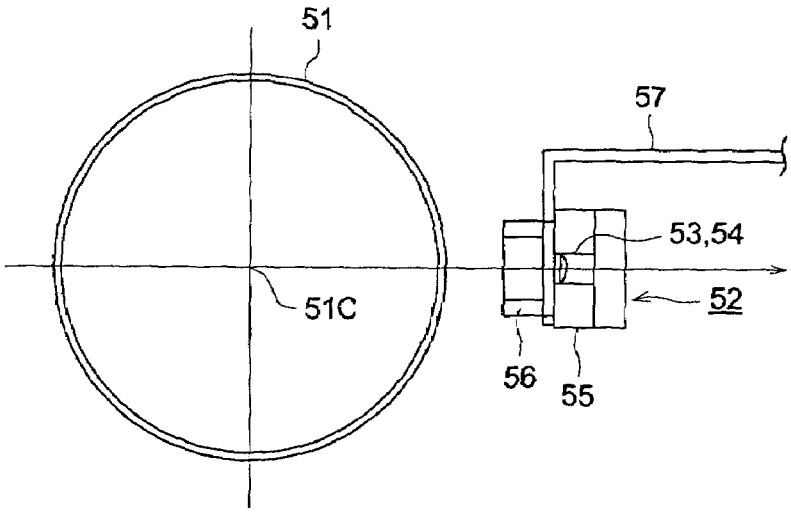
Figure 8:
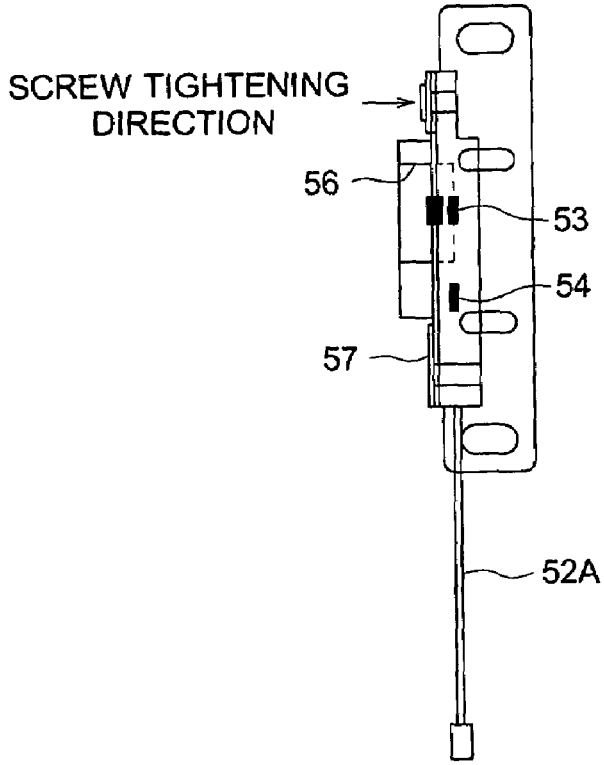
Figure 9:
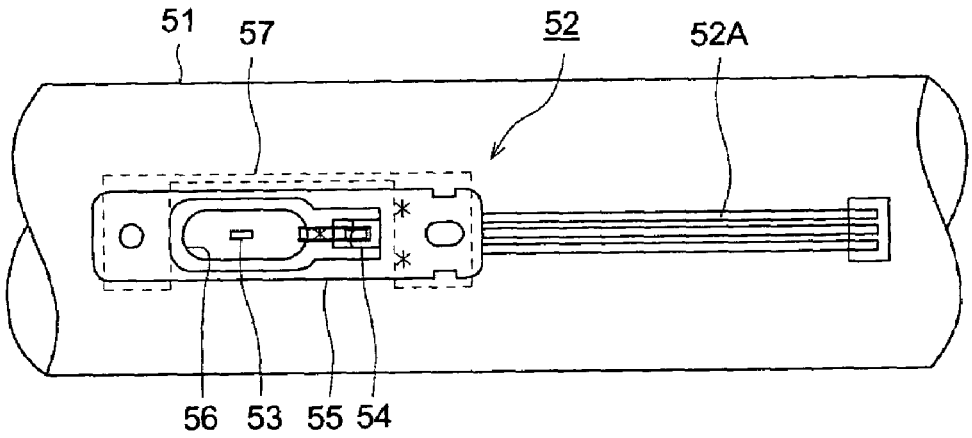
Figure 10:
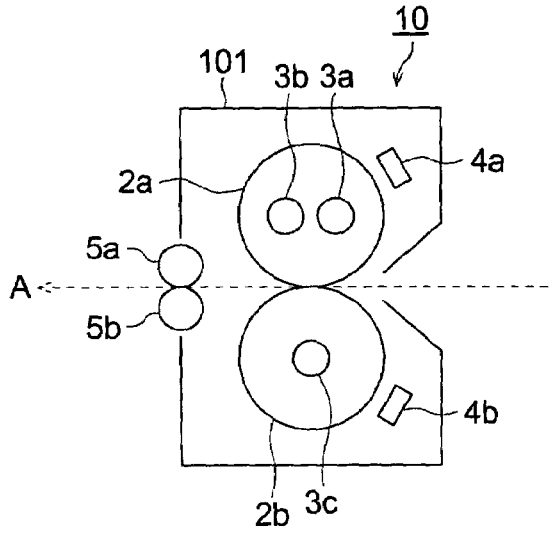
Figure 11:
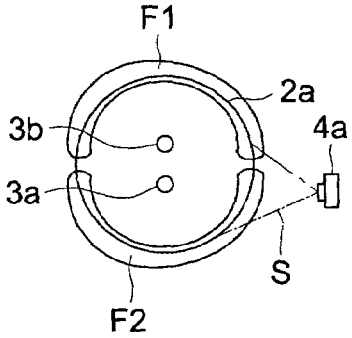
Figure 11:
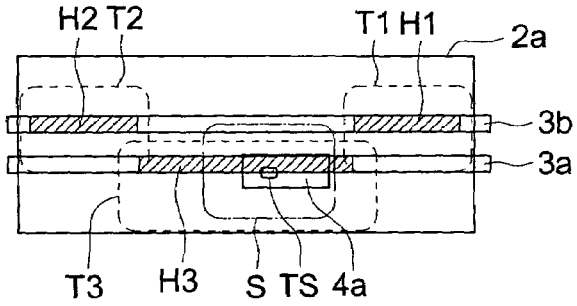
Figure 13:
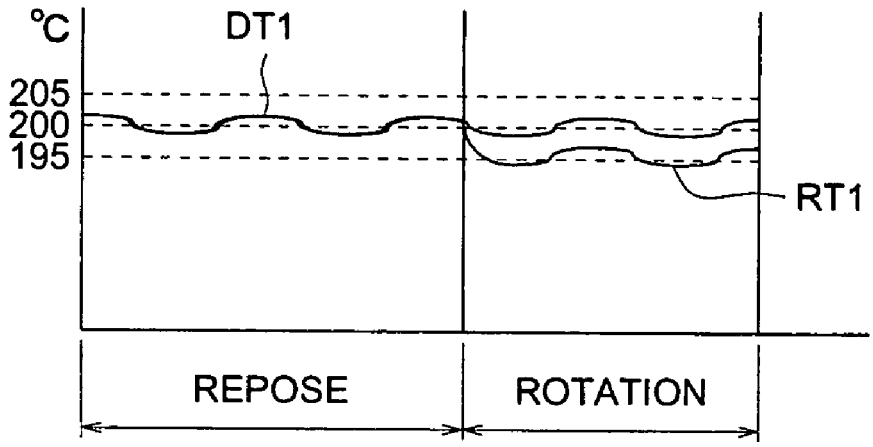
Figure 13:
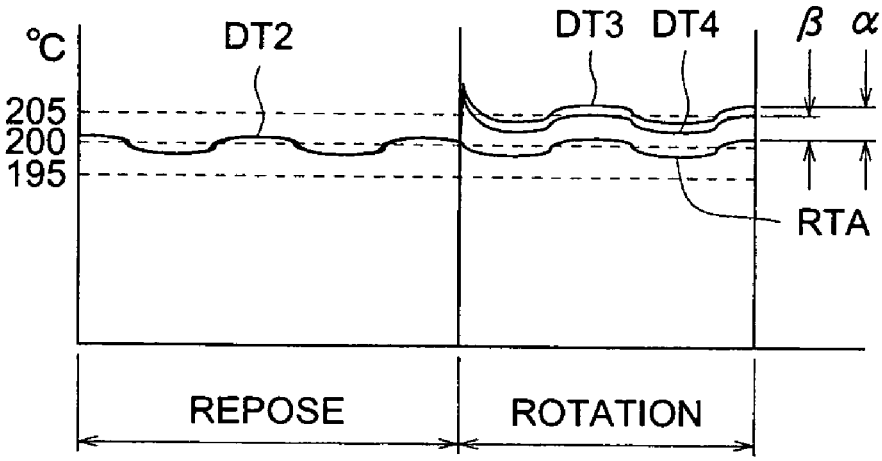
Figure 14:
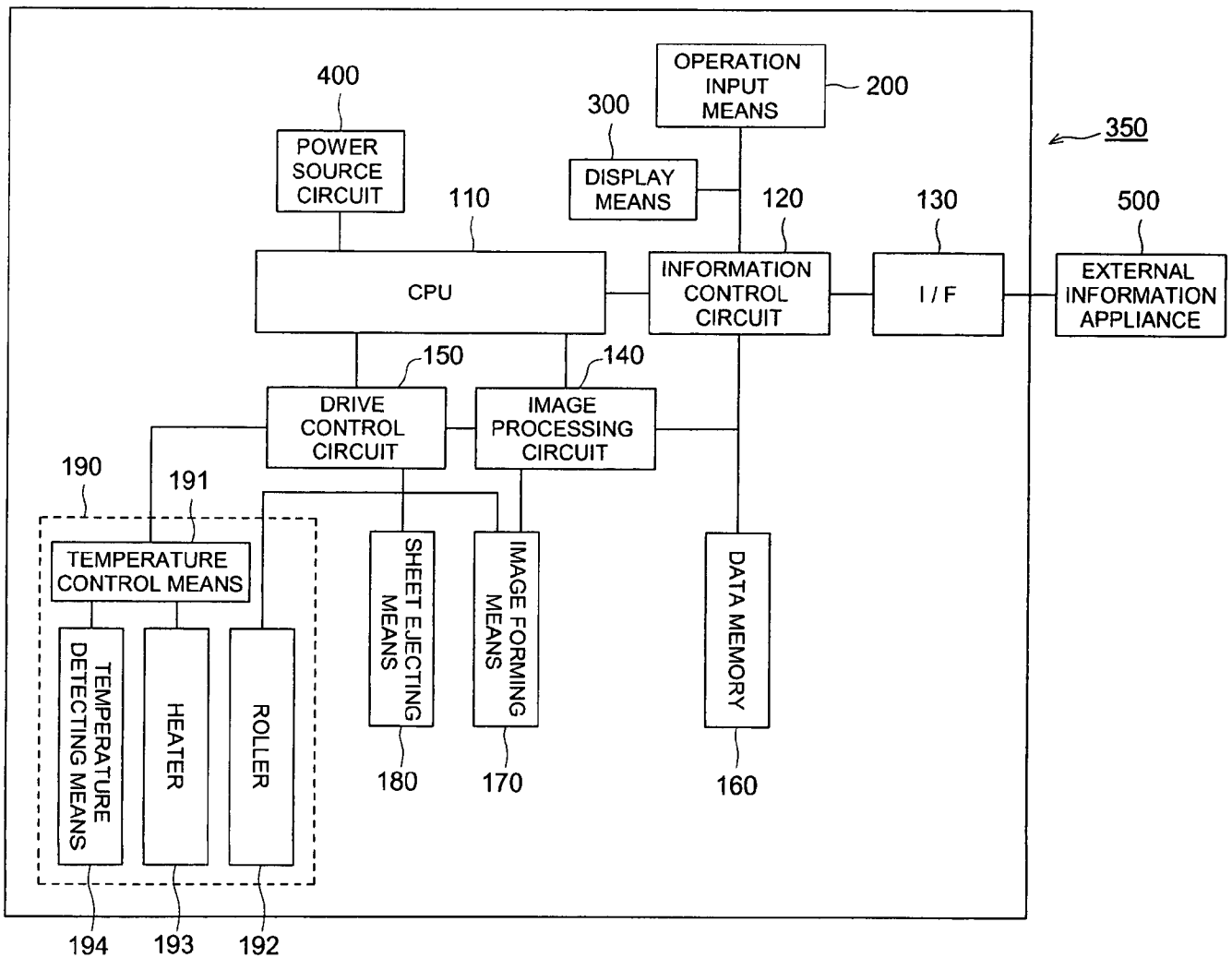
Figure 15:
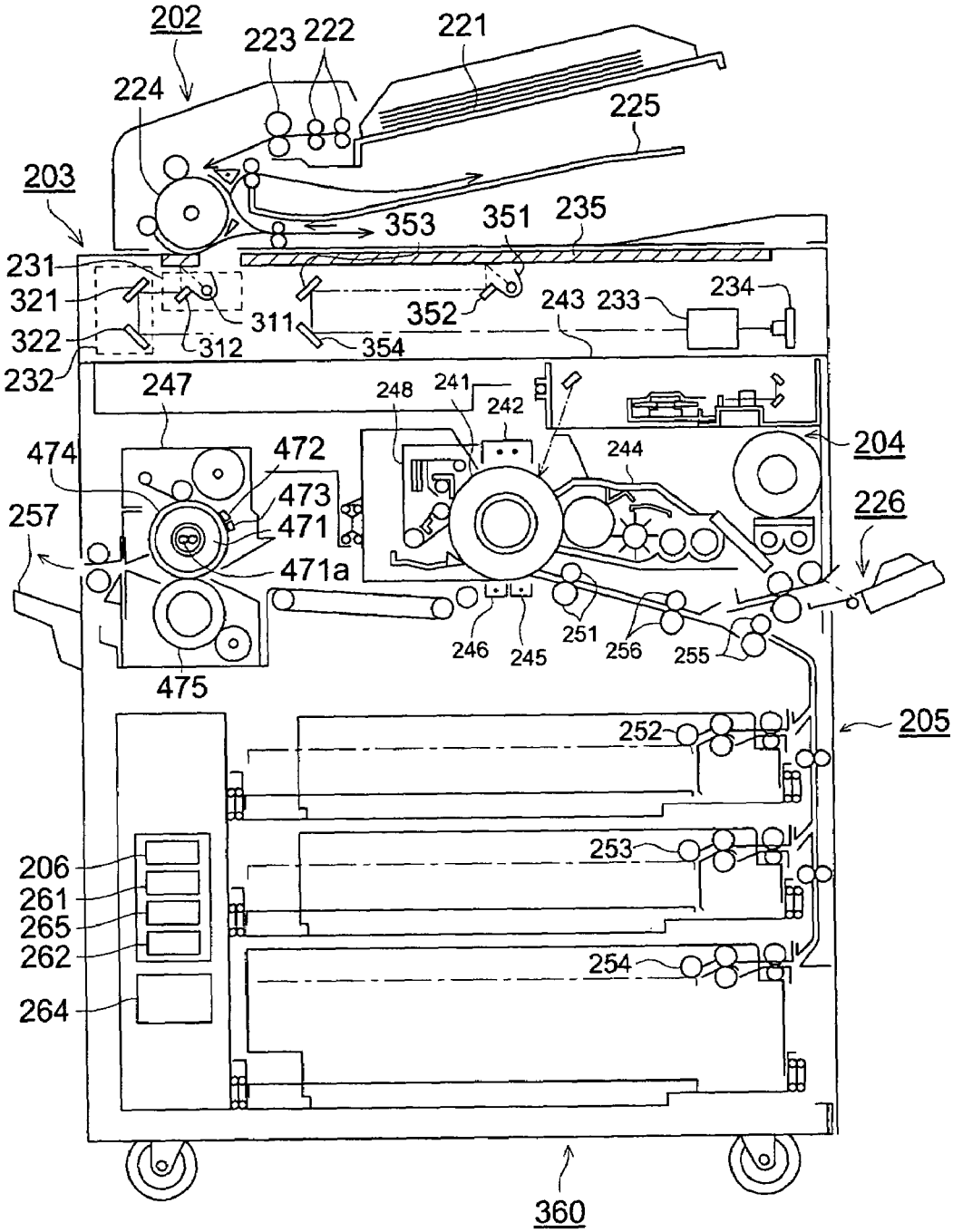
Figure 16:
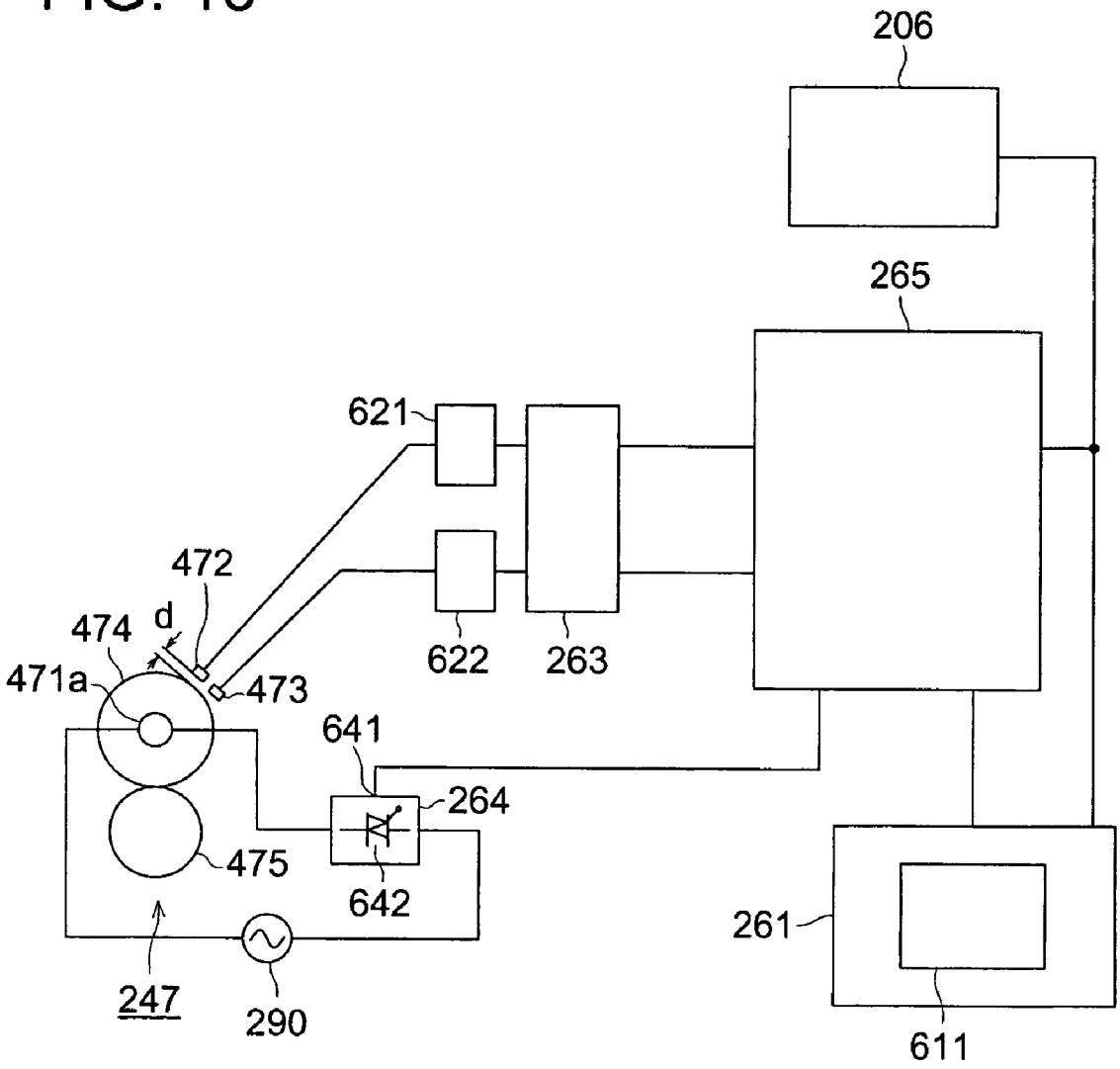
Figure 17:
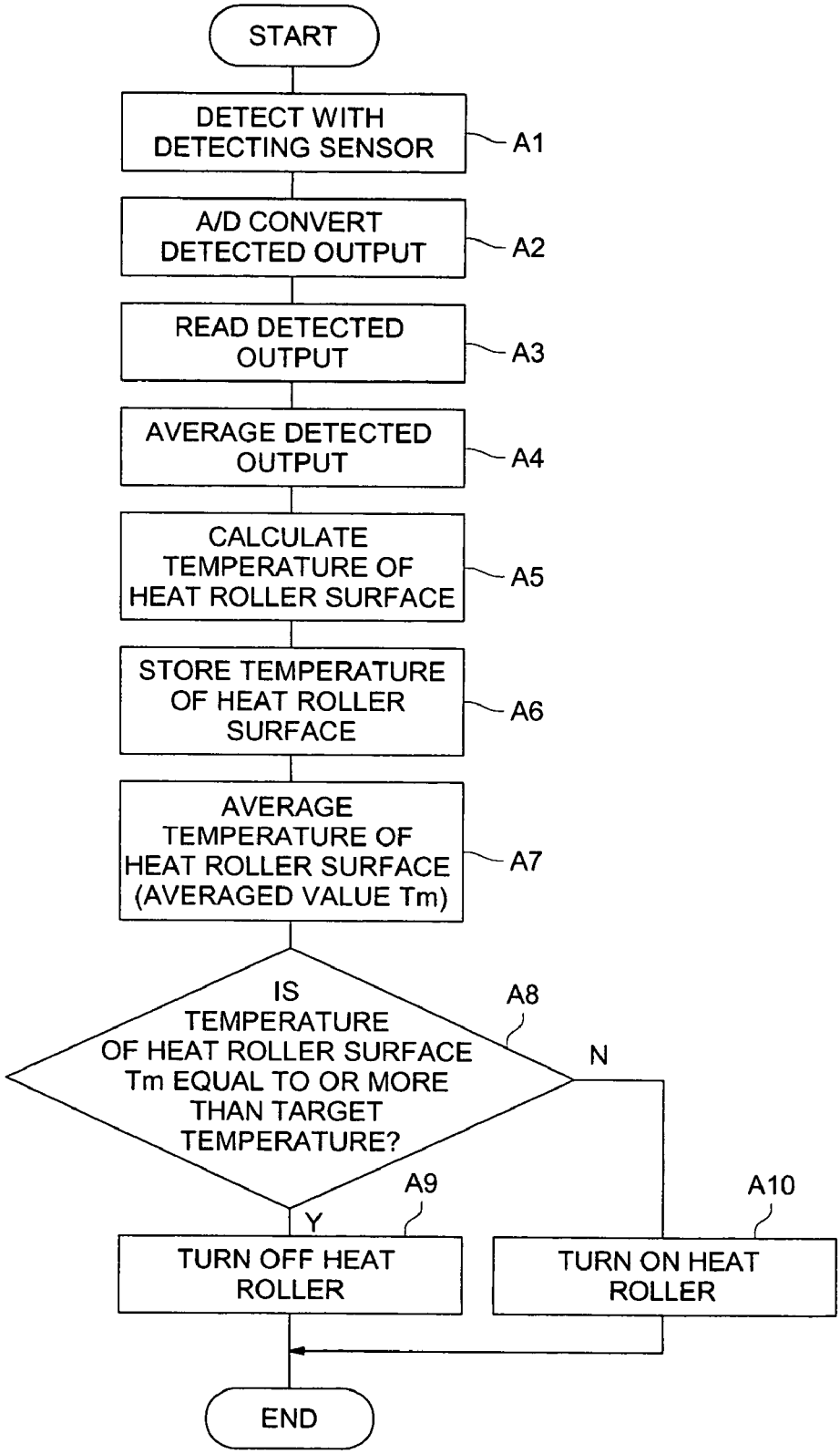
Figure 18:
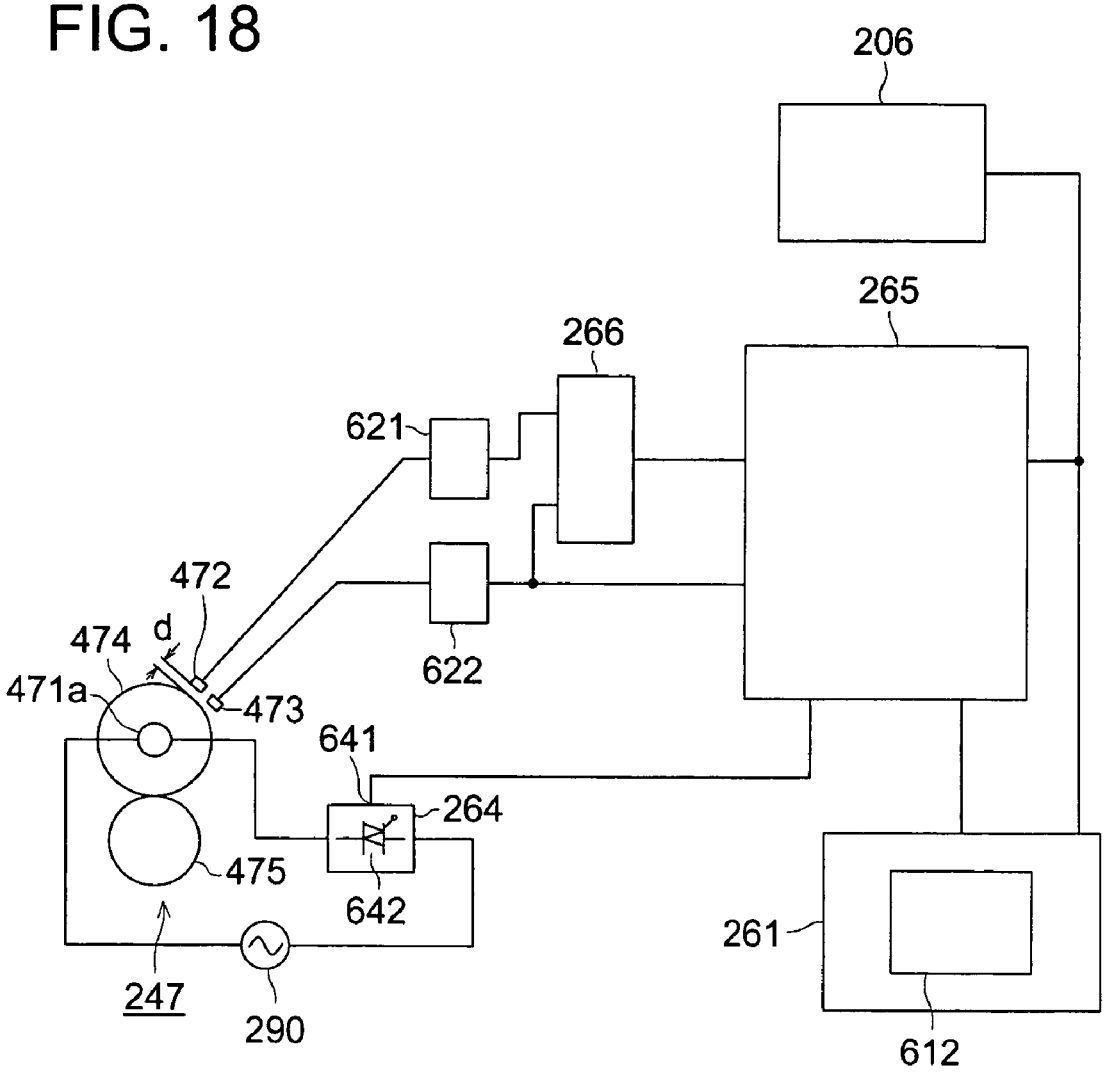
Figure 19:
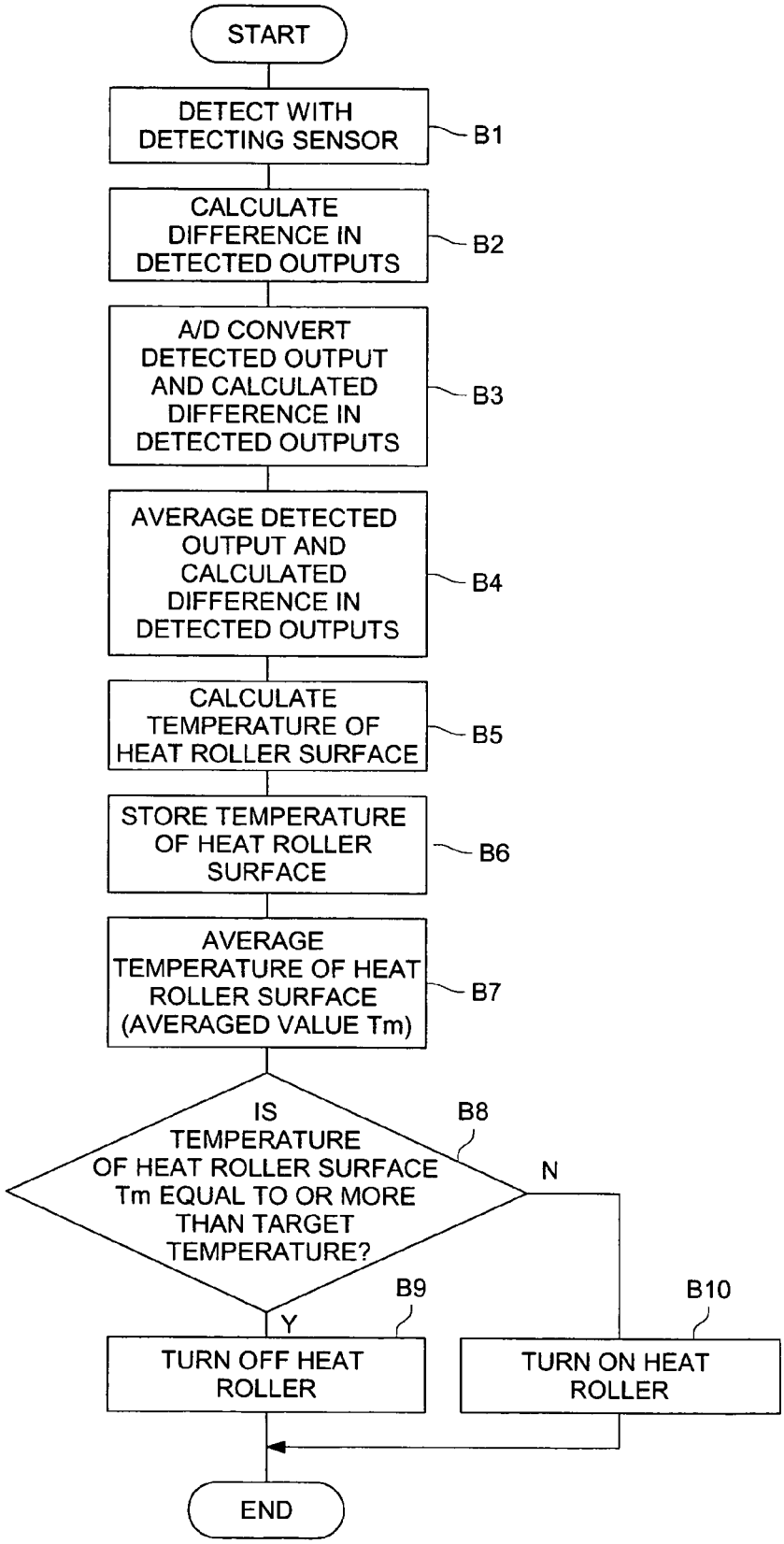
Figure 20:
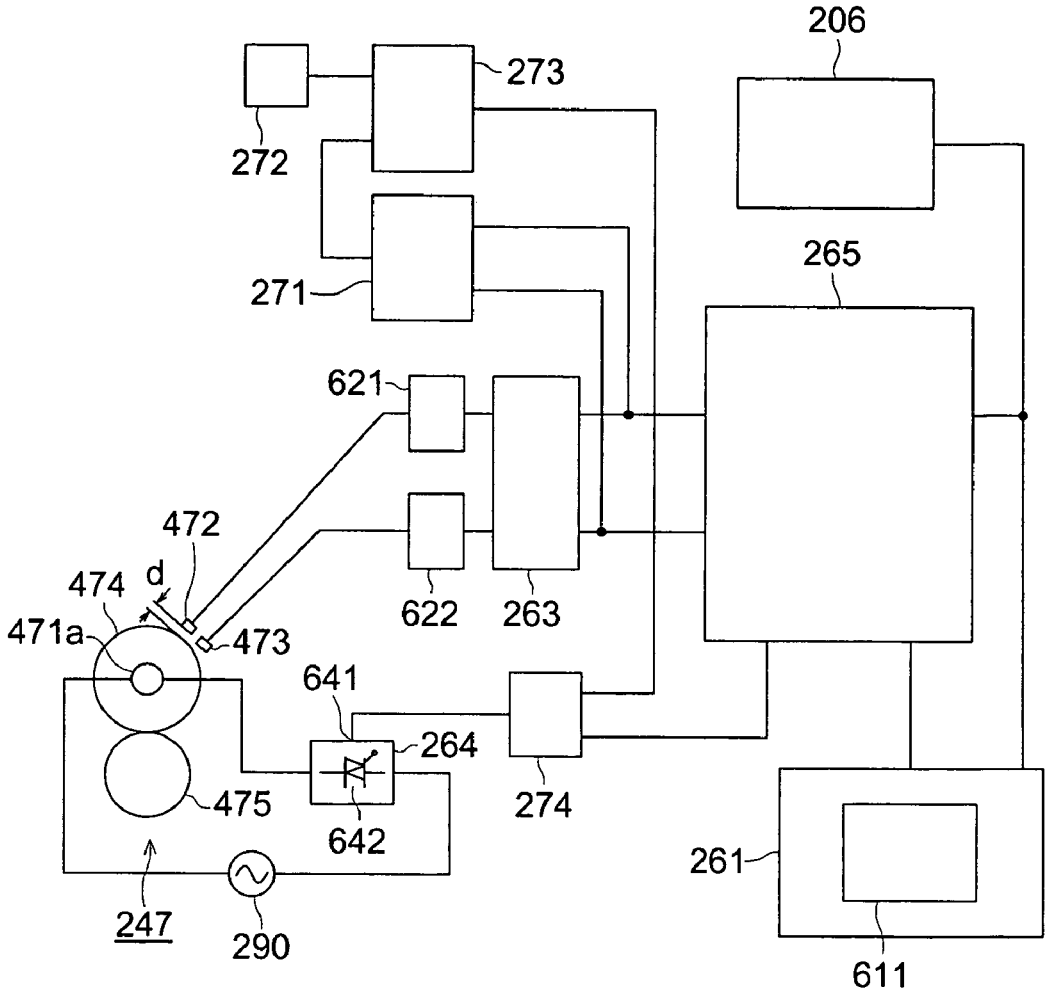
Figure 21:
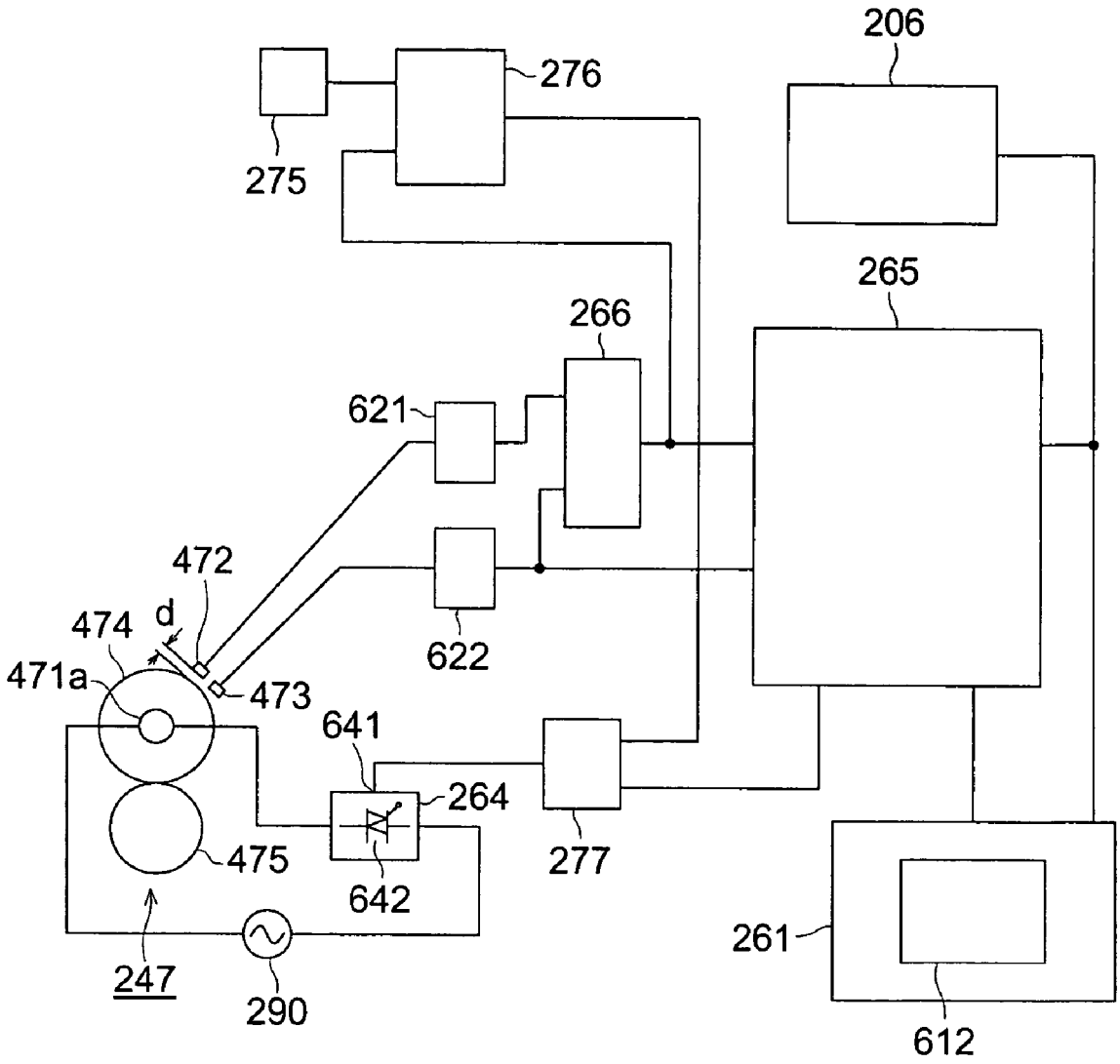
Figure 23:
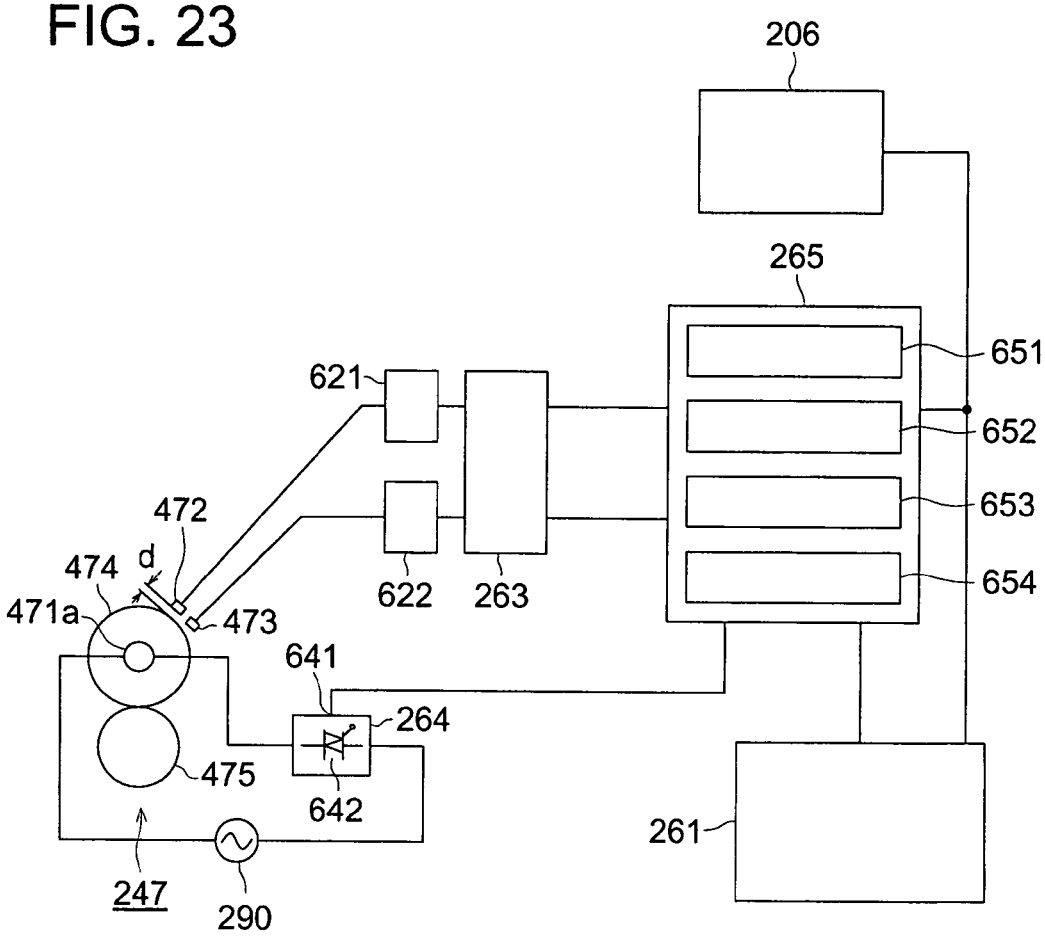
Figure 24:
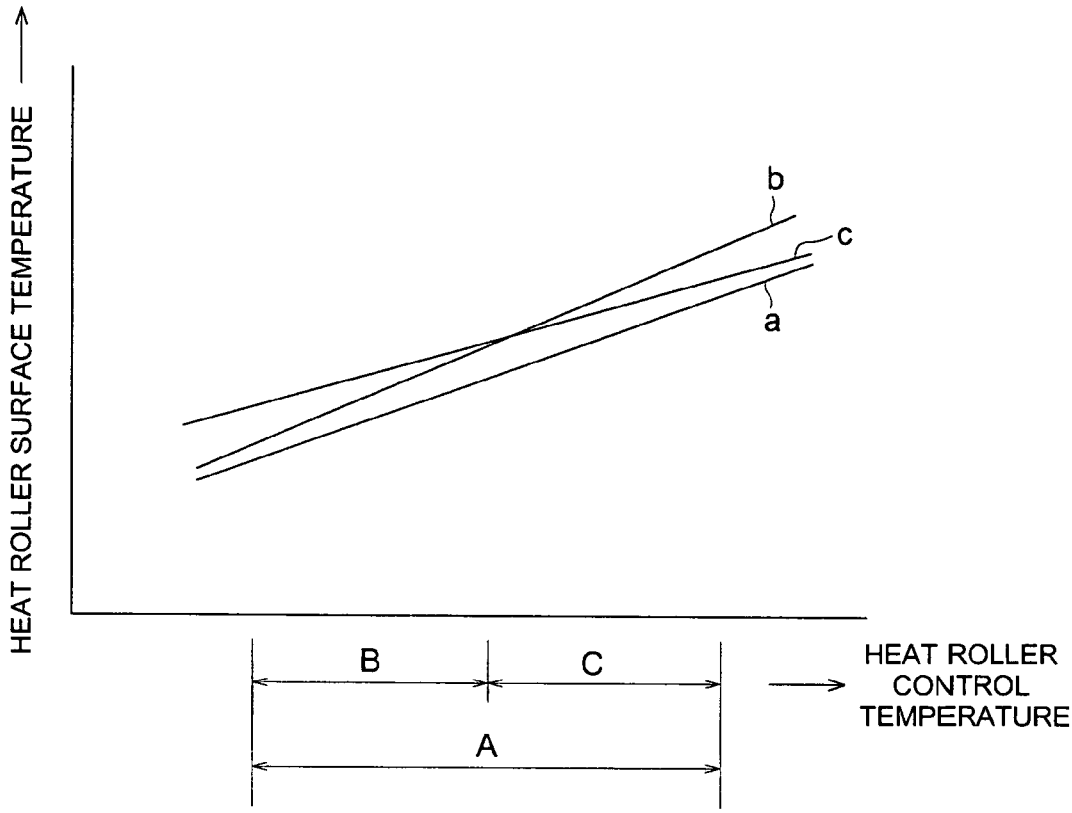
Figure 25:
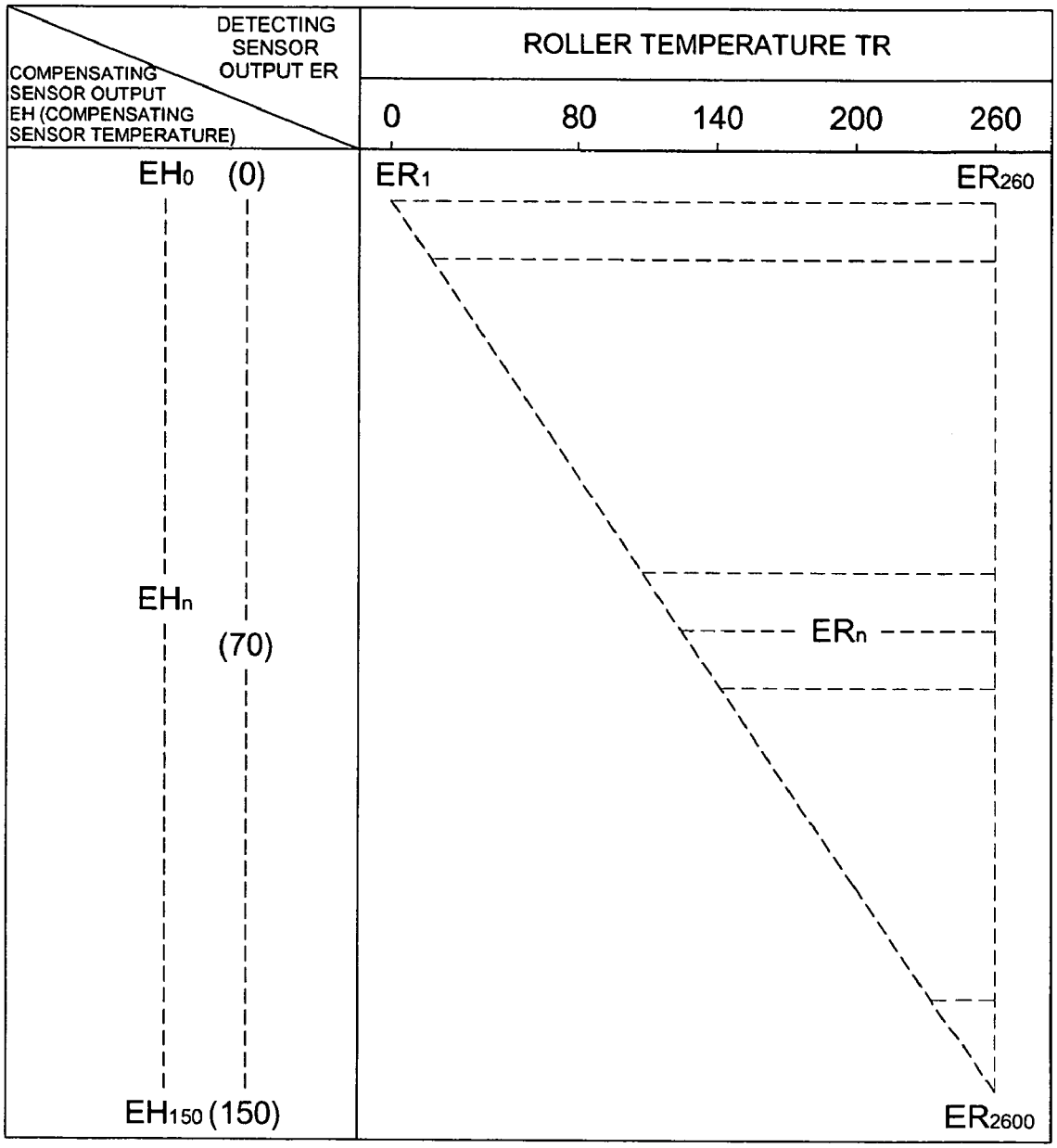
Figure 27:
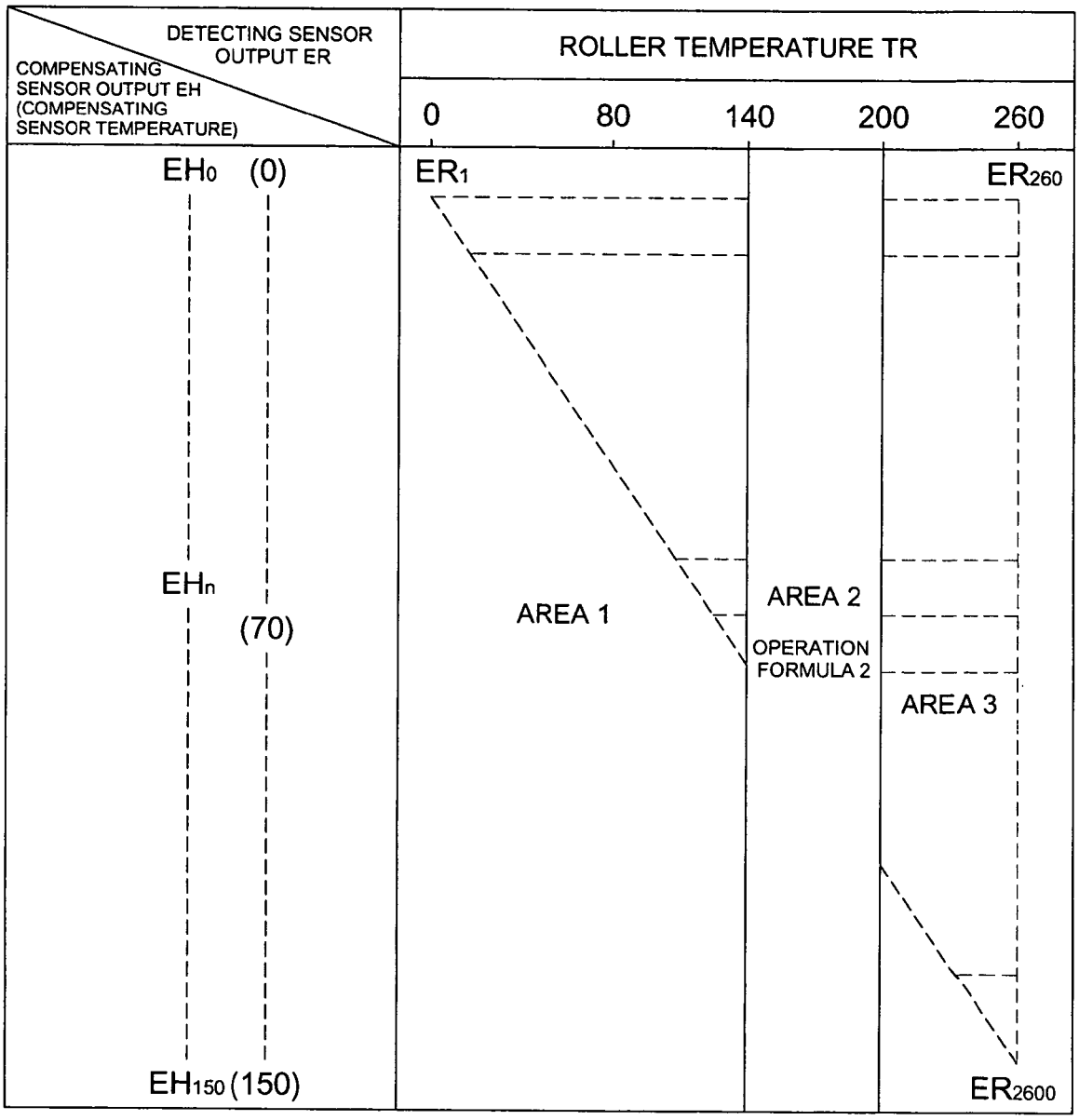
Figure 28:
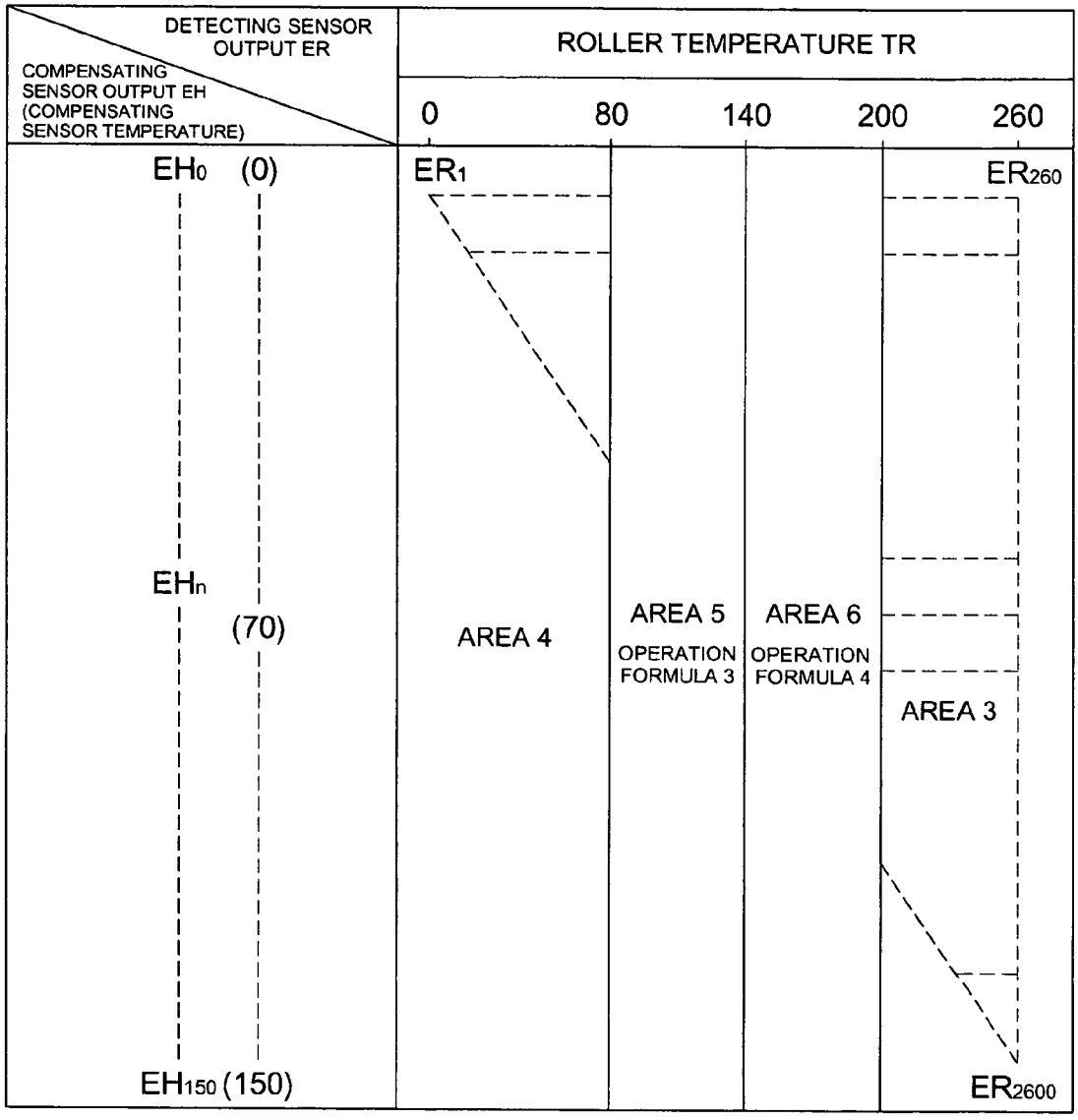
Figure 29:
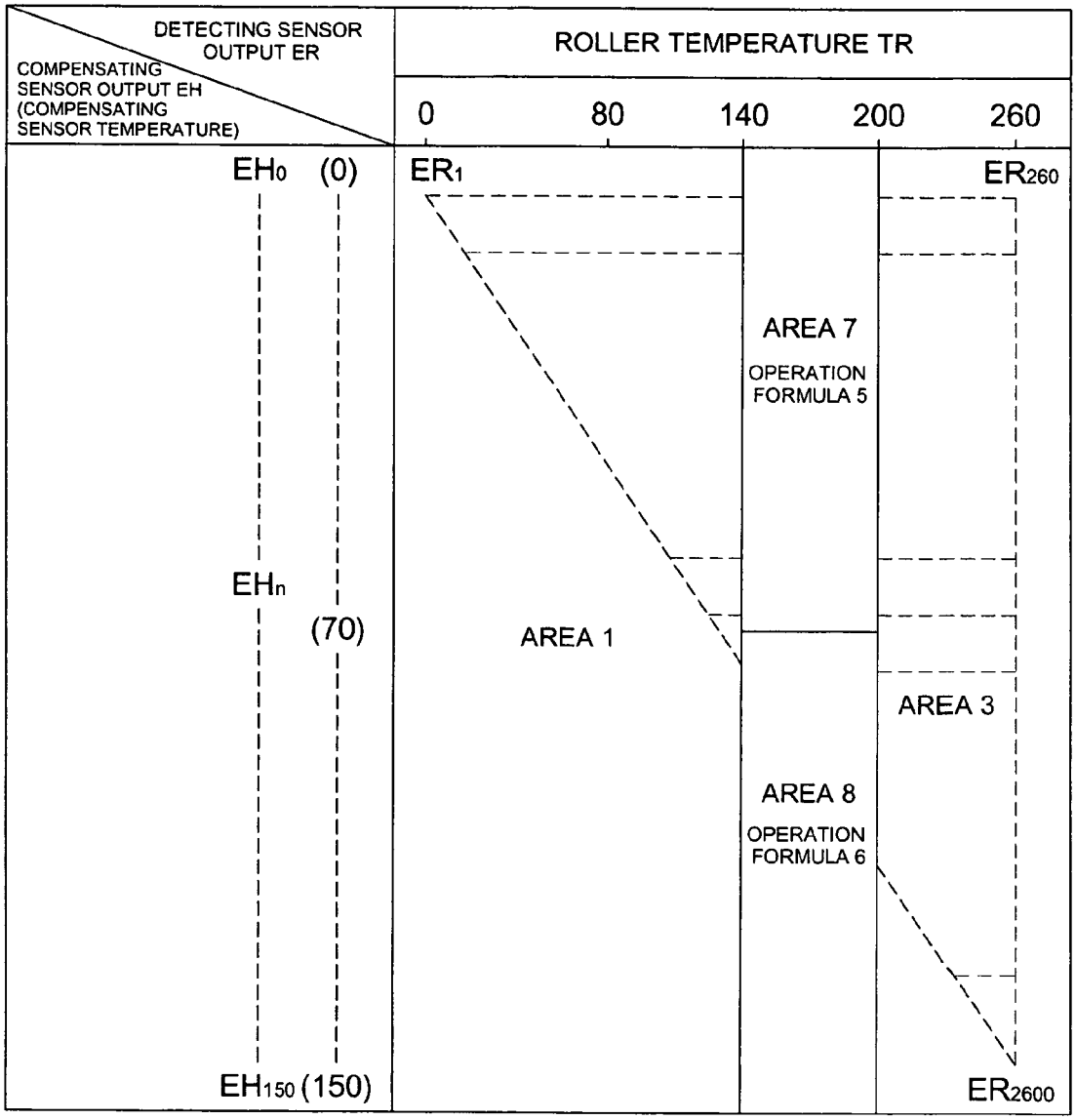
Figure 30:
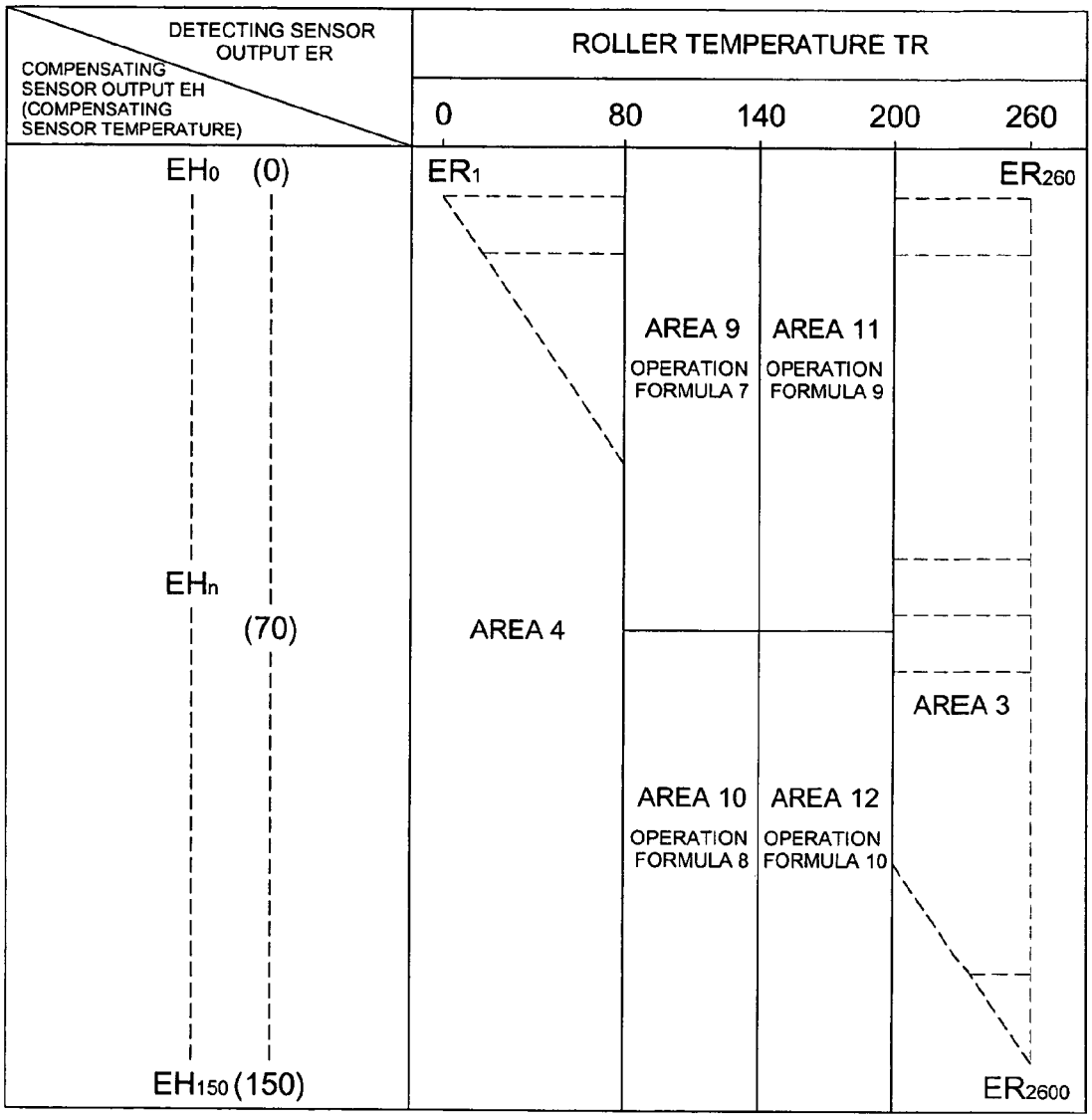
Figure 31:
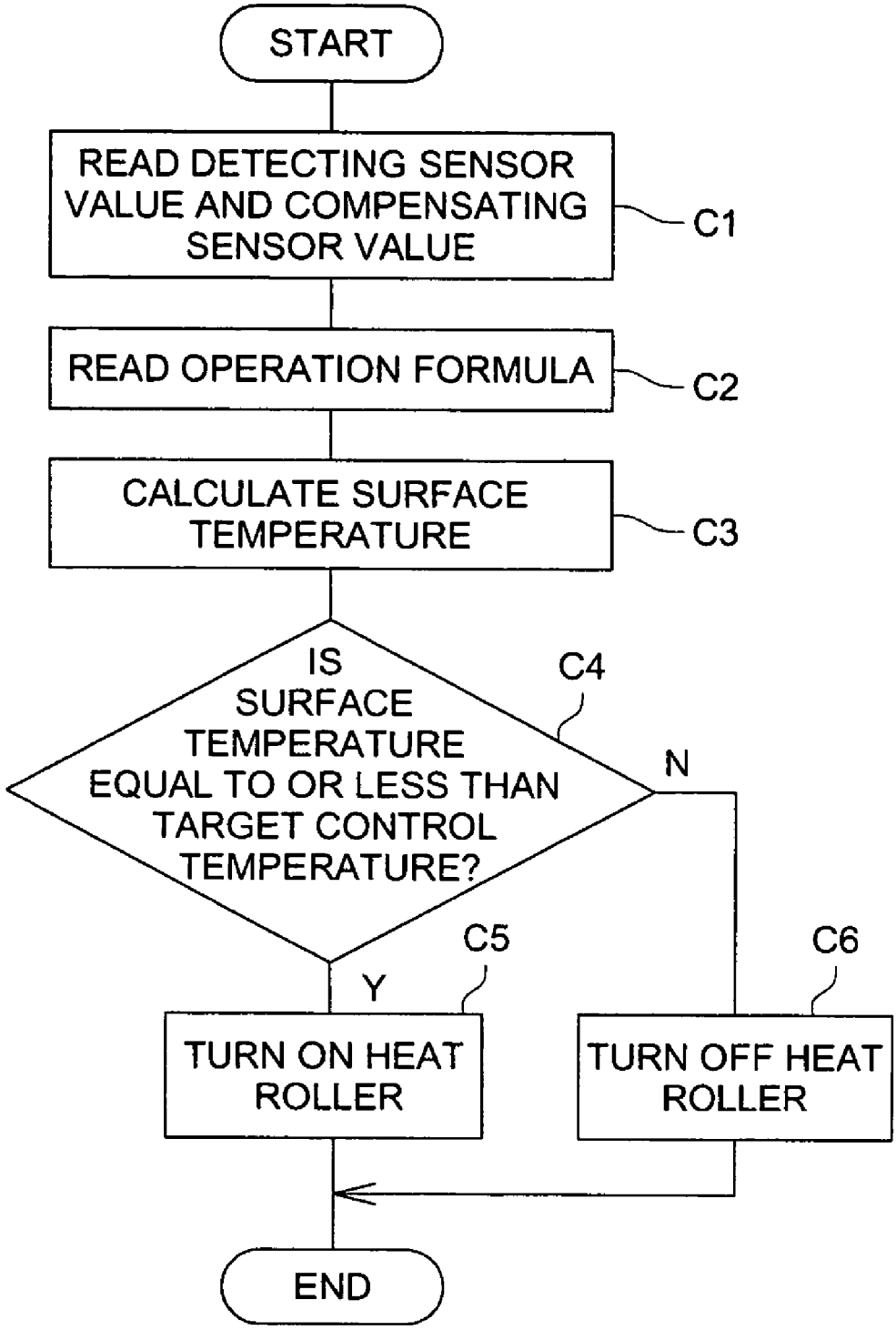
Figure 32:
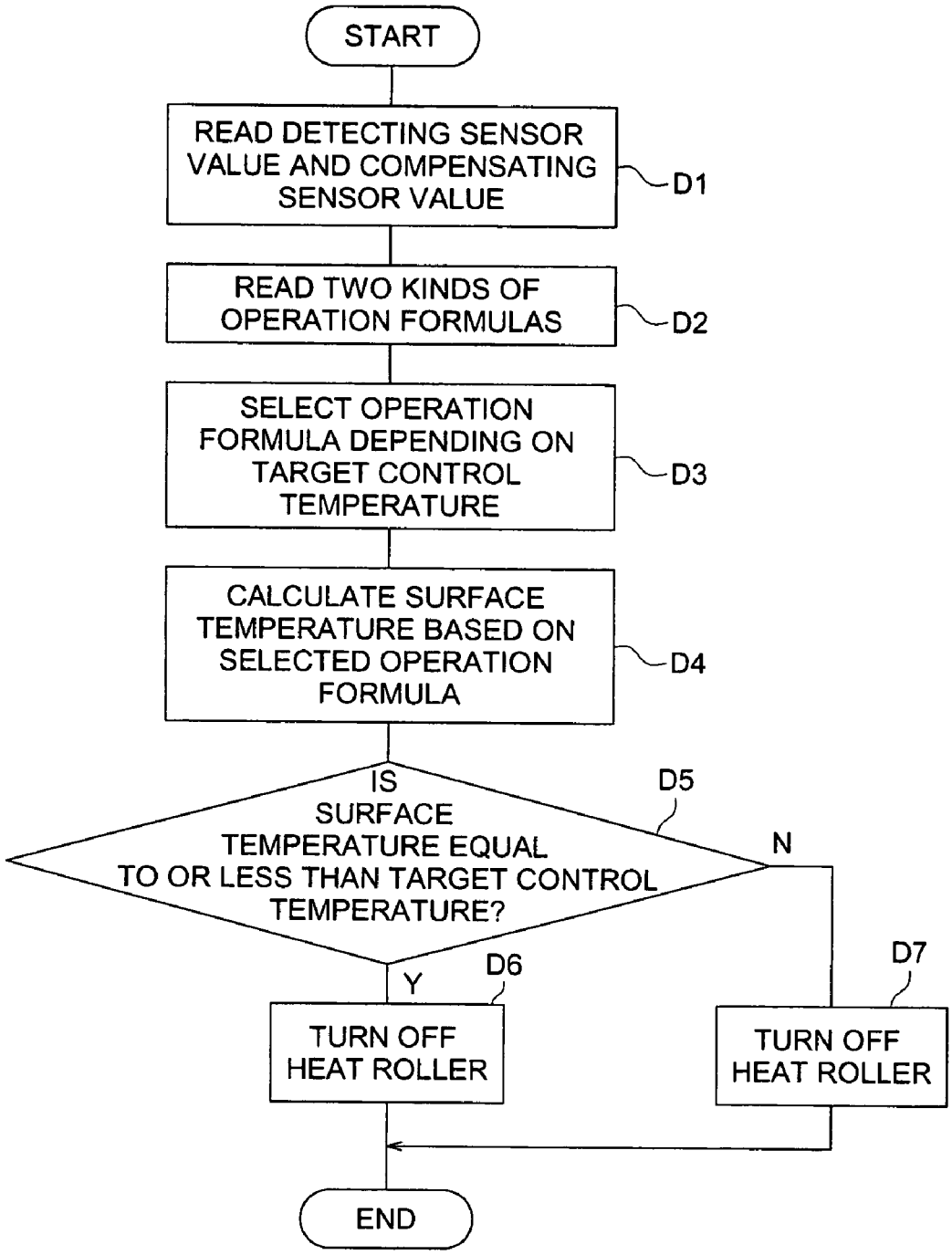
Figure 33:
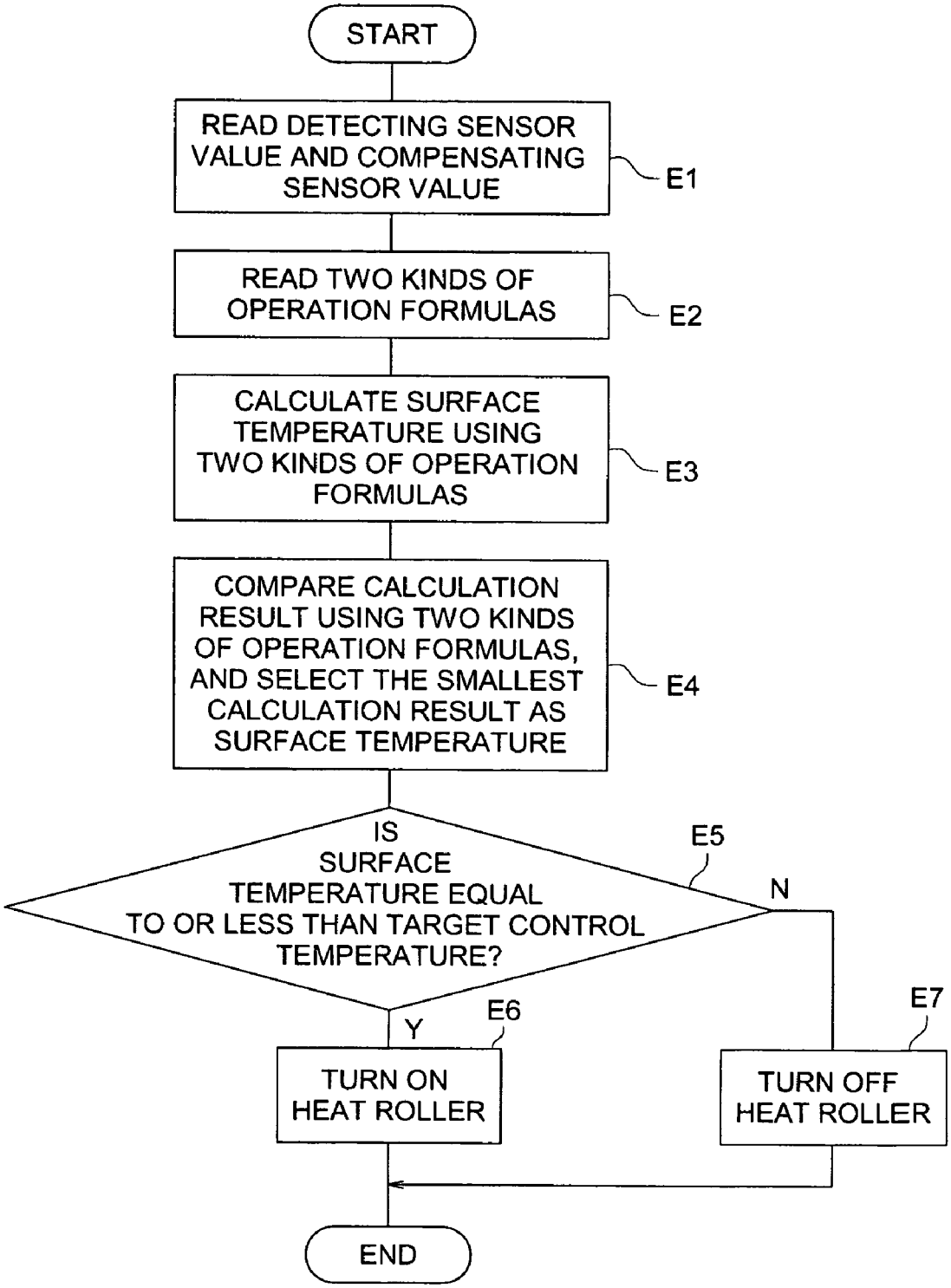
Figure 34:
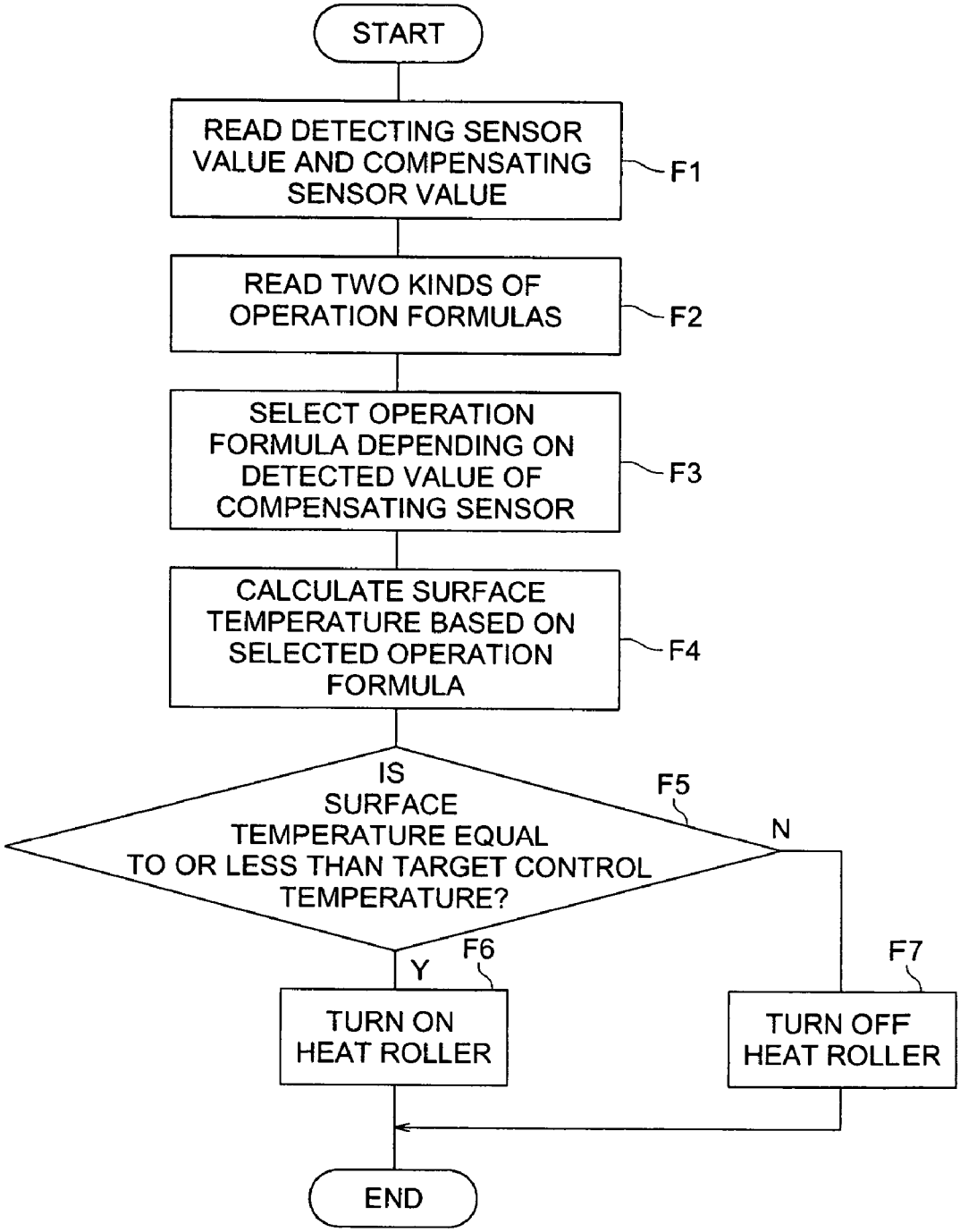
Figure 35:
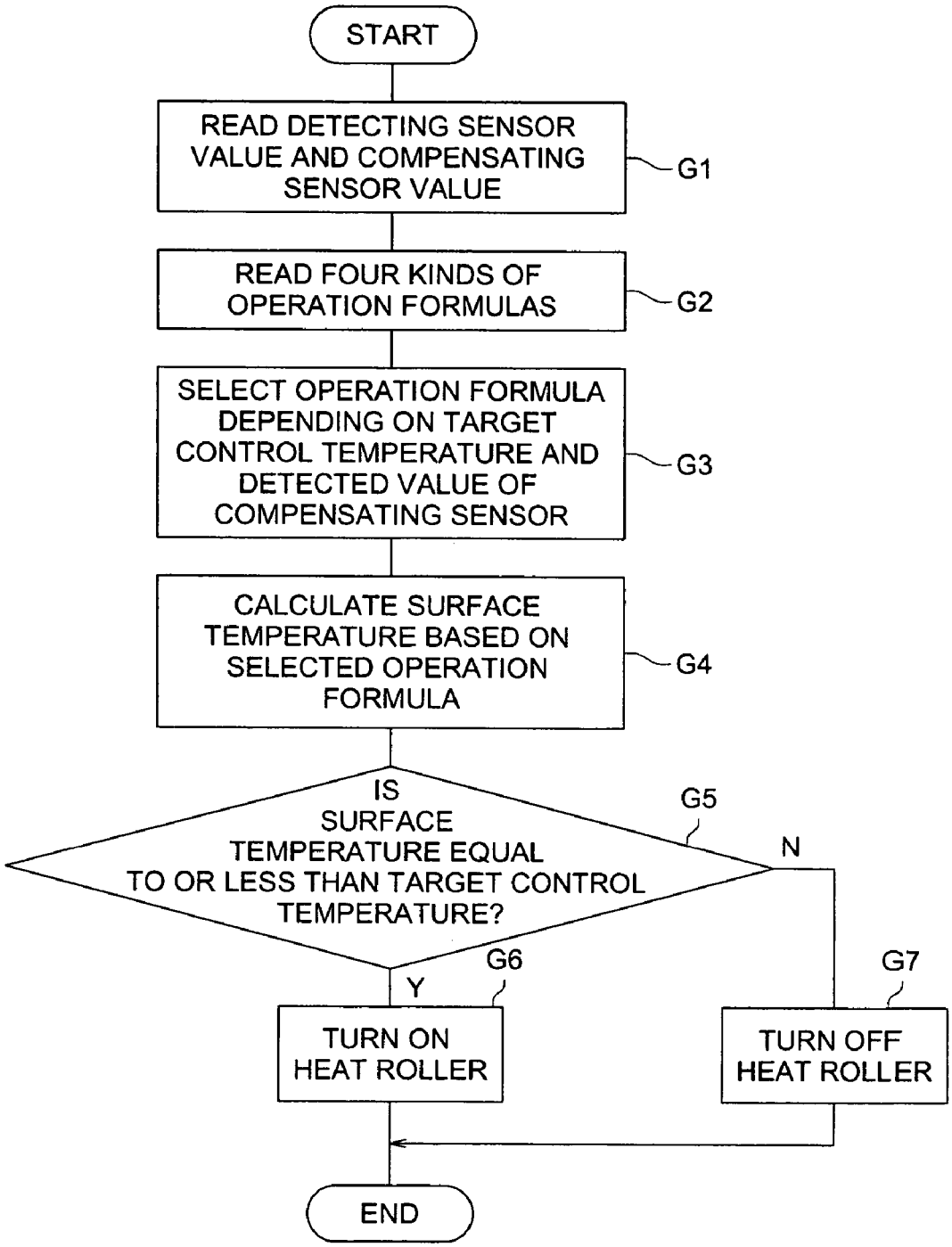
Figure 36:
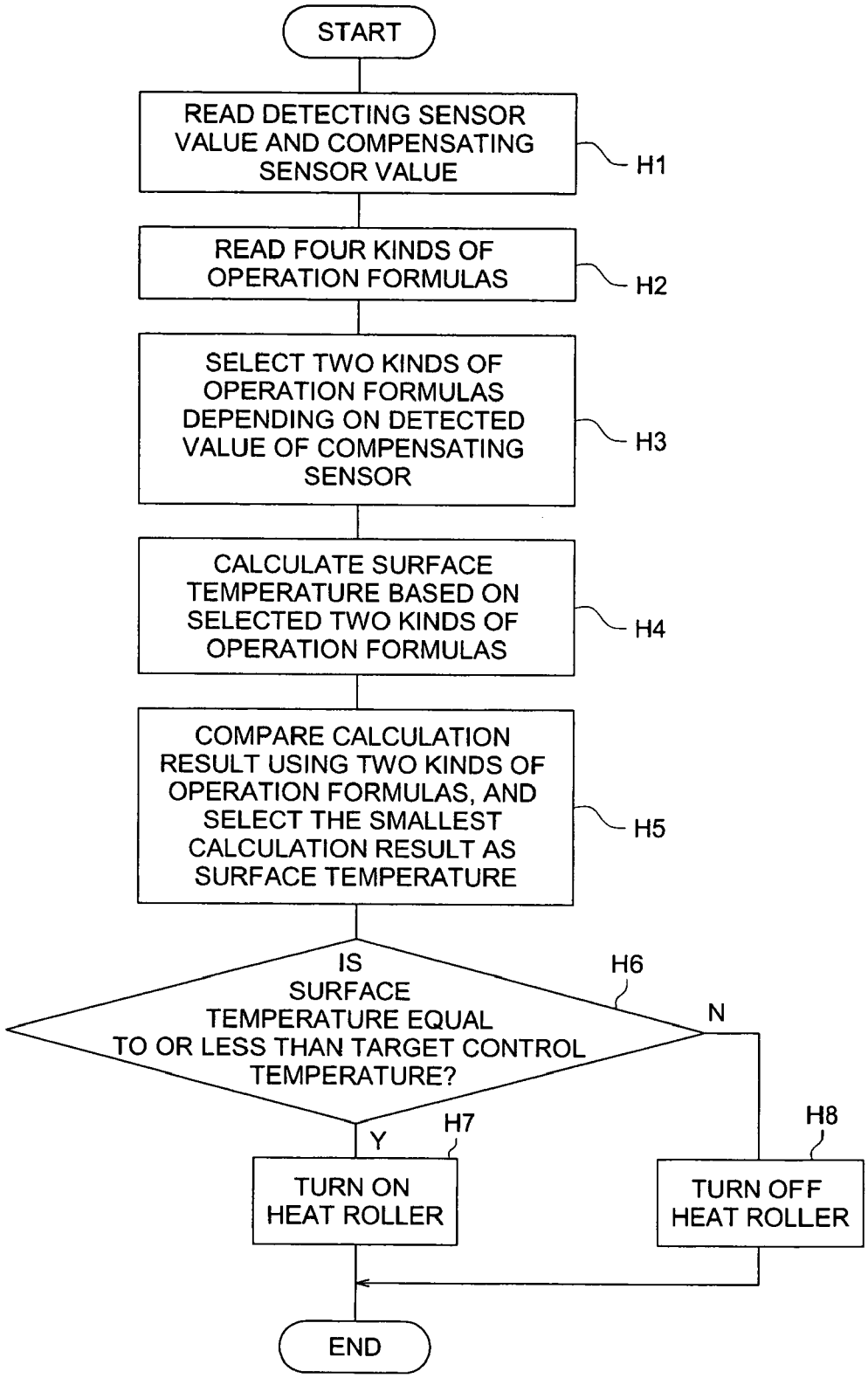
Figure 37:
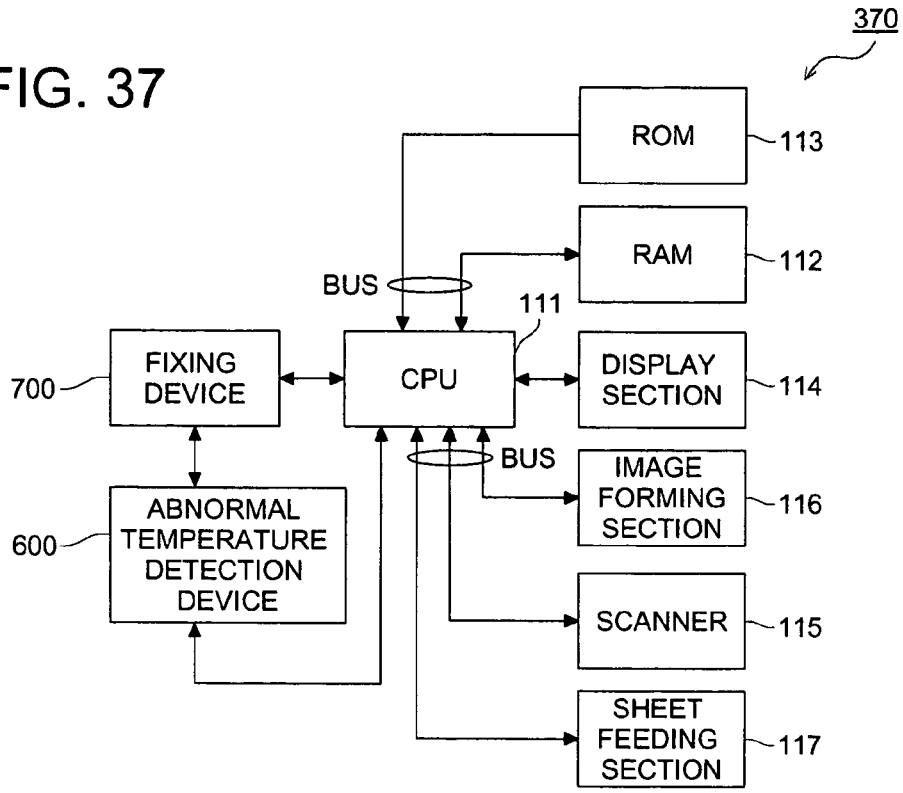
Figure 38:
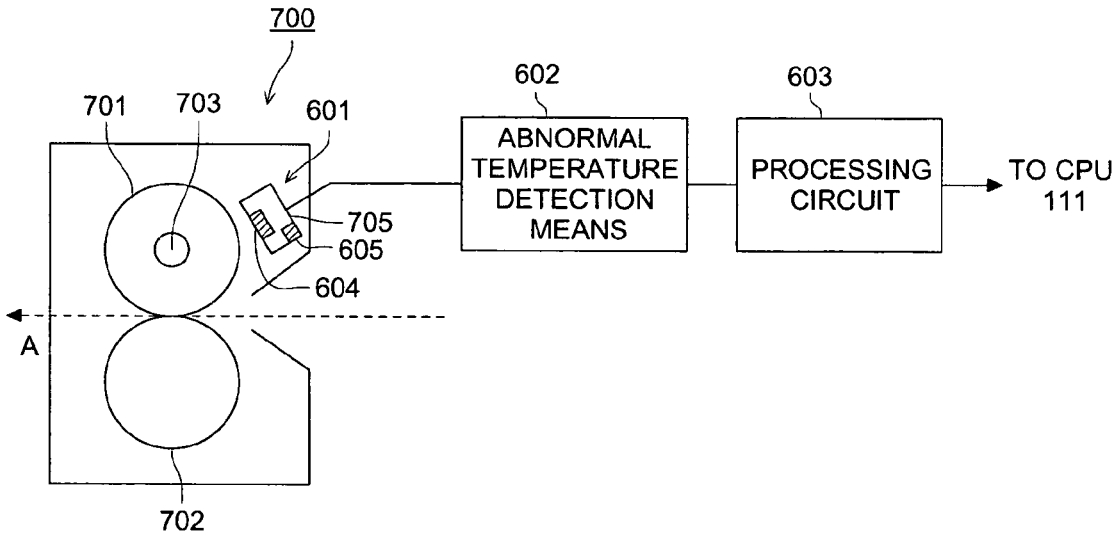
Figure 39:
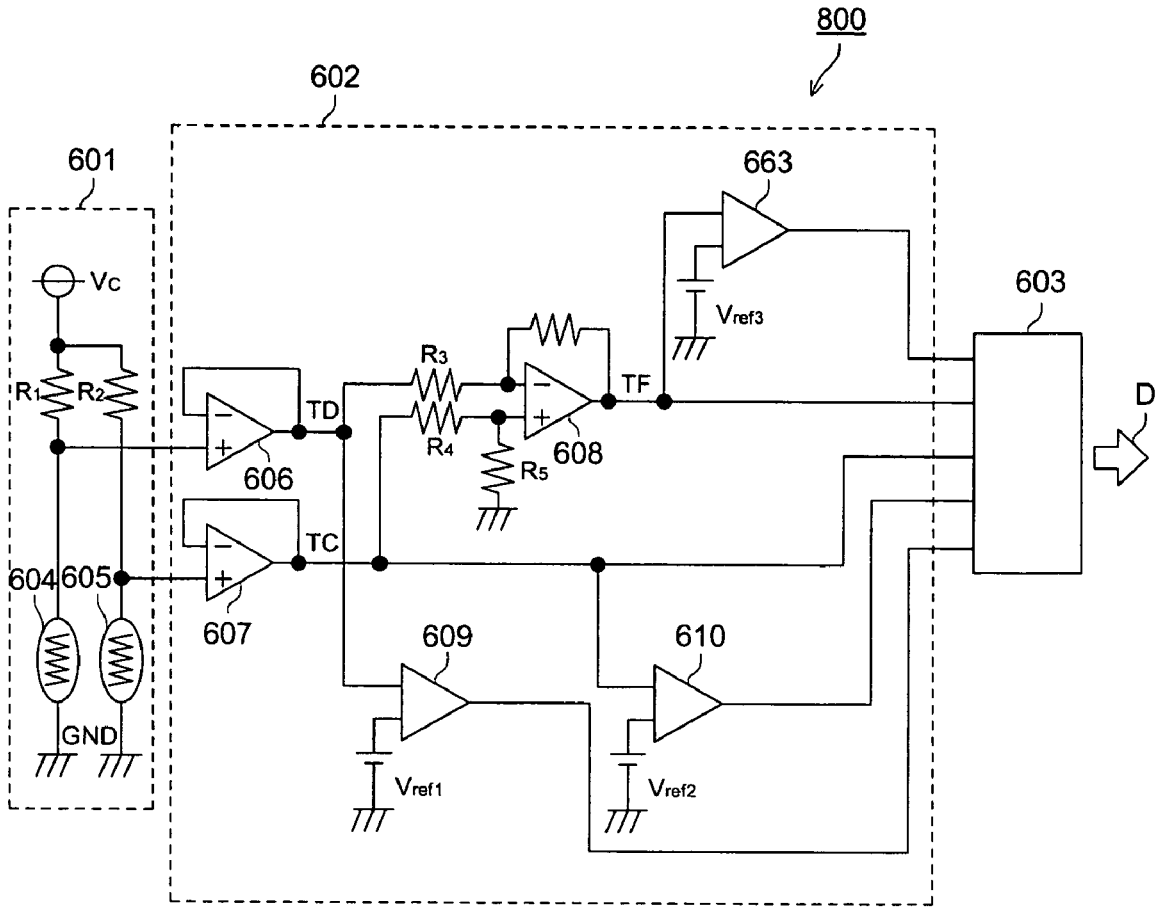
Figure 40:
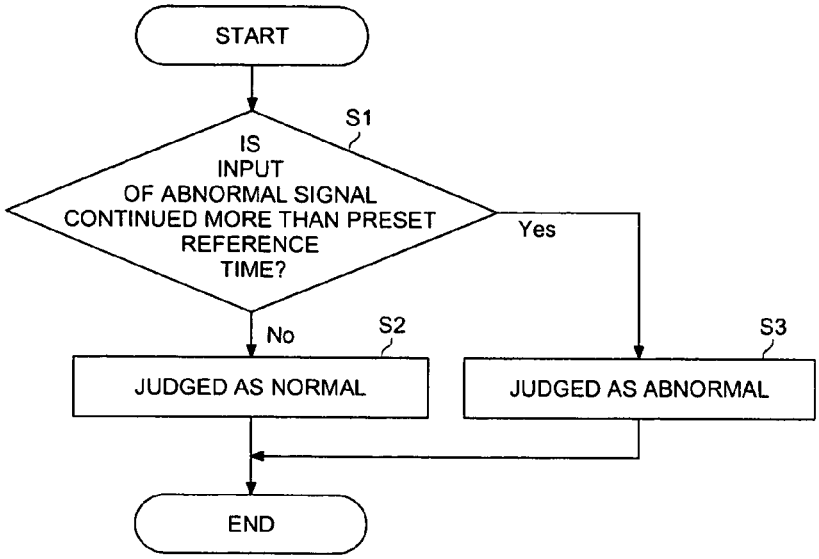
Figure 41:
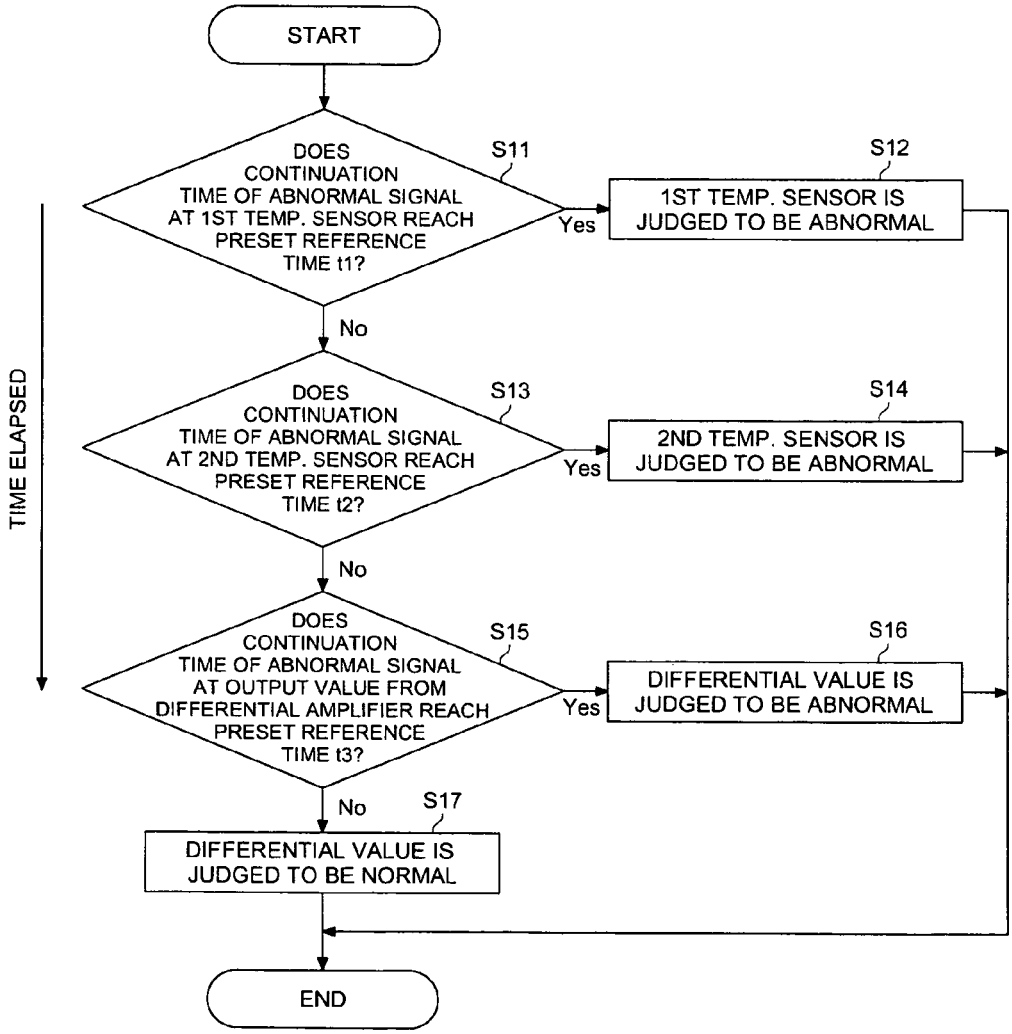
Figure 42:
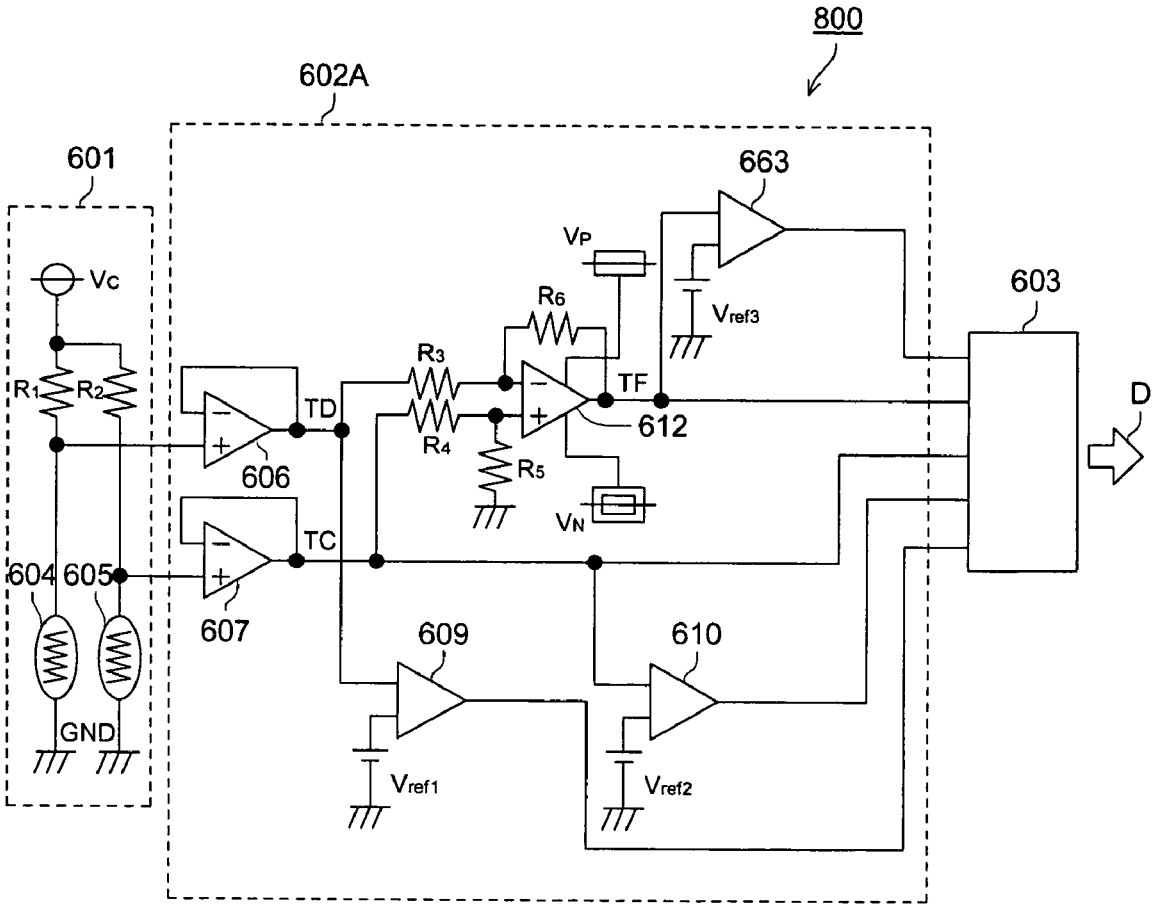
Figure 43:
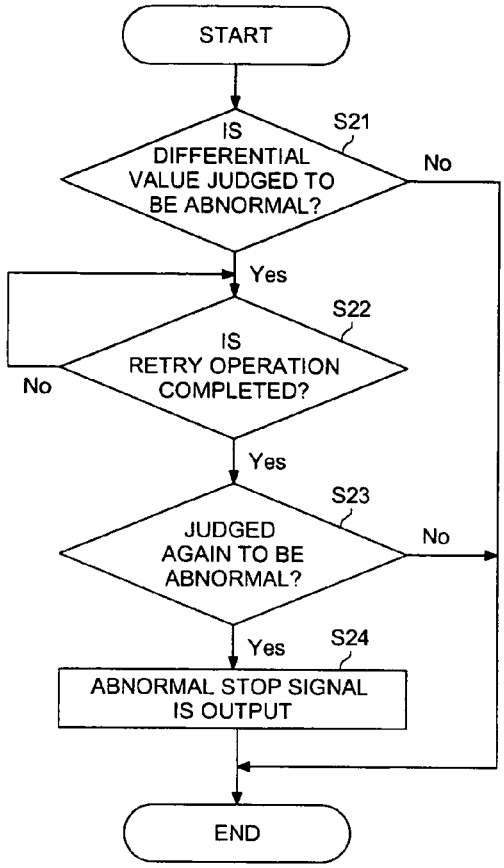
Figure 44:
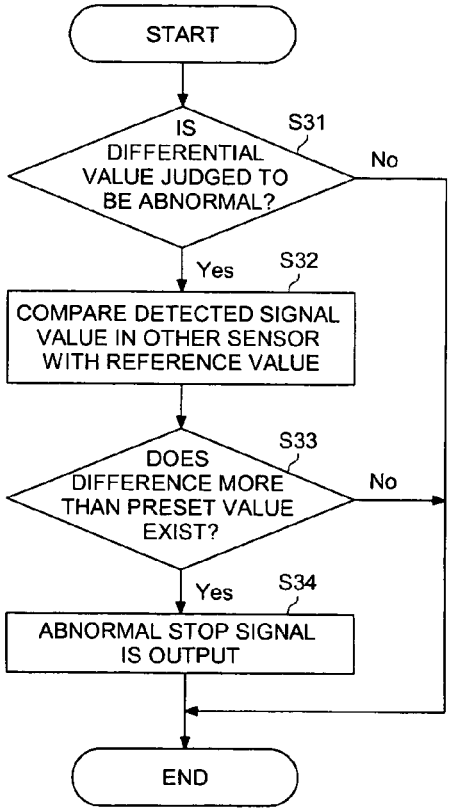
Figure 45:
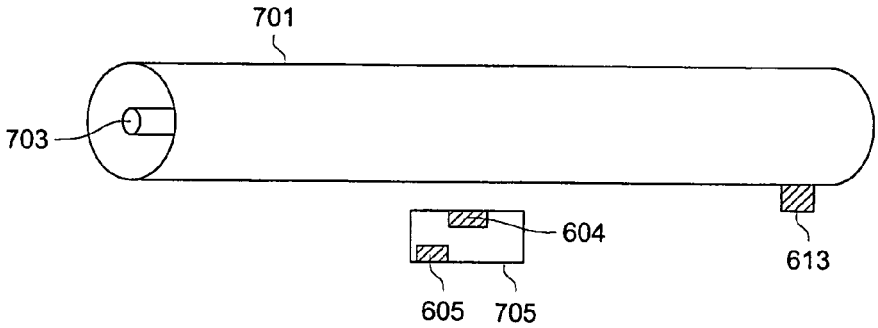
Figure 46:
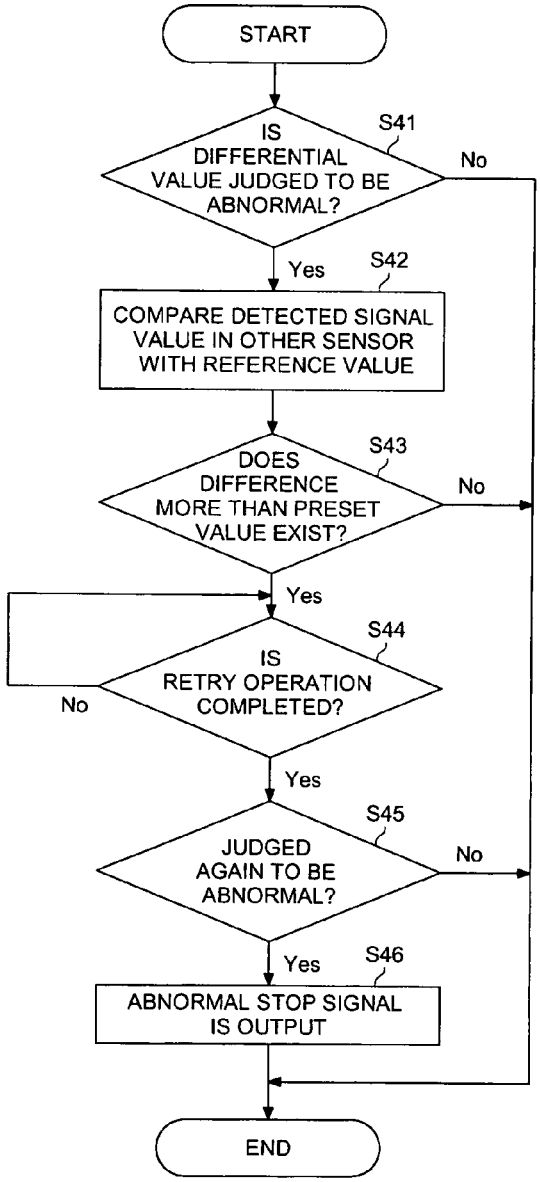
Figure 47:
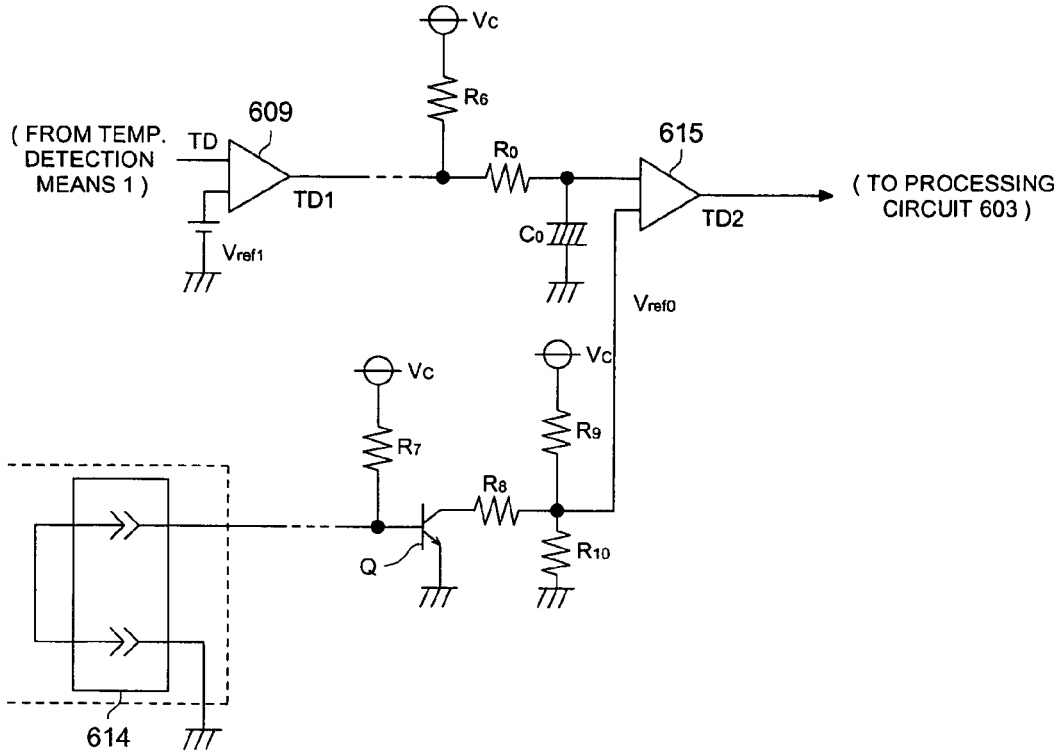

FIG. 4(*a*) and FIG. 4(*b*) are the front cross-sectional views each showing the allowable ranges of placement of a temperature detecting device placed in non-contact with the heating roller of a fixing device;

FIG. 5 is a schematic drawing showing a turbulent state of the heat convection etc. when a temperature detecting device placed in non-contact with the heating roller of a fixing device is located outside the allowable range of placement;

FIG. 6 is a schematic drawing showing the allowable range of inclination of the sensor surface facing a heating roller surface;

FIG. 7 is the front view showing an example of a temperature detecting device with a case for accommodating two sensors and a mounting plate positioned opposite to a heating roller;

FIG. 8 is the top view showing the state of two sensors being fitted in a case;

FIG. 9 is a side view showing the state of two sensors being fitted in a case;

FIG. 10 is a fixing device for use in an image forming apparatus for accomplishing the second object of this invention;

FIG. 11(*a*) and FIG. 11(*b*) are temperature distribution drawings of a fixing roller of this invention;

FIG. 12(*a*) and FIG. 12(*b*) are schematic drawings each showing the relation between a fixing roller and a temperature detecting means of this invention;

FIG. 13(*a*) and FIG. 13(*b*) are graphs each showing a temperature control of a fixing roller of this invention;

FIG. 14 is a block diagram showing the circuit structure of an image forming apparatus of this invention;

FIG. 15 is an illustrative drawing of an image forming apparatus showing the embodiment for accomplishing the third object of this invention;

FIG. 16 is an illustrative drawing showing the embodiment 1 of this invention;

FIG. 17 is a flow chart showing a control method of the embodiment 1 of this invention;

FIG. 18 is an illustrative drawing showing the embodiment 2 of this invention;

FIG. 19 is a flow chart showing a control method of the embodiment 2 of this invention;

FIG. 20 is an illustrative drawing showing an abnormality detecting means and a control method of the embodiment 3 of this invention;

FIG. 21 is an illustrative drawing showing an abnormality detecting means and a control method of the embodiment 4 of this invention;

FIG. 22(*a*) and FIG. 22(*b*) are conceptual drawings of data tables each;

FIG. 23 is a control block diagram of the embodiment 4 for accomplishing the fourth object of this invention;

FIG. 24 is a graph showing the result of the calculation using plural equations;

FIG. 25 is a drawing of a data table for calculating a surface temperature on the basis of a detection output and a correction output;

FIG. 26 is an illustrative drawing for the calculation of a surface temperature by means of a conventional single operation equation;

FIG. 27 is an illustrative drawing for the calculation of the surface temperature of a heating roller by means of an operation equation of the embodiment 1 of this invention;

FIG. 28 is an illustrative drawing for the calculation of the surface temperature of a heating roller by means of operation equations of the embodiment 2 and the embodiment 3 of this invention;

FIG. 29 is an illustrative drawing for the calculation of the surface temperature of a heating roller by means of operation equations of the embodiment 4 of this invention;

FIG. 30 is an illustrative drawing for the calculation of the surface temperature of a heating roller by means of operation equations of the embodiment 5 and the embodiment 6 of this invention;

FIG. 31 is a flow chart for illustrating the embodiment 1 of this invention;

FIG. 32 is a flow chart for illustrating the embodiment 2 of this invention;

FIG. 33 is a flow chart for illustrating the embodiment 3 of this invention;

FIG. 34 is a flow chart for illustrating the embodiment 4 of this invention;

FIG. 35 is a flow chart for illustrating the embodiment 5 of this invention;

FIG. 36 is a flow chart for illustrating the embodiment 6 of this invention;

FIG. 37 is a block diagram showing the functional structure of an image forming apparatus 370 for accomplishing the fifth object of this invention;

FIG. 38 is a drawing showing the structure of the fixing device 700 shown in FIG. 37;

FIG. 39 is a drawing showing an example of the circuit structure of the abnormal temperature detecting device 800 shown in FIG. 37;

FIG. 40 is a flow chart showing abnormality judgement processings A and B to be practiced by the processing circuit 603 shown in FIG. 39;

FIG. 41 is a flow chart showing an abnormality judgement processing C to be practiced by the processing circuit 603 shown in FIG. 39;

FIG. 42 is a drawing showing an example of the circuit structure in the embodiment 4 of this invention;

FIG. 43 is a flow chart showing an abnormality confirmation processing A to be practiced by the processing circuit 603 shown in FIG. 39 and FIG. 42;

FIG. 44 is a flow chart showing an abnormality confirmation processing B to be practiced by the processing circuit 603 shown in FIG. 39 and FIG. 42;

FIG. 45 is a perspective view showing the heating roller 701 and the end portion sensor 613 of the fixing device 700 shown in FIG. 38;

FIG. 46 is a flow chart showing an abnormality confirmation processing C to be practiced by the processing circuit 603 shown in FIG. 39 and FIG. 42; and FIG. 47 is a drawing showing an example of the circuit structure for changing the length of the abnormality detection time in the abnormality detecting device 800 shown in FIG. 39 and FIG. 42.

DETAILED DESCRIPTION OF THE PREFERRED EMBODIMENT

In the following, the embodiment for accomplishing the first object of this invention will be explained. In addition, what is noted in this description is not to limit the technical scope and the meaning of the terms in the structures. Further, the assertive explanations in the embodiment of this invention is to show the best mode and not to limit the meaning of the terms and the technical scope of this invention.

Figure 1:
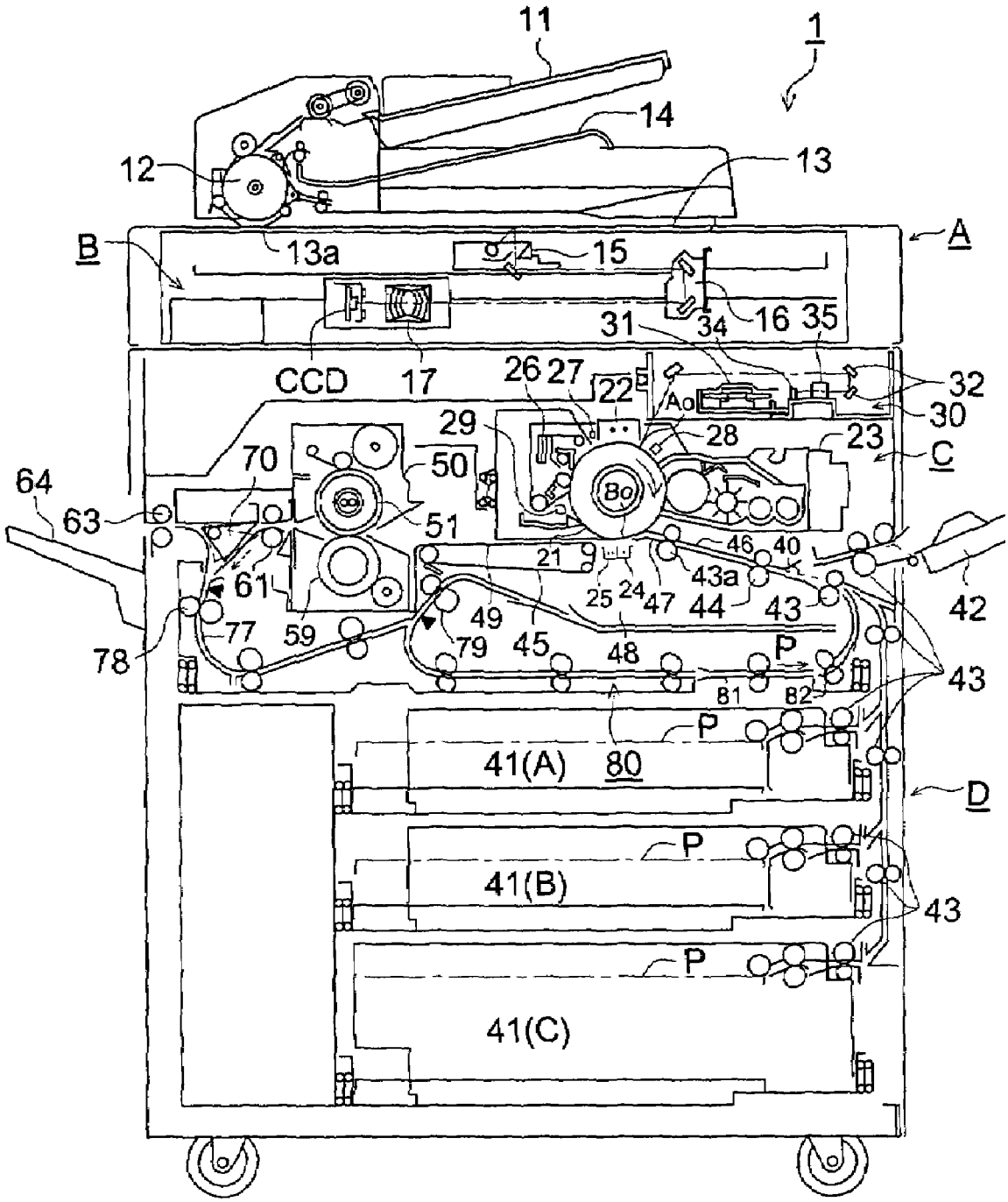
FIG. 1 is an illustrative outline drawing of an image forming apparatus for accomplishing the first object of this invention.

The illustrative outline drawing of an image forming apparatus shown in FIG. 1 is one that notes the outline of an image forming apparatus based on a digital method equipped with a fixing device of this invention; the image forming apparatus consists of an image reading part A, an image processing part B, an image forming part C, and a transfer material conveying part D as a transfer material conveying means.

On the image reading part A, there is provided an automatic document feeding means for automatically feeding a document, and document sheets placed on a document placement table 11 are separated and conveyed one by one by a document conveyance roller 12, to be subjected to the reading of its image at a reading position 13*a*. The document sheet, whose image having been read, is ejected onto a document output tray 14 by the document conveyance roller 12.

On the other hand, an image on a document sheet placed on a glass platen 13 is scanned by the movement of an illumination lamp and a first mirror unit 15 made up of a first mirror at a speed v, and the movement of a second mirror unit made up of a second mirror and a third mirror arranged in a V-shaped position at a speed v/2 in the same direction of the first mirror unit, both units making up an optical system.

The image is formed on the image receiving surface of an image sensor CCD, which is a line sensor, through a projection lens 17. The line-shaped optical images formed on the image sensor CCD are sequentially photoelectrically converted into electrical signals (brightness signals), which are then subjected to an A/D conversion, and further subjected to a density transformation and processings such as a filter processing in the image processing part B; then, the image data are once stored in a storage.

In the image forming part C, as an image forming unit, a drum-shaped photoreceptor 21 as an image carrying member, a charging means 22 opposite to the outer circumference of the photoreceptor 21 for charging it, an electric potential detecting means 28 for detecting the surface potential of the charged photoreceptor, a development means 23, a transfer electrode 24 and a detachment electrode 25 as a transfer-detachment means, a cleaning device 26 for the above-mentioned photoreceptor 21, and a PCL (a pre-charging exposure lamp) 27 as a photo-discharging means are arranged in the order of their operation. Further, at the downstream side of the development means 23, there is provided a reflection density detecting means 29 for measuring the reflection density of a patch image developed on the photoreceptor 21. The photoreceptor 21 is formed of a photoconductive compound coated on a drum-shaped base for which, for example, an organic photoconductor (OPC) is desirably used, and is driven to rotate in the clockwise direction as shown in the drawing.

The rotating photoreceptor 21, after having been subjected to a uniform charging by the charging means 22, is subjected to an image exposure based on the image signal read out from the storage in the image processing part B by means of an exposure optical system 30 as an image exposure means. As regards the exposure optical system 30 as an image exposure means which is a writing means, the main scanning is carried out with a laser beam emitted from a laser diode as a light emission source passing through a rotary polygonal mirror 31, an fθ lens, and a cylindrical lens, with its optical path being deflected by a reflection mirror 32; an image exposure is carried out at a position $A_0$ for the photoreceptor 21, and a latent image is formed by the rotation (sub-scanning) of the photoreceptor 21. In an example of this embodiment, the character part of an image is exposed to light to form a latent image.

The latent image on the photoreceptor 21 is subjected to a reverse development by the development means 23, and a toner image is formed on the surface of the photoreceptor 21. In the transfer material conveying part D, there are provided under the image forming unit, paper feed units 41(A), 41(B), and 41(C) as transfer material accommodation means containing transfer material sheets P of different sizes, and at the side of the image forming unit, there is provided a manual paper feed unit 42 for carrying out manual paper feeding. A transfer material sheet P from any one of the above-mentioned paper feed units selected is fed along a conveyance path 40 by guide rollers 43, and after having been once stopped by a registration roller pair 44 for making the correction for the skew and deflection of the transfer material sheet P to be fed, is fed again, to be guided by the conveyance path 40, a pre-transfer roller 43*a*, a paper feed path 46, and entrance guide plates 47; then, the toner image on the photoreceptor 21 is transferred onto the transfer material sheet P at a transfer position $B_0$ by the transfer electrode 24, and the transfer material sheet P is detached off the surface of the photoreceptor 21 while it is being carried and conveyed by a conveyance belt 49 of a conveyance belt device 45, to be conveyed to the fixing device 50 as a fixing means by the above-mentioned conveyance belt device 45.

The fixing device 50 comprises a heating roller 51 as a rotary heating member having a heating source and a pressing roller 59 as a pressing member, and by making the transfer material sheet P pass through between the heating roller 51 and the pressing roller 59, fixes a toner image by the application of heat and pressure. The transfer material sheet P, having its toner image fixed, is ejected onto an output paper tray 64.

Up to now, the mode in which an image formation is made on one side of a transfer material sheet P has been explained; however, in the case of duplex copying, a paper ejection switching member 70 is switched, a paper guide 77 is opened, and a transfer material sheet P as a copy sheet is conveyed in the direction of the directed broken line.

Further, the transfer material P as a copy sheet is conveyed downward by a conveyance mechanism 78, is switched back by a paper inverter 79, with the trailing edge of the transfer material P as a copy sheet converted to the leading edge, and is conveyed into a duplex copy feed unit 80.

Then, a conveyance guide 81 provided in the duplex copy feed unit 80 is moved to the paper feeding direction, and the transfer material sheet P is again fed by paper feed rollers 82, to be guided to the conveyance path 40.

Again, as described in the foregoing, the transfer material sheet P is conveyed toward the photoreceptor 21, and after a toner image is transferred on the rear side of the transfer material sheet P and is fixed by the fixing device 50, the transfer material sheet P is ejected onto the output tray 64.

Figure 2:
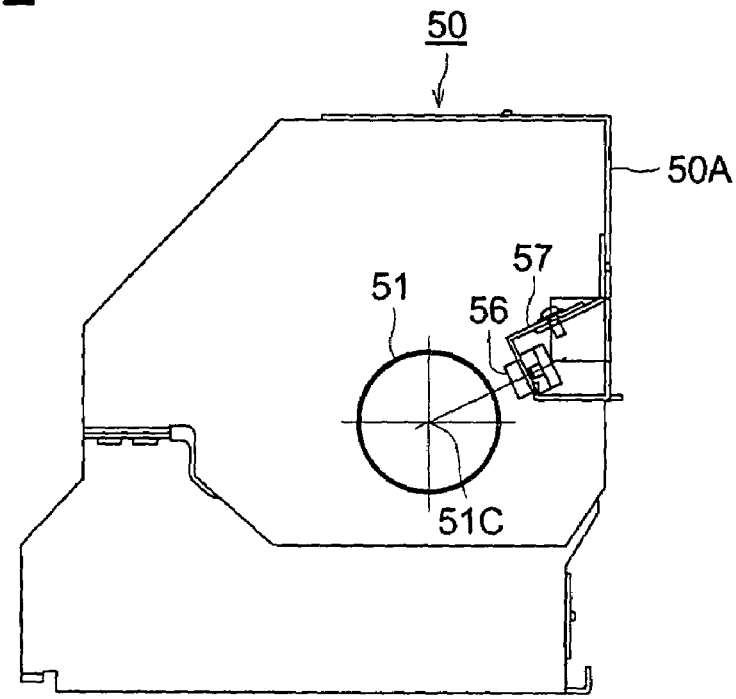
FIG. 2 is the front cross-sectional view of the essential part of a fixing device of this invention.
Figure 3:
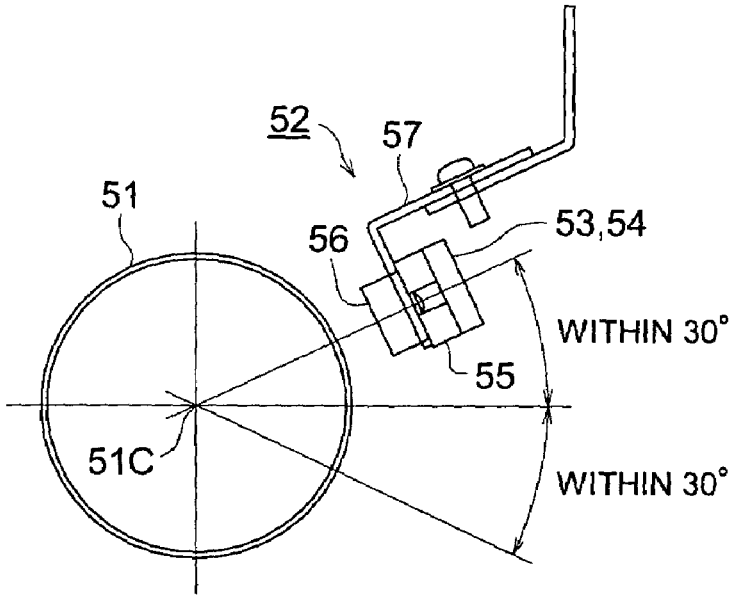
FIG. 3 is the front cross-sectional view showing an example of the arrangement of a temperature detecting device placed in non-contact with the heating roller of a fixing device.

Next, the fixing device 50 of an image forming apparatus of this invention will be explained in detail with reference to the front cross-sectional views of FIG. 2, FIG. 3, FIG. 4(*a*), and FIG. 4(*b*), and the schematic drawings of FIG. 5 and FIG. 6.

The fixing device 50 comprises the heating roller 51 provided with a heating means for heating and fixing a toner image formed on a transfer material sheet P and a temperature detecting device 52 placed in non-contact with said heating roller 51; said temperature detecting device 52 has a surface temperature detecting sensor 53 for detecting the temperature of the surface of the above-mentioned heating roller 51 and a compensation temperature sensor 54 for detecting the ambient temperature, and is a device for accurately obtaining the surface temperature of the heating roller 51 on the basis of the output of the above-mentioned two sensors. However, although the above-mentioned temperature detecting device 52 determines the surface temperature of the heating roller on the basis of the output of said two sensors, it has been found that the surface temperature of the heating roller 51 as determined by the detection becomes different dependently on the position and angle of placement, and the material of the fitting member.

It is the characteristic of a fixing device of an image forming apparatus of this invention that, in order to avoid the above-mentioned problem, the placement position and the shape and material of the case for the accommodation of the two sensors are determined as conditions for accurately detecting and determining the surface temperature of the above-mentioned heating roller 51 stably. This point will be described in the following.

As described above, in the fixing device 50 of the image forming apparatus 1 comprising the heating roller 51 provided with a heating means for heating and fixing a toner image formed on a transfer material sheet P and a temperature detecting device 52 placed in non-contact with said heating roller 51, the temperature detecting device 52 has the surface temperature detecting sensor 53 for detecting the temperature of the surface of the heating roller 51, the compensation temperature sensor 54 for making the detected temperature by the surface temperature detecting sensor 53 agree with the correct surface temperature by the detection of the ambient temperature, and a case 55 having an opening 56. In this case 55, the above-mentioned surface temperature detecting sensor 53 is placed at a position to which the heat radiation from the heating roller 51 is directly incident through the opening 56, and the above-mentioned compensation temperature sensor 54 is placed at a second position enclosed by said case 55. In this embodiment, the second position is determined to be a position to which the heat radiation from the heating roller 51 is not directly incident. Further, as means for calculating the true surface temperature of the above-mentioned heating roller 51 on the basis of the output of both the sensors, for example, a correlation table as shown in Table 1 is prepared, and is stored in the control section. That is, when the output of the compensation temperature sensor 54 is 2.3 V and the output of the surface temperature detecting sensor is 2.25 V, it is immediately judged that the correct surface temperature of the heating roller 51 is 185° C., and in this connection, also when the former is 2.46 V and the latter is 2.3 V, it is judged that the correct surface temperature is 185° C. In order to make it possible to maintain a state such that this condition of correlation is stably established, it is desirable that the above-mentioned opening 56 of said case 55 for said surface temperature detecting device 53 is placed in such a way as not to enter the region between the vertical plane P1 containing the central axis 51C of the heating roller 51 and the tangential plane P2 of the circumferential surface of the heating roller 51 parallel to the vertical plane P1 nearer to the sensors. A desirable arrangement is shown in FIG. 4(*b*). This drawing shows an arrangement desirable for cases where the temperature detection of a roller is carried out, and should be applied to temperature sensors for an upper fixing roller and a lower fixing roller. Further, FIG. 4(*a*) shows an optimum arrangement region of temperature sensors for an upper fixing roller. A case where the roller rotates clockwise and a transfer sheet moves from right to left is taken for instance. The region "a" or "b" is the optimum sensor arrangement region. In the case where sensors are placed in the region "a", because the temperature after the roller is deprived of its heat by a transfer paper sheet is to be measured, it is desirable to place temperature sensors for fixing in the region "b".

TABLE 1

| | | Infrared ray output (V) | | | | | | |
|---|---|---|---|---|---|---|---|---|
| | | 2.5 | . . . | 2.32 | 2.3 | 2.25 | . . . | 1.9 |
| Temperature compensation output | 0 | 0 | . . . | . . . | . . . | . . . | . . . | 200 |
| | . . . | . . . | . . . | . . . | . . . | . . . | . . . | . . . |
| | 2.14 | — | . . . | 170 | 175 | 180 | . . . | — |
| | 2.3 | — | . . . | 175 | 180 | 185 | . . . | — |
| | 2.46 | 0 | . . . | 180 | 185 | 190 | . . . | — |
| | . . . | . . . | . . . | . . . | . . . | . . . | . . . | . . . |
| | 4 | 0 | . . . | — | — | — | . . . | — |

. . . ; Numerical figures omitted
—; Blank

If the temperature detecting device is arranged in a way such that a part of the case 55 of both the above-mentioned sensors enters the above-mentioned region, the opening portion, as shown in the schematic drawing of FIG. 5, is directly subject to the influence of the heat transfer from the air due to the convection rising from the heating roller surface located downward in the above-mentioned region and the influence of the heated air flow produced by the rotation of the roller, and a usual stable output, for example, the output of a value as shown in the correlation table noted above is not obtained, to be changed. In contrast with this, for example, in the case where the diameter of the heating roller is 40 mm, and the distance from the surface of said heating roller to the entrance of the above-mentioned opening 56 is 5 mm, in the angular range from 30 degrees under the horizontal plane containing the roller axis to 30 degrees over the plane, in other words, in the positional range where the opening 56 of the case 55 for the above-mentioned surface temperature detecting sensor 53 does not enter the region between the vertical plane P1 containing the central axis 51C of the heating roller 51 and the tangential plane P2 of the circumferential surface of the heating roller 51 nearer to the sensors parallel to the vertical plane P1, because the opening 56 can avoid the influence of heat convection, the sensors are hard to be subject to the influence of heat transfer from the turbulent air flow due to the convection and the rotation of the heating roller.

With the placement position of the above-mentioned temperature detecting device 52 in the fixing device 50 made to fall within an angular range from 30 degrees under the horizontal plane containing the roller axis to 30 degrees over said plane and the material of the mounting plate made iron, a correlation table between the measured temperature by the surface temperature detecting sensor 53 and the measured temperature by the compensation temperature sensor 54 is prepared. If such a correlation table is stored in the control section, in the fixing device 50 having the temperature detecting device 52 placed in such a way as to satisfy the above-mentioned condition, the temperature of the measurement object, that is, the heating roller surface, even if it varies, can be detected more accurately and stably on the basis of the calculation from the correlation table.

In order to detect the surface temperature of an object of measurement accurately and stably, the surface temperature detecting sensor 53 and the compensation temperature sensor 54 each are placed at positions of the same phase near to each other in the case 55 (at the same angle and the same height from the horizontal plane containing the roller axis). Further, for the case 55 of the surface temperature detecting sensor 53, aluminum, which has a good thermal conductivity, is adopted in order to be able to respond to a sudden ambient temperature variation. In this case, the sensors are placed at positions where no influence due to the convection and conduction in the fixing device is given to the detected temperature of the surface temperature detecting sensor 53, that is, at positions falling within a range from 30 degrees under the horizontal plane containing the roller axis to 30 degrees over that plane.

Further, as shown in the schematic drawing of FIG. 6, it is put into practice that each angle made by each straight line from each of the central position on the sensor surface of both the sensors perpendicular to the central axis 51C of the above-mentioned heating roller 51, which represents the shortest distance to the axis, and the sensor surface of both the sensors is 90 degrees±5 degrees. So long as the angle falls within this placement error, the surface temperature of the heating roller is accurately and stably secured, and is never subject to the influence of the above-mentioned angular error. However, if the angular error exceeds this range, the detection result derived from the above-mentioned correlation table comes to have a large error, and at the same time, there is a possibility of an erroneous detection. For that reason, it sometimes occurs that another correlation table has to be prepared.

Further, it is necessary to use a material having a good thermal conductivity for the case 55 of the above-mentioned temperature detecting device 52 for accommodating both the above-mentioned sensors and the mounting plate 57 as a mounting member to be attached to said case. For the material having a good thermal conductivity, copper, aluminum, and iron are used as shown in Table 2.

In the case where the ambient temperature of the temperature detecting device 52 is changed, the heat conduction to the compensation temperature sensor 54 is delayed because it is mounted in the case. Further, in the case where the thermal conductivity of the mounting plate 57 is poor, the heat of the case 55 of both the sensors is not dissipated through the mounting plate 57 to remain in the case, which makes worse the detection accuracy of the compensation temperature sensor 54. In order to secure the detection accuracy of the compensation temperature sensor 54 against the change of the ambient temperature, for the mounting plate 57 of both the sensors, it is desirable to adopt aluminum, which is the same as the material of the case 55 accommodating both the sensors, or a material having a higher thermal conductivity, although iron is usually used for the mounting plate 57.

FIG. 7 shows an example of practice in which the fixing roller is an aluminum roller with a thickness of 4 mm to 8 mm, and in order to make smaller the influence of convection, the sensors are placed at positions of about 3 mm to 10 mm from the roller surface, although these things are not shown in the drawing.

TABLE 2

| Material | Thermal conductivity (W/m · ° C.) |
|---|---|
| Iron | 83.5 |
| Aluminum | 236 |
| Copper | 403 |

The mounting plate 57 for mounting the temperature detecting device 52 are attached to the case in such a way as to cover the front surface of the case except for the opening 56.

Further, as shown in the front view of FIG. 7 of a temperature detecting device with both sensors accommodated in a case placed opposite to a heating roller with a mounting plate, the above-mentioned case 55 accommodates both the above-mentioned sensors in such a way as to cover the sensors with its front part except the above-mentioned opening 56, and is mounted to the mounting plate 57 fixed to the frame 50A of the fixing device 50.

The detail of the state that the surface temperature detecting sensor 53 and the compensation temperature sensor 54 are accommodated in the case 55 as fitted to it is shown in the top view of FIG. 8 and in the side view of FIG. 9. The numbers in the drawings are the same as those noted before. Besides, although it is not shown in the drawing, the heating roller 51 is arranged at the left side in the drawing as viewed from this side. The surface temperature detecting sensor 53 is placed at a first position opposite to the opening 56 in the case 55, and receives directly the radiation heat from the heating roller 51 through the opening 56. On the other hand, the compensation temperature sensor 54 is placed at a second position in the case 55. The second position is a position such that the radiation heat from the heating roller is not directly incident.

Further, both the sensors, the surface temperature detecting sensor 53 and the compensation temperature sensor 54 are fixed with an adhesive to a flexible board 52A having lead wires provided in the case 55.

By making the placement position of the temperature detecting device, in particular, the surface temperature detecting sensor, the compensation temperature sensor, and the opening portion of the case with respect to the heating roller fall within a definite region, and making the material of the case and the mounting plate be one of high thermal conductivity, it has been actualized to make it possible to provide a fixing device which has an improved accuracy of detection of the surface temperature of the heating roller in a method in which the surface temperature of the heating roller is determined by the use of a correlation table of the detected temperature by the surface temperature detecting sensor and the detected temperature by the compensation temperature sensor.

In the following, the embodiment for accomplishing the second object of this invention will be explained with reference to the drawings.

FIG. 10 shows a fixing device of an image forming apparatus of this invention. FIG. 11(*a*) and FIG. 11(*b*) show the temperature distribution of a fixing roller of this invention. FIG. 12(*a*) and FIG. 12(*b*) are schematic drawings showing the relation between a fixing roller and a temperature detecting means of this invention. FIG. 13(*a*) and FIG. 13(*b*) are graphs showing the temperature control of a fixing roller of this invention. FIG. 14 is a block diagram showing the circuit structure of an image forming apparatus of this invention.

First, the image forming process of an image forming apparatus of an electrophotographic method of this invention will be briefly explained. Although not shown in the drawings, a photoreceptor drum rotates when an image formation process starts, uniform charging is applied to the rotating photoreceptor drum, and the charged photoreceptor drum is subjected to an exposure using an image signal based on image information, to have a latent image formed on it. The latent image formed on the photoreceptor drum is developed by the use of a toner and a toner image is formed. When a toner image is formed on the photoreceptor drum, a recording material is conveyed to the photoreceptor drum at a suitable timing from a recording material accommodation unit having recording material sheets such as paper sheets stacked in it, and after the toner image formed on the photoreceptor drum is transferred onto the recording material sheet conveyed, it is detached off the photoreceptor drum to be conveyed to a fixing device. The recording material sheet, having been conveyed to the fixing device, has the toner image on it fused and fixed by the fixing roller heated by a heater as the heat source of the fixing device, to have an image formed on it, and is ejected onto an output tray provided outside the machine. On the other hand, the photoreceptor drum, having the recording material sheet detached off its surface, continues to rotate thereafter too, has the toner particles remaining on its surface removed, and in the case where no succeeding image formation is to be done, stops its rotation; thus, an image formation process is finished.

With reference to FIG. 10, a fixing device of an image forming apparatus will be explained.

The fixing device 10 is one for use in an image forming apparatus such as the above-mentioned copying machine and a laser beam printer employing an electrophotographic method.

The fixing device 10 is equipped with a pair of fixing rollers 2*a* and 2*b* inside a housing 101, which are rotated by a drive mechanism not shown in the drawing.

The fixing rollers 2*a* and 2*b* have their surface layer generally made of a metal, and contain heaters 3*a*, 3*b*, and 3*c* made up of a halogen heater inside as a heat source; by the heat of the fixing rollers 2*a* and 2*b* controlled to have a uniform temperature distribution at a specified temperature by these heaters 3*a*, 3*b*, and 3*c*, toner particles on a recording material sheet being conveyed in the direction of the arrow mark A in the fixing device 10 are fused and fixed on a recording sheet.

A pair of rollers for ejecting a recording sheet to the direction of the arrow mark A from the fixing device 10 are denoted by 5*a* and 5*b*, and 4*a* and 4*b* denote temperature detecting means for detecting the temperature of the fixing rollers 2*a* and 2*b* (hereinafter referred to also as the surface temperature) respectively.

The temperature detecting means 4*a* or 4*b* consists of a non-contact type temperature sensor for detecting the temperature of the fixing roller 2*a* or 2*b*, and a non-contact type temperature compensation sensor provided inside the temperature detecting means 4*a* or 4*b* for detecting the temperature of the temperature detecting means 4*a* or 4*b* itself, and outputs, for example, voltages, electric currents, or signalized electrical bits of temperature information corresponding to the temperatures detected by the temperature sensor and the temperature compensation sensor to a temperature control means to be described later, so as to make it possible to detect the correct temperature of the fixing roller 2*a* or 2*b* through correcting the temperature detected by the temperature sensor by the temperature detected by the temperature compensation sensor, in order that the temperature detected by the temperature sensor may not be influenced by the temperature rise of the temperature detecting means 4*a* and 4*b* themselves etc.

In addition, the temperature detected by the temperature sensor or the temperature compensation sensor of the temperature detecting means according to the embodiment of this invention is actually obtained as a voltage value, but for the simplicity of explanation, hereinafter it is referred to simply as temperature.

With reference to FIG. 11(*a*) and FIG. 11(*b*), the temperature distribution of a fixing roller will be explained.

FIG. 11(*a*) is the front view of the fixing roller 2*a* shown in FIG. 10, and FIG. 11(*b*) is the side view of the fixing roller 2*a*. The same signs as those in FIG. 10 are supposed to represent the same members.

In FIG. 11(*a*), inside the fixing roller 2*a*, there are provided the heaters 3*a* and 3*b*, which are controlled at a specified temperature.

The heating portions of the heater 3*b* are denoted by H1 and H2, which are provided at both the end portions in the lengthwise direction of the fixing roller 2*a* respectively, and the heating portion of the heater 3*a* is denoted by H3, which is provided at the central part in the lengthwise direction of the fixing roller 2*a*; it is considered not to produce a non-uniform part in terms of the temperature distribution in the lengthwise direction of the fixing roller, and a control is practiced so as to make the whole of the fixing roller 2*a* have a uniform temperature distribution at a specified temperature.

The signs T1, T2, and T3 correspond to the heating portions H1, H2, and H3 of the heaters 3*a* and 3*b* respectively, and indicate the regions of higher temperatures on the surface of the fixing roller 2*a*. Although it is considered to make the temperature distribution in the lengthwise direction of the fixing roller 2*a* or 2*b*, it is understood that the temperature becomes higher in the neighborhood of the heating portions, and a temperature non-uniformity is produced.

The sign 4*a* denotes a temperature detecting means, and S indicates the temperature detection range by the temperature sensor TS of the temperature detecting means 4*a*.

In FIG. 11(*b*), F1 and F2 represent the temperature distribution of the fixing roller 2*a* as viewed from the side direction produced by the heaters 3*a* and 3*b*, and although it is devised to obtain an approximately uniform temperature distribution over the whole circumference, the fixing roller 2*a* heated by the heaters 3*a* and 3*b* shown in FIG. 11(*a*) has a temperature non-uniformity produced in the same way as the lengthwise direction.

That is, it is desired that a fixing roller is kept at a correct set temperature stably, while it eliminates a temperature non-uniformity as described above to have a uniform temperature distribution.

Further, the temperature detection range S of the temperature sensor TS is previously set; if the sensor become more distant from the fixing roller 2*a*, the temperature detection range spreads broader, and it becomes possible to contain the total fixing roller 2*a* in the temperature detection range S, but it becomes difficult to detect the temperature of the fixing roller 2*a*, because the sensor is subject to the influence of the convection heat etc. to be described later.

Further, if the temperature detecting means 4*a* is made to come too near to the fixing roller 2*a*, in this case, the temperature detecting means 4*a* itself is abnormally heated too much, and the correction by the compensation temperature sensor (not shown in the drawing) is not made properly, which makes it difficult to detect the temperature of the fixing roller 2*a*.

Accordingly, it is desirable to determine the distance between the fixing roller 2*a* and the temperature detecting means 4*a*, with the structure of the image forming apparatus etc. taken into consideration, through obtaining, previously by experiments or the like, a distance such that the temperature sensor TS is hard to be subject to the influence of the convection heat etc. and an appropriate temperature can be obtained from the temperature sensor TS, or a distance such that the correction by the compensation temperature sensor is possible.

In addition, in this embodiment of the invention, the heaters 3*a* and 3*b* are provided in the fixing roller 2*a*, and the heater 3*c* is provided in the fixing roller 2*b*; however, so long as the fixing rollers 2*a* and 2*b* can be kept at an appropriate temperature with a uniform temperature distribution, the kind, arrangement, and the number of the heaters, the structure of the heating portion of the heaters, etc. may be suitably determined in accordance with the performance of the heaters and the characteristics of the fixing rollers, without being limited to the above-mentioned example.

With reference to FIG. 12(*a*) and FIG. 12(*b*), the relation between a fixing roller and a temperature detecting means will be further explained.

FIG. 12(*a*) is a drawing of a fixing roller 2 as viewed from the side direction; a heater 3 is provided inside the fixing roller 2, which is controlled to be kept at a specified temperature and have a uniform temperature distribution, and is in a state that its rotation is stopped. Further, the distance between the fixing roller 2 and a temperature detecting means 4 is set at a distance obtained by an experiment or the like under the above-mentioned condition.

The sign 4 denotes the temperature detecting means, and in FIG. 12(*a*) and FIG. 12(*b*), the cross-sectional view of the temperature detecting means is shown; for example, a cylindrical-shaped hood 4F is provided, which makes the temperature sensor TS easy to detect the temperature of the fixing roller 2, and not receive the unnecessary influence of heat convection. The sign HS denotes a compensation sensor provided inside the temperature detecting means 4, which is one for detecting [the temperature of the temperature sensor TS itself or] the temperature of the temperature detecting device 4 itself, and as described before, for correcting the temperature detected by the temperature sensor TS.

When the fixing roller 2 is heated by the heater 3, infrared rays (directed broken lines) are radiated from the circumference of the fixing roller 2, and the air surrounding the fixing roller 2 is heated to produce heat convection (directed solid lines) rising upward.

In the state that the heat convection is rising, as shown in FIG. 12(*b*), when the fixing roller 2 rotates in the direction of the arrow mark M, a turbulence of the heat convection is produced under the influence of the rotation of the fixing roller 2.

The temperature detecting means 4 placed at a position where it is not subject to the influence of the heat convection in the state that the fixing roller 2 is stopping its rotation, accompanied by the rotation of the fixing roller, comes to detect an averaged temperature as the result of the averaging of the temperature non-uniformity of the above-mentioned fixing roller 2, which gives some influence to the temperature detection; however, the temperature detecting means is strongly subject to the influence due to the above-mentioned turbulence of the heat convection, and the temperature sensor TS comes to be unable to detect a proper temperature of the fixing roller 2.

That is, a difference is produced in the temperature detected by the temperature sensor TS in accordance with the degree of the influence of the turbulence of the heated air flow rising upward in the heat convection produced by the rotation of the fixing roller between the rotating state and stopping state of the fixing roller 2. Further, this turbulence of the rising of the heated air flow in the heat convection is varied depending on the temperature and the rotational speed of the fixing roller 2, and the structure of the fixing device; therefore, it is not to be calculated by means of a simple operation equation, and it is desirable to obtain the above-mentioned degree of the influence previously by an experiment or the like by the use of a fixing device having the same structure as one actually used.

Accordingly, when the temperature detecting means 4 is placed for the fixing roller 2, it is necessary that, by the use of a fixing device of the same model as the fixing device for which the temperature detecting means 4 is to be placed, the above-mentioned distance between the fixing roller and the temperature detecting means 4 is obtained during the rotation of the fixing roller 2, and with the structure of the image forming apparatus etc. taken into consideration, the placement angle of the temperature detecting means 4 with respect to the fixing roller 2 is also obtained beforehand by an experiment or the like; further, it is also necessary that, in the state that the temperature detecting means is placed on the basis of these results, the difference in the temperature detected by the temperature sensor TS between the state of rotation and the state of stopping of the fixing roller 2 is obtained.

In this embodiment of the invention, as the result of an experiment carried out concerning the influence of the above-mentioned turbulence of the heated air flow rising upward in the heat convection, it is found that, in the fixing device used in the experiment, in the case where the temperature detecting means is placed at a position of a direction with an angle of not smaller than 20 degrees in the counterclockwise direction with respect to the horizontal direction of the fixing roller 2 (the horizontal direction means the direction parallel to the lower edge of the paper sheet in FIG. 12, and the angle 0 degree is defined as the right side in the horizontal direction), the temperature sensor is strongly subject to the influence of the turbulence of the heat convection; therefore, in this embodiment of the invention, it is practiced to place the temperature sensor 4 at a position in the direction of an angle falling within a range smaller than 20 degrees with respect to the horizontal direction; however, it is a matter of course that the angle is not limited to this. That is, when the temperature detecting means is placed close to the fixing roller, it is easy to be subject to the influence of the convection, and in the case where it is placed not close to the fixing roller, it is hard to be subject to the influence of the convection; therefore, it is desirable to make this angle smaller for a close placement and it is possible to make this angle larger for a case of no close placement.

With reference to FIG. 13(*a*) and FIG. 13(*b*), a temperature control of a fixing roller will be explained.

FIG. 13(*a*) is a graph showing a state of a temperature control of a fixing roller based on a conventional temperature control method; this is a graph in which the ordinate represents the temperature (° C.), and the abscissa represents the state of the temperature detected by the temperature detecting means and the state of the actually measured surface temperature of the fixing roller during the still-standing and the rotating of the fixing roller.

The sign DT1 denotes the detected temperature of the fixing roller by the above-mentioned temperature detecting means, and represents a temperature converted from the temperature information representing the corrected temperature of the fixing roller obtained by correcting the temperature information as the temperature of the fixing roller detected by the temperature sensor of the temperature detecting means on the basis of the temperature information as the temperature of the temperature detecting means itself detected by the compensation temperature sensor, and RT1 denotes the temperature of the fixing roller, that is a temperature obtained by an actual measurement of the surface temperature of the fixing roller.

In addition, in the embodiment of this invention, as temperature information detected by the temperature sensor and the compensation temperature sensor of the temperature detecting means, a voltage value corresponding to a temperature is obtained; however, hereinafter it is referred to also as temperature simply.

Up to this time, in controlling the temperature of a fixing roller, it has been put into practice that a temperature control means keeps the fixing roller at a constant temperature of a specified value by it that the control means compares a detection temperature detected by a temperature detecting means with a reference temperature set beforehand, if the detection temperature is lower than the reference temperature, the heater is energized to heat the fixing roller, and if the detection temperature becomes higher than the reference temperature, the energizing of the heater is stopped.

For that purpose, heretofore, the detected temperature is corrected by a correction value obtained so as to approximate the detection temperature of the temperature detecting means to the temperature of the fixing roller as described before; therefore, the reference temperature set in the temperature control means is the same as the set temperature of the fixing roller, and it is set at the same temperature value during the still-standing and the rotating of the fixing roller.

That is, in FIG. 13(*a*), for example, in the case where the set temperature of the fixing roller is determined to be 200° C., the reference temperature is also 200° C., and on the basis of the detection temperature DT1 detected by a temperature detecting means (not shown in the drawing), a temperature control means (not shown in the drawing) practices a control so as to make the temperature of the fixing roller constant at 200° C. by controlling a heater (not shown in the drawing) provided in the fixing roller.

To state it concretely, FIG. 13(*a*) is a drawing of a graph representing the detection temperature DT1 obtained by a conventional temperature control method and the actually measured surface temperature RT1 of a fixing roller.

It is understood that, in a conventional temperature control method, as shown in FIG. 13(*a*), during the still-standing of the fixing roller, DT1 and RT1 superposes each other, and if the heater of the fixing roller is controlled on the basis of a reference temperature set in the temperature control means by the use of the detection temperature DT1 detected by the temperature detecting means, the surface temperature of the fixing roller is kept approximately at a temperature of 200° C.

However, during the rotation of the fixing roller, the curve RT1 is separated downward from the curve DT1. That is, when the fixing roller rotates, as described before, the temperature detecting means is subject to the influence of the turbulence of the heated air flow rising upward in the heat convection, and detects a temperature higher than the actual roller temperature; it is understood that if the heater of the fixing roller is controlled on the basis of the detection temperature DT1 of the temperature detecting means, which is shown as 200° C., with respect to the reference temperature set in the temperature control means, a phenomenon that the actual surface temperature RT1 falls, for example, to 195° C. occurs.

Accordingly, in an conventional temperature control method of a fixing roller, for example, when 200° C. is set as the set temperature of the fixing roller, the same temperature as the set temperature is set for the reference temperature in order to make the fixing roller have the set temperature; therefore, although a control is made so as to fix certainly a toner image transferred onto a recording material sheet by the above-mentioned image forming process to the recording sheet at 200° C., it has been produced a problem that a poor fixing occurs during an actual fixing operation in an image forming process, because the surface temperature of the fixing roller falls to 195° C. during the rotation of the fixing roller.

FIG. 13(*b*) is a graph showing a temperature control of a fixing roller of this invention, and in the same way as FIG. 13(*a*), the ordinate represents the temperature (° C.), and the abscissa represents the state of the temperature of the fixing roller detected by a temperature detecting means and the state of the actually measured surface temperature of the fixing roller during the still-standing and the rotating of the fixing roller.

The signs DT2, DT3, and DT4 denotes the detection temperature of the fixing roller and RTA denotes the actually measured surface temperature of the fixing roller. In addition, the way of entry in the graph and the condition of measurement of the detection temperatures by the temperature detecting means DT2, DT3, and DT4 and the actually measured surface temperature RTA of the fixing roller are made to be the same as those in FIG. 13(*a*); therefore, the explanation will be omitted.

However, FIG. 13(*b*) is a graph formed of the variation of the measured surface temperature of the fixing roller and the detection temperature of the temperature detecting means in the case where the surface temperature of the fixing roller is made to be kept at 200° C. during both the still-standing and the rotating of the fixing roller.

In addition, the experiment was carried out in such a way that, in actually measuring the surface temperature of the fixing roller during the rotation of the fixing roller, the number of rotations was set at the normal number of rotations and at another number of rotations smaller than that.

As the result of this experiment, it is found that, during the still-standing of the fixing roller, the curve DT2 and the curve RTA superpose each other approximately at 200° C., and in the same way as the conventional method, a temperature control of a fixing roller may be carried out on the basis of the detection temperature DT2 with respect to a reference temperature of a temperature control means, with the set temperature of the fixing roller determined to be the same as the reference temperature of the temperature control means.

In FIG. 13(*b*), it is understood that, during the rotation of the fixing roller, although the surface temperature of the fixing roller RTA is made to be approximately 200° C., it appears that the detection temperature DT3 is approximately 205° C. and the detection temperature DT4 is approximately 203° C., there is a difference between the detection temperatures DT3 and DT4, and also there is a temperature difference between either of these and the actually measured temperature RTA.

It is considered that the difference between DT3 and DT4 was due to the difference of the number of rotations of the fixing roller, and was produced by it that the rotation of the fixing roller when the detection temperature DT3 was detected was faster than the rotation of the fixing roller when the detection temperature DT4 was detected.

That is, the detection temperature becomes different between during the still-standing and during the rotating of the fixing roller owing to the degree of influence of the turbulence of the heated air flow rising upward in the heat convection to the temperature detecting means, and during the rotation, from the result that a difference of 5° C. ($\alpha$) is produced between the detection temperature DT3 and the actually measured surface temperature RTA of the fixing roller in the case of fast rotation of the fixing roller and a difference of 3° C. ($\beta$) is produced between the detection temperature DT4 and the actually measured surface temperature RTA of the fixing roller, it is understood that for the purpose of making the temperature of the fixing roller constant, a correction using a plural correction values such as $\alpha$ and $\beta$ for example is necessary to the detection temperature as described in the above, because the degree of the influence of the turbulence of the heated air flow rising upward in the heat convection to the temperature detecting means changes with the number of rotations of the fixing roller.

Accordingly, in the embodiment of this invention, in order to carry out a temperature control during the rotation of a fixing roller more accurately, for example, in the case where surface temperature of the rotating fixing roller is kept at 200° C., it is practiced to make a reference temperature set in the temperature control means higher during the rotation than during the still-standing of the fixing roller, with the degree of the influence of the turbulence of the heated air flow rising upward in the heat convection taken into consideration; for example, the reference temperature is set at 200° C.+5° C. ($\alpha$) in the case of the usual number of rotations of the fixing roller, and it is set at 200° C.+3° C. ($\beta$) in the case of the rotation slower than that.

That is, if a temperature control of a fixing roller is carried out with a temperature obtained by the addition of the above-mentioned correction value ($\alpha$ or $\beta$) to the surface temperature of the fixing roller set in the temperature control means as a reference temperature corresponding to the number of rotations of the fixing roller, during the rotation of the fixing roller, the temperature of the fixing roller comes to be kept constant at the set temperature.

In the embodiment of this invention, explanation has been done on the assumption that the correction value α is +5° C., and the correction value β is +3° C., that is, both values are positive; however, in some environments where the temperature sensor TS is placed, it may occur a case where the correction value α or β becomes negative owing to the temperature sensor being cooled by something. In such a case also, it is appropriate to set a temperature obtained by the addition of a negative correction value (α or β) to the surface temperature of the fixing roller as a reference temperature to carry out the temperature control of the fixing roller.

Further, the number of rotations of a fixing roller, depending on the function, performance, or specification of the image forming apparatus, becomes different, and particularly in recent years, it has been put into practice to change the number of rotations of the fixing roller with the kind of the recording material, to enable a reliable fixing irrespectively of the kind of the recording material; it has appeared an apparatus capable of controlling the speed of the recording material sheet passing the fixing roller (also called the fixing process speed) by the changeover of the number of rotation of the fixing roller, for example, supposing that the fixing process speed at the time a normal paper sheet is subjected to fixing is put as 1, to make it ½ for a thick paper sheet, ⅓ for an OHP sheet; therefore, it is necessary to obtain previously a correction value equivalent to the above-mentioned α or β in accordance with the temperature, the number of rotations, etc. of the fixing roller of the image forming apparatus in which the fixing device is expected to be adopted.

In the embodiment of this invention, for the simplicity of the explanation, the explanation has been given only for the case where the number of rotations of the fixing roller is changed in two steps of a usual number of rotations and a number of rotations smaller than that; however, because the way of the changeover of the number of rotations of the fixing roller is not limited to two steps, and a similar phenomenon occurs in the case of three steps or more, concerning a fixing roller of an image forming apparatus having its number of rotations supposed to be changed in three steps or more, it is desirable to obtain further, on the basis of the relative magnitude of the number of rotations of the fixing roller, the correction values equivalent to the above-mentioned α and β successively and set reference temperatures using these values.

With reference to FIG. 14, the circuit structure of an image forming apparatus which practices a temperature control of a fixing device of the embodiment of this invention will be explained briefly.

The sign 350 denotes the circuit of the whole of the image forming apparatus, and 110 denotes a CPU for practicing the control of the whole of the image forming apparatus, having various kinds of program for controlling the image forming apparatus stored beforehand.

To the CPU 110, an information control circuit 120, an image processing circuit 140, a drive control circuit 150, and a power source circuit 400 are connected.

The information control circuit 120 has a structure such that image information from an external information apparatus 500 such as characters and images and various kinds of information required for image formation etc. are inputted through an interface (I/F) 130, the inputted various kinds of information are stored in a data storage 160, and the various kinds of information stored in the data storage 160 are outputted to the image processing circuit 140, the drive control circuit 150, a display means 300, or the like as occasion demands.

For the external information apparatus, an information apparatus capable of being connected to an image forming apparatus of the embodiment of this invention such as a computer, an Internet server, a digital camera, or a measuring apparatus capable of outputting measured information can be supposed.

Further, the information control circuit 120 operates to carry out the inputting and outputting of various kinds of information necessary for the operation of pertinent means including the image processing circuit 140 and the drive control circuit 150 in addition to the various kinds of information inputted from the external information apparatus 500 and to transfer the inputted information by an operation input means 200 to the pertinent circuit or means suitably and smoothly so as not to hinder the operation of the image forming apparatus.

The operation input means are made up, for example, of a keyboard, a touch panel, or the like, and has a structure such that information such as the number of output sheets and the kind (for example, plain paper, recycled paper, thick paper, OHP sheet, etc.) of the recording material having an image formed on it, and information such as the magnification in the enlargement or reduction, density setting of the output image, etc. can be inputted.

The display means 300 is made up, for example, of a liquid crystal display means or the like, and has a structure such that a list of the operation procedures at the time of inputting information by the operation input means 200 and various kinds of information, a confirmation screen of setting information, or a screen of information stored in the data storage 160, a screen showing the state of operation of the image forming apparatus, a screen of warning, or the like can be displayed.

The image processing circuit 140 is a circuit for converting image information or the like stored in the data storage 160 into data or signals suitable for the image forming apparatus by the instruction of the CPU 110, and making it possible to carry out image formation by an image forming means 170 in cooperation with the drive control means 150 etc.

The drive control circuit 150 is a circuit for bringing into operation the image forming means 170, a paper feed/ejection means 180, and a fixing device 190 (including means in the frame shown by the dotted line) by the instruction of the CPU 110, and carrying out an image formation operation.

The image formation means 170 is brought into operation by the drive control circuit 150, and carries out image formation by a signal based on image information outputted from the image processing circuit 140; although not shown in the drawing, it is means for carrying out, for example, an operation comprising the steps of charging a photoreceptor drum, making an exposure for the photoreceptor drum, developing the latent image formed on the photoreceptor drum, transferring the toner image being made visible on the photoreceptor drum to a recording sheet, detaching the recording sheet off the photoreceptor drum, and after that, cleaning the photoreceptor drum.

Further, in the case where the image forming apparatus is a copying machine, it is premised that the image forming means 170 includes a reading means for reading a document.

The paper feed/ejection means 180 is means for carrying out an operation, for the purpose of making it possible to transfer a toner image having been made visible on the photoreceptor drum, comprising the processes of conveying and supplying a recording sheet, for example, from a recording sheet accommodation section (not shown in the drawing) at a suitable timing to the photoreceptor drum, and conveying and ejecting the recording sheet having finished the transfer and detachment operation onto an output tray (not shown in the drawing) through the fixing device 190.

The fixing device 190 is equipped with a roller drive means 192 for driving a fixing roller, a heater means 193 provided in the fixing roller, a temperature detecting means 194 equipped with a temperature sensor (not shown in the drawing) for detecting the temperature of the fixing roller and a compensation temperature sensor (not shown in the drawing), and a temperature control means 191 for controlling the heater means 193 for heating the fixing roller to a specified temperature and keeping it at the temperature on the basis of information such as a detection temperature outputted by the temperature detecting means 194, and is a device for fusing and fixing a toner image on a recording sheet by the heat of the fixing roller.

The power source circuit 400 has a structure such that when a power switch (not shown in the drawing) is turned on, a suitable energizing is carried out from the power source over the whole of the image forming apparatus, and when the power switch is turned off, the energizing is intercepted. Further, it has a structure such that it can practice an operation, for example by the instruction of the CPU 110, when an image formation operation is finished, for intercepting all the energizing except for a part of the energizing necessary for bringing the image forming apparatus into an energy saving state in the ready state, or for saving the storage content in the storage etc. temporarily.

The operation of the temperature control means 191 of the fixing device of this invention will be explained.

First, the temperature control means 191 makes the temperature outputted by the temperature sensor of the temperature detecting means 194 and the temperature of the temperature detecting means 194 itself outputted by the compensation temperature sensor be inputted, and corrects the temperature value of the fixing roller detected by the temperature sensor by the use of the temperature value outputted by the compensation sensor, to obtain the detection temperature of the fixing roller by the temperature detecting means 194.

For this detection temperature of the fixing roller, for example, on the basis of the information concerning the number of rotations etc. of the fixing roller in accordance with the kinds etc. of the recording sheet outputted from the information control circuit 120, and the information of the state of operation etc. of the fixing roller outputted from the drive control circuit 150, in the case where the fixing roller is rotating, a temperature obtained by the addition of a correction value depending on the number of rotations set beforehand on the basis of these conditions to the set temperature of the fixing roller is set as a reference temperature.

To state it concretely, as described before, for example, in the case where the temperature of the fixing roller is to be made 200° C., the reference temperature is set at 200° C.+$\alpha$ when the number of rotations of the fixing roller is large, and the reference temperature is set at 200° C.+$\beta$ when the number of rotations of the fixing roller is smaller than that.

Further, as regards the temperature control of the fixing roller, it is put into practice that this reference temperature is compared with the detection temperature detected by the temperature detecting device 194, if the detection temperature becomes higher than the reference temperature, the energizing of the heater is intercepted, and if the former is lower than the latter, the heater is energized; thus, the temperature of the fixing roller is always kept constant at the specified set temperature.

In addition, in the embodiment of this invention, during the still-standing of the fixing roller, in order to make it possible to carry out a fixing operation quickly, a temperature control is practiced with the set temperature of the fixing roller set at the reference temperature; however, for example, in the case where the image forming apparatus does not operate for a period not shorter than a specified period of time, it is also appropriate to lower the reference temperature automatically for the fixing device to be brought into a energy saving state.

Further, when the temperature control means operates to obtain the detection temperature, or to correct the detection temperature, in the embodiment of this invention, it is practiced to obtain the temperature of the fixing roller by the use of a detection temperature table which is prepared beforehand from the temperature values outputted by the temperature sensor and the temperature values outputted by the compensation temperature sensor to form a table, or by the use of a reference temperature setting table which is prepared from the correction values for the still-standing and rotating of the fixing roller and for each of the pertinent number of rotations to form a table; however, the way of obtaining the temperature of the fixing roller is not limited to this, and it is also appropriate to obtain the detection temperature and the reference temperature by calculating the temperature value and the correction value.

As described in the foregoing, in the embodiment of this invention, in carrying out a temperature control of a fixing roller, during the rotation of the fixing roller, a temperature obtained by the addition of a correction value determined beforehand to the set temperature of the fixing roller is made to be the reference temperature; therefore, even during the rotation of the fixing roller, the temperature of the fixing roller can be always kept constant at the set temperature, and it has become possible to make an image formation of high image quality without producing a poor fixing.

Further, for example, even if the number of rotations of the fixing roller is changed in order to carry out a reliable fixing in accordance with the kind etc. of the recording material, the reference temperature can be changed by a correction value determined beforehand in accordance with the number of rotations; therefore, irrespectively of the number of rotations of the fixing roller, even during the rotation of the fixing roller, the temperature of the fixing roller can be always kept constant at the set temperature, and it has become possible to make an image formation of high image quality without producing a poor fixing.

It has become possible to provide an image forming apparatus capable of practicing an image formation of high image quality in which the temperature of the fixing roller can be always kept constant at a set temperature during the rotation of the fixing roller without producing a poor fixing.

Further, It has become possible to provide an image forming apparatus capable of practicing an image formation of high image quality in which even if the number of rotations of the fixing roller is changed, irrespectively of the number of rotations of the fixing roller, the temperature of the fixing roller can be always kept constant at a set temperature during the rotation of the fixing roller without producing a poor fixing.

In the following, with reference to the drawings, the embodiment for accomplishing the third object of this invention will be explained.

First of all, the outline of an image forming apparatus will be explained.

FIG. 15 is an illustrative drawing of an image forming apparatus showing the embodiment of this invention.

The sign 360 denotes an image forming apparatus, in which document sheets are stacked on a document feed table 221 of an automatic document feeding means 202 with the image surface facing upward, are conveyed out one by one by the action of conveying-out rollers 222, each sheet, after having been once stopped by a pair of registration rollers 223 with its leading edge regulated, is conveyed to a conveyance drum 224, and in the process of rotation together with the drum surface in the counterclockwise direction, the reading of its image surface is carried out by an image reading means 203; after that, it is detached off the drum surface at the position of approximately a half rotation to be ejected onto an output tray 225.

In the above-mentioned image reading means 203, a first mirror unit 231 equipped with a light source 311 and a mirror 312 sequentially illuminates for projection a document passing through at a position directly under the above-mentioned conveyance drum 224, and the image is reflected by a second mirror unit 232 equipped with a mirror 321 and a mirror 322, both being arranged in the direction perpendicular to the document moving direction, to be focused on a line-shaped image sensor 234 through an image forming lens 233.

Further, in the case where image information is to be read from a document placed on a glass platen 235, an image on the document surface is reflected by a movable first mirror unit equipped with a light source 351 and a first mirror 352 and a second mirror unit equipped with a mirror 353 and a mirror 354, and is focused on the line-shaped image sensor 234 through the image forming lens 233 in the same way. Up to now, the image reading means 203 has been explained.

Image information, having been read by the image reading means 203, is subjected to image processing in an image processing means 262, where it is converted into image data to become a signal, and is once stored in a storage means 261.

By the start of an image formation, the operation of the image forming means is started; the above-mentioned image data are read out from the storage means 261, are inputted to an image writing means 243, where a laser beam emitted from a laser emitting device (not shown in the drawing) in accordance with the image data makes an exposure for scanning the surface of the photoreceptor drum 241 having an electric potential given by a charging device 242, in the main scanning direction, the axial direction of the photoreceptor drum 241, deflected by a rotary movement of a polygonal mirror (no sign), and in the sub-scanning direction by the rotation of the photoreceptor drum 241, and an electrostatic latent image of the image on the document is formed on the photosensitive layer.

The above-mentioned electrostatic latent image is reversely developed by a development means 244 to become a toner image, and in parallel with this, any one of a manual paper feed means 226 as a recording sheet supplying means, the conveying-out rollers 252, 253, and 254 of the respective cassettes of a paper feed means 205 accommodating recording sheets is brought in operation, to convey out a recording sheet, which is fed to conveyance rollers 255 and 256, and to a pair of timing rollers 251; thus, a recording sheet is fed to the photoreceptor drum 241 in synchronism with the toner image on the photoreceptor drum 241.

The toner image on the photoreceptor drum 241 is translated to the surface of a recording sheet by the application of an electric voltage of a polarity reverse to the toner by means of a transfer device 245 to become transferred on the recording sheet.

Further, a recording sheet, having a toner image transferred on it, is subjected to a charge elimination by a charge eliminating device 246, is detached off the photoreceptor drum 241, is conveyed to a fixing means 247 whose temperature is controlled by a control means 206, and after the toner image on the recording sheet is fused and fixed by the pressing and heating applied by a heating roller 474 and a pressing roller 475, the recording sheet is ejected onto a tray 257.

Further, as regards the photoreceptor drum 241 having a recording sheet detached from it, after its residual electric potential is removed, it is cleaned through the removal of the residual toner particles by a cleaning means 248, and enters a succeeding image formation process.

In this embodiment of the invention, the fixing means 247 consists of a heating roller 474 formed of a base body 471 made of aluminum containing a halogen lamp heater 471*a* inside coated with a heat-resistant releasing layer made of fluorine-contained resin, and a pressing roller 475 formed of a base body made of aluminum arranged parallel to the axial direction of the heating roller in contact with the heating roller coated with a heat-resistant elastic layer made of silicone rubber, and the heating roller 474 is heated by a heat generating body 471*a*. Further, a roller heat detecting sensor 472 for detecting the heat (infrared rays) radiated from the heating roller 474 and an ambient temperature detecting sensor 473 for detecting the ambient temperature of the roller heat detecting sensor are placed at a position distant from the heating roller by 0.2 mm to 8 mm, or desirably, 4.5 mm to 5.5 mm (indicated by d in FIG. 16).

The sign 264 denotes a heating control means to be described later, and 265 denotes a surface temperature calculating means to be described later.

FIG. 16 is an illustrative drawing showing the embodiment 1 of this invention.

FIG. 22(*a*) and FIG. 22(*b*) are conceptual drawings of a data table.

First, with reference to FIG. 16, FIG. 22(*a*), and FIG. 22(*b*), the structure of the fixing means will be explained.

The sign 247 denotes the fixing means, 474 denotes the heating roller, 471*a* denotes the heat generating body (hereinafter referred to also as the halogen lamp heater) and 475 denotes the pressing roller.

The sign 290 denotes a commercial alternating-current power source of the image forming apparatus.

The sign 264 denotes the heating control means, and comprises a heating control member 642 for turning on or off the application of an electric current to the halogen lamp heater 471*a* on the basis of an input to a control input 641.

In the above, the heating control member 642 may be one that can vary the energy ratio of an alternating-current power such as a triac, and as regards the input to the control input 641 in this case, a voltage proportional to the energy ratio is inputted.

The halogen heater lamp 471*a* is connected to the commercial alternating-current power source 290 at one end, and is connected to the heating control means 264 at the other end.

Further, the roller heat detecting sensor 472 is made up of a thermistor or a thermocouple, detects the heat (infrared rays) radiated from the heating roller 474, and its output terminal is connected to the input terminal of an A/D converter for converting A/D conversion through a buffer 621. Further, the ambient temperature sensor 473 is made up of a thermistor or a thermocouple, detects the ambient temperature of the roller heat detecting sensor 472, and its output terminal is connected to the input terminal of the A/D converter 263 through a buffer 622.

Each of the digital outputs from the A/D converter of the detection information of the roller heat detection sensor and that of the ambient temperature detecting sensor is inputted to the surface temperature calculating means 265 for calculating the surface temperature of the heating roller on the basis of the detection information of the roller heat detecting sensor and that of the ambient temperature detecting sensor.

To the surface temperature calculating means 265, the storage means 261 is connected, where writing and readout of various kinds of information are carried out.

Further, the storage means 261 has a register and a storage; the register has a capacity to store at least three or more of the average values of the detection information of the roller heat detecting sensor and the ambient temperature detecting sensor each, and in the above-mentioned storage, a data table having written in it the surface temperature information Tnn of the heating roller corresponding to the detection information Xn of the roller heat detecting sensor and the detection information Yn of the ambient temperature detecting sensor shown in FIG. 22(*a*) is stored beforehand. The data table contains the whole of the range of temperatures which the surface of the fixing roller reaches, and the preparation of a minute table makes possible a temperature detection of higher accuracy.

Further, the output terminal of the surface temperature calculating means 265 is connected to the control input 641 of the heating control means 264, which makes an ON-and-OFF control of the electric current application to the halogen lamp heater 471*a*.

The sign 206 denotes the control means, which reads out a temperature control program for the heating roller stored beforehand in the storage of the storage means 261, controls the surface temperature calculating means 265 and the storage means 261 according to the control program, to make the surface temperature calculating means practice processings to be described later such as calculating the surface temperature of the heating roller on the basis of the detection information of the roller heat detecting sensor 472 and that of the ambient temperature detecting sensor 473, and controls the heat generation quantity of the halogen lamp heater 471*a* through the heating control means 264, to make it heat the heating roller up to a specified temperature.

FIG. 17 is a flow chart showing a control method of the embodiment 1 of this invention.

In the following, with reference to FIG. 16, FIG. 17, FIG. 22(*a*), and FIG. 22(*b*), a control method of the embodiment 1 will be explained.

In the step (A1), the roller heat detecting sensor 472 detects the heat radiated from the heating roller all the time, while the ambient temperature detecting sensor 473 detects the ambient temperature of the roller heat detecting sensor all the time, they output the detection outputs to the buffers 621 and 622 respectively, where impedance matching between the sensors and the A/D converter is carried out, and the outputs from the buffers each are inputted to the A/D converter 263.

In the step (A2), the detection information of the roller heat detecting sensor and that of the ambient temperature detecting sensor inputted through the buffers 621 and 622 respectively are converted to digital data by the A/D converter 263, and the outputs are inputted to the surface temperature calculating means 265.

In the step (A3), the control means 206 makes the surface temperature calculating means 265 read both the digitized detection information inputted of the roller heat detecting sensor and that of the ambient temperature detecting sensor successively.

In the step (A4), the control means 206 makes the surface temperature calculating means 265 calculate the moving average of the digitized detection information of the roller heat detecting sensor and that of the ambient temperature detecting sensor in the order of reading for one or a plurality of the data (3 to 10, desirably 5 to 8) taken out as one unit, and makes the register of the storage means 261 store three or more of the moving average values (3 to 50, desirably 5 to 20) successively in due order.

In the above, as regards the number of data in one unit for the calculation of a moving average value and the number of moving average values to be stored by the storage means, more number is preferable so long as the processing time is within an allowable limit for the reason of preventing the influence of noises etc. and raising the accuracy.

In the step (A5), the control means 206 controls the surface temperature calculating means 265 to make it read out the surface temperature data table 611 of the heating roller shown in FIG. 22(*a*) stored previously in the storage means 261.

Further, the control means 206 controls the surface temperature calculating means 265 to make it read out the moving average values of each of the roller heat detecting sensor and the ambient temperature detecting sensor stored by the storage means 261, and calculate the surface temperature information (T22 for example) of the fixing roller corresponding to the moving average value (X2 for example) of the roller heat detecting sensor and the moving average value (Y2 for example) of the ambient temperature detecting sensor.

Then, the moving average values read out are erased from the storage means, which makes it possible to store new moving average values.

In this way, the correction of the detection information of the surface temperature of the heating roller of the roller heat detecting sensor is carried out all the time; therefore, it is possible to detect the surface temperature of the fixing roller quickly and accurately.

In the step (A6), the control means 206 controls the surface temperature calculating means 265 to make it store a plurality of the data (2 to 10, desirably 3 to 5) of the surface temperature information calculated in the step (A5) in the register of the storage means 261 in the order of calculation, for example, as T11, T22, T33, and T44.

In the step (A7), the control means 206 controls the surface temperature calculating means 265 to make it read out three or more (3 to 10, desirably 5 to 8) of the latest data of the surface temperature information (for example, T11, T22, T33, and T44) out of those stored in the step (A6) from the storage means 261 at specified time intervals (50 to 1000 ms, desirably 100 to 200 ms), remove the maximum value and the minimum value among the plural data of the surface temperature information read out, and calculate the average value of the rest of the surface temperature information data (for example, T22 and T44) to determine it to be the roller surface temperature (Tm).

In the above, as regards the number of the average values of the surface temperature (the number of data to be read out), more number is preferable so long as the processing time is within the allowed limit for the reason of preventing the influence of noises etc. and raising the accuracy.

In the step (A8), the control means 206 controls the surface temperature calculating means 265 to make it to compare the surface temperature (Tm) with the target temperature of the fixing roller (approximately 200° C.), if the roller surface temperature (Tm)≧the fixing roller target temperature (Yes), proceed to the step (A9), and if the roller surface temperature (Tm)≦the fixing roller target temperature (No), proceed to the step (A10).

In the step (A9), the control means 206 makes the surface temperature calculating means 265 brings it into the off-state the control input of the heating control means 264 so as to turn off the application of an electric current to the heat generating body 471.

In the step (A10), the control means 206 controls the surface temperature calculating means 265 to bring it into the on-state the control input of the heating control means 264, so as to turn on the application of an electric current to the heat generating body 471 to heat the heating roller.

Further, in the above description, as regards the calculation carried out in the steps (A2), (A4), and (A7), the numerical values obtained as the final result of the calculation are rounded to an integer by counting fractions of 0.5 and over or 0.7 and over as a unit and cutting away the rest.

Further, the influence of noises can be reduced by the averaging operation carried out in the plural steps.

FIG. 18 is an illustrative drawing showing the embodiment 2 of this invention.

FIG. 22(*a*) and FIG. 22(*b*) are conceptual drawings of data tables.

First, with reference to FIG. 18, FIG. 22(*a*), and FIG. 22(*b*), the structure of a fixing device will be explained. Here, the part which is different from the explanation of FIG. 16 will be mainly explained.

A roller heat detecting sensor 472 is made up of a thermistor or a thermocouple, detects the heat (infrared rays) radiated from a heating roller 474, and its output terminal is connected to one of the input terminals of a difference calculating means 266 consisting of a differential amplifier through a buffer 621. Further, an ambient temperature detecting sensor 473 is made up of a thermistor or a thermocouple, detects the ambient temperature of the roller heat detecting sensor 472, and its output terminal is connected to the other input terminal of the difference calculating means 266 and to a surface temperature calculating means 265 for calculating the surface temperature of the heating roller on the basis of difference between the detection information of the roller heat detecting sensor and the detection information of the ambient temperature detecting sensor through a buffer 622.

Further, the difference calculating means 266 is composed of an operation amplifier etc., calculates the difference of the detection information between the roller heat detecting sensor and the ambient temperature detecting sensor, and at the same time, amplifies the difference, to output it.

The output terminal of the difference calculating means 266 is connected to the other input terminal of the surface temperature calculating means 265.

To the surface temperature calculating means 265, a storage means 261 is connected, and writing and readout of various kinds of information are practiced.

Further, the storage means consists of a register for temporarily storing data and a storage for storing data beforehand, and in the storage, the surface temperature data table 612 shown in FIG. 22(*b*) in which the surface temperature information data Tnn of the heating roller corresponding to the difference in the detection information between the roller heat detecting sensor and the ambient temperature sensor Zn and the detection information of the ambient temperature sensor Yn are written beforehand.

Further, the output terminal of the surface temperature calculating means 265 is connected to the control input 641 of a heating control means 264, which makes an on/off control for the electric current application to the halogen lamp heater 471*a*.

The sign 206 denotes a control means, which reads out a temperature control program for the heating roller stored beforehand in the storage of the storage means 261, controls the surface temperature calculating means 265 and the storage means 261 according to the control program, to make them practice processings to be described later such as a processing in which the difference information data calculated on the basis of the detection information of the roller heat detecting sensor and that of the ambient temperature detecting sensor are inputted to the surface temperature calculating means 265, and the surface temperature calculating means 265 calculates the surface temperature of the heating roller, and controls the heat generation quantity of the halogen lamp heater 471*a* through the heating control means 264, to make it heat the heating roller up to a specified temperature.

FIG. 19 is a flow chart showing a control method of the embodiment 2 of this invention.

In the following, with reference to FIG. 18, FIG. 19, FIG. 22(*a*), and FIG. 22(*b*), the control method of the embodiment 2 will be explained.

In this flow chart of the embodiment 2, the part which is different from the explanation of the flow chart shown in FIG. 17 will be mainly explained.

In the step (B1), the roller heat detecting sensor 472 detects the heat radiated from the heating roller, and the ambient temperature sensor 473 detects the ambient temperature of the roller heat detecting sensor all the time; the detection outputs are outputted to the buffer 621 and to the buffer 622 respectively, the buffer 621 and the buffer 622 makes an impedance matching between the sensors and the difference calculating means 266, and the outputs are inputted to the difference calculating means 266.

In the step (B2), the difference calculating means 266 calculates the difference between the output information of the roller heat detecting sensor and the output information of the ambient temperature information from the bits of output information of the buffer 621 and the buffer 622, the result of the calculation is amplified at a specified amplification ratio (5 to 15 times, desirably 8 to 12 times), and the difference calculation output is inputted to the surface temperature calculating means 265.

In the step (B3), the control means 206 controls the surface temperature calculating means 265 to make it read the analog output of both the bits of information respectively outputted from the output terminal of the difference calculating means 266 and the buffer 622, and apply an A/D conversion to the read output of the difference calculating means 266 and to the read output of the buffer 622.

In the step (B4), the control means 206 controls the surface temperature calculating means 265 to make it calculate the moving averages of the digitized output data of the difference calculating means 266 and the detection information data of the ambient temperature sensor each in the order of reading for one or a plurality of the data taken out as one unit (3 to 10, desirably 5 to 8), and stores the moving average values in the register of the storage means 261 in due order.

In the above description, as regards the number of data in one unit taken for the calculation of the moving average value and the number of moving average values to be stored in the storage means, more number is preferable for the reason of preventing the influence of noises and raising the accuracy so long as the processing time is allowed.

In the step (B5), the control means 206 controls the surface temperature calculating means 265 to make it read out the surface temperature data table shown in FIG. 22(*b*) stored beforehand in the storage of the storage means 261.

Further, it makes the surface temperature calculating means 265 read out the moving average value of the difference calculation output information of the difference calculating means and that of the output information of the ambient temperature detecting sensor stored by the storage means in the step (B4), and calculate the surface temperature information (for example, T22) of the heating roller corresponding to the moving average value (for example, Z2) of the output data of the difference calculating means and the moving average value (for example, Y2) of the detection data of the temperature detecting sensor from the surface temperature data table 612.

Further, the read out moving average values are erased out of the storage means, which makes it possible to store new moving average values.

Subsequently, in the same way as explained in the steps (A6) to (A10), in the steps (B6) to (B10), an on/off control of the control input for the heating control means 264 is practiced.

By the structure and the control shown in FIG. 16 or in FIG. 18, it becomes possible a stabilized fixing such that the surface temperature of a heating roller can be detected quickly and accurately without being influenced by a noise, irrespectively of whether the timing is immediately after the completion of warm-up or during copying, the surface temperature of the heating roller is kept approximately constant, and the deterioration or the breakage of the heating roller or the pressing roller due to an abnormal temperature rise of the heating roller and the pressing roller, or the occurrence of a fixing offset is prevented, and the energizing of the halogen lamp heater exceeding a required level can be prevented, which makes it possible to reduce the power consumption of the heating means.

In the following, means for detecting abnormality in the case where the heating roller temperature becomes abnormal will be explained.

This means is a countermeasure devised with the occurrence of a phenomenon remarked such that, although the difference in the output value between the roller heat detecting sensor and the ambient temperature detecting sensor falls within a certain definite range during a normal operation, for example, in the case of an abnormal heat generation of the heating roller, the output of the roller heat sensor rises abnormally against the output value of the ambient temperature sensor to make the difference exceed a certain definite range, or for example, in the case of the abnormality of the roller heat detecting sensor, the output value of the roller heat detecting sensor does not rise (or rises over a required level) in spite of the rise of the output value of the ambient temperature detecting sensor due to the heating by the heating roller, and is one for detecting an abnormal heat generation of the heating roller and an abnormality of the sensor such as the snapping of a sensor wire at a low cost with a simple circuit structure.

FIG. 20 is an illustrative drawing showing an abnormality detecting means and a control method of the embodiment 3 of this invention.

FIG. 21 is an illustrative drawing showing an abnormality detecting means and a control method of the embodiment 4 of this invention.

First, with reference to FIG. 20, an abnormality detecting means and the concept of its control method of the embodiment 3 of this invention will be explained. In this explanation, the heating means of the heating roller 474 and its control method are the same as those described in the explanation of FIG. 16 and FIG. 17, and will not be explained. Here, only the abnormality detecting means and its control method will be explained.

The abnormality detecting means is composed of a difference detecting 271, a comparison means 273, and an AND means 274.

The difference calculating means is made up of an operation amplifier etc., and to its input terminal the digital output of the detection information of the roller heat detecting sensor and the digital output of the detection information of the ambient temperature detecting sensor each are inputted; the difference in the detection information between the roller heat detecting sensor and the ambient temperature detecting sensor is calculated, and the difference calculation value is amplified at a specified amplification ratio, to be outputted to the input terminal of the comparison means 273 as difference calculation information (a voltage).

The comparison means 273 is connected to a reference setting means 272 consisting of a variable resistor etc. to become a reference of comparison, and a reference voltage equivalent to the maximum difference between the detection information of the roller heat detecting sensor in the case of the normal operation of the image forming apparatus and the detection information of the ambient temperature detecting sensor is outputted from the reference setting means 272 to the comparison means 273.

The comparison means 273 consists of a comparator etc., and compares the reference voltage inputted from the reference setting means 272 with the difference calculation information inputted from the difference calculating means 271; if the reference voltage<the difference calculation information (voltage), an abnormality output signal is outputted to the AND means 274 made up of an AND logic circuit.

To the input terminal of the AND means 274, the output terminal of the surface temperature calculating means 265 and the output terminal of the comparison means 273 are connected, and it is possible for the AND means 274 to bring the control input 641 of the heating control means 264 into the on-state on the basis of the output of the surface temperature calculating means 265 only if an abnormality output signal is not inputted from the comparison means 273.

Further, at the same time the comparison means 276 outputs an abnormality signal, the control means 206 carries out warning with a voice for notifying the user of an abnormality by means of a voice generating device (not shown in the drawing), and displays the abnormality by means of a display device of the operation panel (not shown in the drawing) during the output of the abnormality signal.

Next, with reference to FIG. 21, an abnormality detecting means and the concept of its control method of the embodiment 3 of this invention will be explained. In this explanation, the heating means and its control method of the heating roller 474 are the same as those described in the explanation of FIG. 18 and FIG. 19, and will not be explained. Here, only the abnormality detecting means and its control method will be explained.

The abnormality detecting means consists of a comparison means 276 and an AND means 277.

The comparison means 276 made up of a comparator etc. is connected to a reference setting means 275 consisting of a variable resistor etc., and a reference voltage equivalent to the maximum difference between the detection information of the roller heat detecting sensor in the case of the normal operation of the image forming apparatus and the detection information of the ambient temperature detecting sensor is outputted from the reference setting means 275 to the comparison means 276.

Further, the comparison means 276 compares the difference between the reference voltage inputted from the reference setting means 275 with the difference calculation information as the result of the calculation of the difference in the detection information between the roller heat detecting sensor and the ambient temperature detecting sensor inputted from the difference calculating means 266, and if the reference voltage<the difference calculation information (a voltage), it outputs an abnormality signal to the AND means 277 made up of an AND logic circuit.

To the input terminal of the AND means 277, the output terminal of the surface temperature calculating means 265 and the output terminal of the comparison means 276 are connected, and it is possible for the AND means 277 to bring the control input 641 of the heating control means 264 into the on-state, only if an abnormality signal is not inputted from the comparison means 276 to its input terminal.

Further, at the same time the comparison means 273 outputs an abnormality signal, the control means 206 carries out warning with a voice for notifying the user of an abnormality by means of a voice generating device (not shown in the drawing), and displays the abnormality by means of a display device of the operation panel (not shown in the drawing) during the output of the abnormality signal.

By the structure and the control shown in FIG. 20 or FIG. 21, it is possible that an abnormal heat generation of the heating roller or an abnormality of the sensor such as a snapping of a wire of the sensor is detected with a simple circuit structure, and in that case, the heating of the heating roller can be stopped; further, it is also possible to notify the operator of the occurrence of an abnormality.

By this invention, an effect to be described below can be obtained: it becomes possible a stabilized fixing such that the surface temperature of a heating roller can be detected quickly and accurately without being influenced by a noise, irrespectively of whether the timing is immediately after the completion of warm-up or during copying, the surface temperature of the heating roller is kept approximately constant, and the deterioration or the breakage of the heating roller or the pressing roller due to the abnormal temperature rise of the heating roller and the pressing roller, or the occurrence of a fixing offset is prevented; further, it is possible to reduce the power consumption of the heating means.

Further, an abnormal heat generation of the heating roller and an abnormality of the sensor such as a snapping of a sensor wire can be detected, and in that case, the heating of the heating roller can be stopped with a simple circuit structure; further, it is also possible to notify the operator of the occurrence of an abnormality.

In the following, with reference to the drawings, the embodiment for accomplishing the fourth object of this invention will be explained.

In this embodiment of the invention, a fixing means 247 is made up of a heating roller 474 formed of a base body 471 made of aluminum containing a halogen lamp heater 471*a* as a heating source coated with a heat-resistant releasing layer made of fluorine-contained resin, and a pressing roller 475 which is arranged parallel to the axial direction of the heating roller in contact with it and is formed of a base body made of aluminum coated with a heat-resistant elastic layer made of silicone rubber, and the heating roller is heated by the heating source 471*a*.

Further, a non-contact type detection sensor 472 for detecting the surface temperature of the heating roller 474 is fitted at a place in a direction where the heat radiation is directly incident at a distance of 0.2 mm to 8 mm or desirably 4.5 mm to 5.5 mm from the heating roller (d in FIG. 23).

A compensation sensor 473 for detecting the temperature of the detection sensor is fitted to the member fitted with the detection sensor at a position where the heat radiation from the heating roller is not directly incident.

In this case, it is possible to make the detection sensor and the compensation sensor a thermally unified body in terms of thermal conduction by it that copper or aluminum, which has a high thermal conductivity, is selected for the member fitted with the detection sensor, and the compensation sensor is fitted in close contact with the fitting member.

The sign 264 is a control means for practicing the heating control for the heating roller, and 265 is a calculating means for calculating the surface temperature of the heating roller; the detail will be explained later.

FIG. 23 is a control block diagram of the embodiment of this invention.

In the drawing, 247 is the fixing means, 474 is the heating roller, 471*a* is the heating source (hereinafter, referred to also as the halogen lamp heater), and 475 is the pressing roller.

The sign 290 denotes a commercial alternating-current power source of the image forming apparatus working also as the power source of the fixing means 247. The sign 264 denotes a heating control means, which has a heating control member 642 for turning on and off the electric current application to the halogen lamp heater 471*a* by a relay or the like on the basis of an input signal to its control input 641.

In the above description, the heating control member 642 may be one that can vary the energy ratio of an alternating-current power such as a triac, and in that case, for the input to the control input 641, a voltage proportional to the energy ratio is inputted.

The halogen heater lamp 471*a* is connected to the commercial alternating-current power source 290 at one end, and is connected to the heating control means 264 at the other end.

Further, the detection sensor 472 has a structure such that the infrared rays radiated from the heating roller are received by its blackened surface, whose temperature is raised in accordance with the received quantity of the infrared rays, and the temperature is detected by a thermistor or the like to give a detection output corresponding to the surface temperature.

In this way, the surface temperature of the heating roller 474 is detected by the detection sensor 472, and the output is inputted to an A/D converter 263 through a buffer 621.

In the above description, for the detection sensor, an infrared ray sensor may be also used.

The compensation sensor 473 is made up of a thermistor, detects the temperature of the detection sensor 472, and its output is inputted to the A/D converter 263 through a buffer 622.

In the above description, it is also appropriate to use a thermocouple for the compensation sensor.

The digital output of the A/D converter for each of the detection output of the detection sensor and the compensation sensor is inputted to the surface temperature calculating means 265 for calculating the surface temperature of the heating roller.

The surface temperature calculating means 265 comprises a selection means 651 for selecting an operation equation for calculating the surface temperature corresponding to the region containing the target control temperature and the detection temperature of the compensation sensor, a calculation means 652 for calculating the surface temperature of the heating roller on the basis of the detection output of the detection sensor and that of the compensation sensor, a comparison judgement means for determining the minimum calculation result to be the above-mentioned surface temperature of the heating roller out of the calculation results, and a control means 653 for practicing the energizing control for the above-mentioned heating source on the basis of the calculation result and the target control temperature.

A storage means 261 comprises a register and a storage, and there are previously stored a temperature control program for the heating roller, the target control temperature at the time of printing use, and as shown in FIG. 27 to FIG. 29, operation equations for calculating the surface temperature defined respectively in correspondence with regions determined by one undivided temperature range or two or more divisional temperature ranges as the result of the dividing of the heating roller temperature to be controlled and one undivided detection range or tow or more divisional ranges as the result of the dividing of the range of the detection output of the above-mentioned compensation sensor.

Further, the output of the surface temperature calculating means 265 is inputted to the control input 641 of the heating control means 264, which makes an on/off control of the electric current application to the halogen lamp heater 471*a*.

The sign 206 denotes a control means, which reads out a temperature control program and the target control temperature for the heating roller, etc. stored beforehand in the storage of the storage means 261, controls the surface temperature calculating means 265 and the storage means 261 in accordance with the control program, and makes them practice processings to be described later such as a processing of calculating the surface temperature of the heating roller by the surface temperature calculating means 265 on the basis of the detection output of the detection sensor and that of the compensation sensor, and comparing the calculation result with the target control temperature to carry out the temperature control for the heating roller.

The surface temperature calculating means 265 controls the heat generation quantity of the halogen lamp heater 471*a* through the heating control means 264, to make the heater heat the heating roller up to a specified temperature.

In the following, with reference to FIG. 23, FIG. 27, and FIG. 31, the embodiment 1 of this invention will be explained. In the step (C1), the detection sensor 472 and the compensation sensor 473 detect the surface temperature of the heating roller and the temperature of the detection sensor respectively all the time, and the detection outputs are outputted to the buffers 621 and 622 respectively.

The buffers 621 and 622 carry out the impedance matching between the sensors and the A/D converter, and the outputs of the buffers are inputted to the A/D converter 263.

The detection output of the detection sensor and that of the compensation sensor, which have been inputted to the A/D converter through the buffers 621 and 622 respectively, are converted into digital data each, and the digital outputs are inputted to the surface temperature calculating means 265.

Further, the control means 206 makes the surface temperature calculating means 265 read the digital output of the detection sensor and that of the compensation sensor.

In the step (C2), the control means 206 makes the surface temperature calculating means 265 read a first-order operation equation (for example, the operation equation 2) for calculating the surface temperature of the heating roller defined in correspondence with the region 2 determined by the roller temperature range for practicing usual printing (for example, 140° C. to 200° C.) and the detection range of the compensation sensor stored beforehand in the storage means 261 as shown in FIG. 27.

$$\text{Surface temperature}=ER_n-(a_1\times EH_n-a_2)/(a_3\times EH_n+a_4), \qquad \text{Operation equation 4}$$

where $ER_n$ denotes a detection sensor output, $EH_n$ denotes a compensation sensor output, and $a_1$ to $a_4$ are constants.

In the step (C3), the control means 206 makes the surface temperature calculating means 256 fit the outputs (digitized) of the detection sensor and the compensation sensor $ER_n$ and $EH_n$ read in the step (C1) to the operation equation 2 read in the step (C2), and carry out the calculation of the surface temperature by means of the calculation means 652.

In the step (C4), the control means 206 makes the surface temperature calculating means compare the calculated surface temperature with the target control temperature in the operation mode at that point of time (for example, 200° C.) read out from the storage means 261, if the surface temperature is lower, it proceeds to the step (C5), and if the surface temperature is higher, it proceeds to the step (C6).

In the step (C5), the control means 206 makes the control means 653 of the surface temperature calculating means 265 output a control signal for heating the heating roller 474 to the heating control means 642. By this signal, the heating control means 642 turns on the electric current application to the halogen lamp heater 471*a*, to heat the heating roller 474.

In the step (C6), the control means 206 makes the control means 653 output a control signal for stopping the heating of the heating roller 474 to the heating control means 642. By this signal, the heating control means 642 turns off the electric current application to the halogen lamp heater 471*a*, to stop the heating of the heating roller.

Next, with reference to FIG. 23, FIG. 28, and FIG. 32, the embodiment 2 of this invention will be explained.

In the step (D1), the same processing as the embodiment 1 is carried out.

In the step (D2), the control means 206 makes the surface temperature calculating means 265 read first-order operation equations (for example, operation equations 3 and 4) for calculating the surface temperature of the heating roller defined in correspondence with the respective regions determined by the two or more divisional roller temperature ranges as the result of the dividing of the roller temperature range where the temperature control for the heating roller is to be carried out and the detection range of the compensation sensor stored beforehand in the storage means 261 as shown in FIG. 28.

$$\text{Surface temperature}=ER_n-(b_1\times EH_n-b_2)/(b_3\times EH_n+b_4), \qquad \text{Operation equation 3}$$

$$\text{Surface temperature}=ER_n-(c_1\times EH_n-c_2)/(c_3\times EH_n+c_4), \qquad \text{Operation equation 4}$$

where $ER_n$ denotes a detection sensor output, $EH_n$ denotes a compensation sensor output, and $b_1$ to $C_4$ are constants.

In the above description, the operation equation 4 is defined for the region 6 corresponding to the divisional temperature range of the heating roller where usual printing is carried out (for example, 140° C. to 200° C.) obtained by the dividing of the temperature range where the temperature control of the heating roller is to be carried out (for example, 80° C. to 200° C.), and the operation equation 3 is defined for the region 5 corresponding to the divisional temperature range of the heating roller (for example, 80° C. to 139° C.).

In the step (D3), the control means 206 makes the surface temperature calculating means 265 compare the target control temperature in the present operation mode (for example, 190° C.) with the divisional temperature ranges obtained by the dividing, and select an operation equation for the region corresponding to the roller temperature range containing the target control temperature (for example, the operation equation 4 for the region 6) by means of the selection means 651.

In the step (D4), the control means 206 makes the surface temperature calculating means 256 fit the outputs (digitized) of the detection sensor and the compensation sensor $ER_n$ and $EH_n$ read in the step (D1) to the operation equation selected in the step (D3) (for example, the operation equation 4), and carry out the calculation of the surface temperature by means of the calculation means 652.

In the steps on and after the step (D5), the same processings as the steps (C4) to (C6) of the embodiment 1 are carried out.

Next, with reference to FIG. 23, FIG. 28, and FIG. 33, the embodiment 3 of this invention will be explained.

In the steps (E1) and (E2), the same processings as the embodiment 2 are carried out.

In the step (E3), the control means 206 makes the surface temperature calculating means 265 fit the outputs (digitized) of the detection sensor and the compensation sensor $ER_n$ and $EH_n$ read in the step (E1) to the two operation equations (for example, the operation equations 3 and 4) read in the step (E2), and carry out the calculation of the surface temperature by means of the calculation means 652.

In the step (E4), the control means 206 makes the comparison judgement means 654 compare the results of the calculation using the two operation equations (for example, the operation equations 3 and 4) carried out in the step (E3) with each other, and determine the smallest one to be the final surface temperature.

In the steps on and after the step (E5), the same processings in the steps (C4) to (C6) of the embodiment 1 are carried out.

Next, with reference to FIG. 23, FIG. 29, and FIG. 34, the embodiment 4 of this invention will be explained.

In the step (F1), the same processing as that in the step (C1) of the embodiment 1 is carried out.

In the step (F2), the control means 206 makes the surface temperature calculating means 265 read first-order operation equations (for example, operation equations 5 and 6) for calculating the surface temperature of the heating roller defined in correspondence with the respective regions determined by the roller temperature range and two or more divisional detection temperature ranges of the compensation sensor as the result of the dividing of the detection temperature range of the above-mentioned compensation sensor stored beforehand in the storage means 261 as shown in FIG. 29.

$$\text{Surface temperature}=ER_n-(d_1\times EH_n-d_2)/(d_3\times EH_n+d_4), \quad \text{Operation equation 5}$$

$$\text{Surface temperature}=ER_n-(e_1\times EH_n-e_2)/(e_3\times H_n+e_4), \quad \text{Operation equation 6}$$

where $ER_n$ denotes a detection sensor output, $EH_n$ denotes a compensation sensor output, and $d_1$ to $e_4$ are constants.

In the above description, the operation equation 5 is defined for the region 7 corresponding to the combination of the divisional temperature range of the compensation sensor, for example, the range of 0° C. to 70° C. and the temperature range of the heating roller where usual printing is carried out (for example, 140° C. to 200° C.) as shown in FIG. 29, and the operation equation 6 is defined for the region 8 corresponding to the combination of the divisional temperature range of the compensation sensor (for example, 80° C. to 139° C.) and the roller temperature range.

In the step (F3), the control means 206 makes the surface temperature calculating means 265 compare the compensation sensor temperature corresponding to the detection output of the compensation sensor read in the step (F1) with each of the divisional compensation temperature ranges, and select the operation equation for the region containing the read compensation sensor temperature (for example, the operation equation 6 for the region 8) by means of the selection means 651.

In the step (F4), the control means 206 makes the surface temperature calculating means 265 fit the outputs (digitized) of the detection sensor and the compensation sensor $ER_n$ and $EH_n$ read in the step (F1) to the operation equation (for example, the operation equation 6) selected in the step (F3), and carry out the calculation of the surface temperature by means of the calculation means 652.

In the steps on and after the step (F4), the same processings as those in the steps (C4) to (C6) of the embodiment 1 are carried out.

Next, with reference to FIG. 23, FIG. 30, and FIG. 35, the embodiment 5 of this invention will be explained.

In the step (G1), the same processing as that in the step (C1) of the embodiment 1 is carried out.

In the step (G2), the control means 206 makes the surface temperature calculating means 265 read first-order operation equations (for example, operation equations 7 to 10) for calculating the surface temperature of the heating roller defined in correspondence with the respective regions determined by the two or more divisional roller temperature ranges as the result of the dividing of the roller temperature range where the temperature control for the heating roller is to be carried out and the two or more divisional detection ranges of the compensation sensor as the result of the dividing of the detection output range of the above-mentioned compensation sensor stored beforehand in the storage means 261 as shown in FIG. 30.

$$\text{Surface temperature}=ER_n-(f_1\times EH_n-f_2)/(f_3\times EH_n+f_4), \quad \text{Operation equation 7}$$

$$\text{Surface temperature}=ER_n-(g_1\times EH_n-g_2)/(g_3\times EH_n+g_4), \quad \text{Operation equation 8}$$

$$\text{Surface temperature}=ER_n-(h_1\times EH_n-h_2)/(h_3\times EH_n+h_4), \quad \text{Operation equation 9}$$

$$\text{Surface temperature}=ER_n-(i_1\times EH_n-i_2)/(i_3\times EH_n+i_4), \quad \text{Operation equation 10}$$

where $ER_n$ denotes a detection sensor output, $EH_n$ denotes a compensation sensor output, and $f_1$ to $i_4$ are constants.

In the above description, the operation equations 7 and 9 are defined for the regions 9 and 11 respectively corresponding to the combination of the divisional temperature range, for example, 0° C. to 70° C. obtained by the dividing of the compensation temperature range (for example, 0° C. to 150° C.), with each of the divisional temperature ranges of the heating roller where usual printing is carried out (for example, 140° C. to 200° C.) and the other divisional temperature range 80° C. to 139° C. obtained by the dividing of the temperature range where the temperature control of the heating roller is to be carried out (for example, 80° C. to 200° C.)

Further, the operation equations 8 and 10 are defined for the combination regions 10 and 12 on the basis of the similar way of thinking.

In the step (G3), the control means 206 makes the surface temperature calculating means 265 compare the compensation sensor temperature corresponding to the detection output of the compensation sensor read in the step (G1) with each of the divisional compensation temperature ranges, and select the operation equations for the regions containing the read compensation temperature range (for example, the operation equation 8 and 10 for the regions 10 and 12 respectively) by means of the selection means 651.

Subsequently, the control means 206 makes the surface temperature calculating means 265 compare the target control temperature in the present operation mode (for example, 190° C.) with each of the divisional roller temperature ranges, and select the operation equation for the region containing the target control temperature (for example, the equation 10 for the region 12) by means of the selection means 651.

In the step (G4), the control means 206 makes the surface temperature calculating means 265 fit the outputs (digitized) of the detection sensor and the compensation sensor $ER_n$ and $EH_n$ read in the step (G1) to the operation equation (for example, the operation equation 10) selected in the step (G3), and carry out the calculation of the surface temperature by means of the calculation means 652.

In the steps on and after the step (G5), the same processings as those in the steps (C4) to (C6) of the embodiment 1 are carried out.

Next, with reference to FIG. 23, FIG. 30, and FIG. 36, the embodiment 6 of this invention will be explained.

In the steps (H1) and (H2), the same processings as those in the steps (G1) and (G2) of the embodiment 5 are carried out.

In the step (H3), the control means 206 makes the surface temperature calculating means 265 compare the compensation sensor temperature corresponding to the detection output of the compensation sensor read in the step (H1) with each of the divisional compensation temperature ranges, and select the operation equations for the regions containing the read compensation sensor temperature (for example, the operation equations 8 and 10 for the above-mentioned regions 10 and 12) by means of the selection means 651.

In the step (H4), the control means 206 makes the surface temperature calculating means 265 fit the outputs (digitized) of the detection sensor and the compensation sensor $ER_n$ and $EH_n$ read in the step (H1) to the two operation equations (for example, the operation equations 8 and 10) each selected in the step (H3), and carry out the calculation of the surface temperature by means of the calculation means 652.

In the step (H5), the control means 206 makes the surface temperature calculating means 265 compare the result of the calculation using the two operation equations (for example, the operation equations 8 and 10) carried out in the step (H4) with each other, and determine the smallest one to be the surface temperature.

In the steps on and after the step (H6), the same processings as those in the steps (C4) to (C6) of the embodiment 1 are carried out.

In the above description, for the purpose of making the explanation be easily understood, the case where both the compensation temperature range and the roller temperature range are one as undivided or divided into two, and operation equations are defined for the region corresponding to the combination of the undivided range or the divisional ranges of both the range has been explained; however, for the purpose of enabling a closer temperature control, it is possible to calculate the surface temperature on the basis of the above-mentioned way of thinking, by dividing the both ranges into the three or more respective divisional ranges (10 or less is desirable in order that the working hours for the calculation may not be too much and the calculation speed may not be lowered) and defining a specified operation equation for a region corresponding to each combination of the divisional roller temperature range and the divisional compensation temperature range.

Further, for the purpose of making the explanation be easily understood, the compensation sensor temperature range has been supposed to be 0° C. to 150° C. and the divisional ranges are determined by the dividing of this range into two approximately equal ranges; however, it is also appropriate that the compensation sensor temperature range is determined to be a compensation sensor temperature range (for example, 40° C. to 150° C.) corresponding to the temperature range where the temperature control of the heating roller is to be carried out (for example, 80° C. to 220° C.), and this range is divided into a compensation sensor temperature range corresponding to the roller temperature range where usual printing is carried out (for example, 160° C. to 200° C.) and a temperature range other than that.

According to the examples of the embodiment except the embodiment 1 of this invention explained above, the roller temperature detection range or the compensation temperature detection range is divided into small divisional ranges, for the regions determined by the combination of both divisional ranges, operation equations for calculating the surface temperature of the heating roller on the basis of the detection values of the detection sensor and the compensation sensor are defined respectively, the surface temperature is calculated by the detection output of the detection sensor and that of the compensation sensor being fitted to the operation equations, and the temperature control of the heating roller is carried out on the basis of the calculation value; therefore, it is possible to provide an image forming apparatus which can detect the surface temperature of the heating roller accurately and quickly without requiring a large number of working hours for the preparation of data and a large storage capacity for the storage of data, and control it without producing a breakage of the heating roller and a fixing abnormality such as an offset.

This invention can exhibit an effect that it can provide an image forming apparatus which is capable of detecting the surface temperature of the heating roller accurately and quickly, without requiring a large number of working hours for the preparation of data and a large storage capacity for the storage of data, and controlling it without producing a breakage of the heating roller and the fixing abnormality such as an offset.

In the following, with reference to the drawings, the embodiment for accomplishing the fifth object of this invention will be explained.

Embodiment 1

First, with reference to FIG. 37 to FIG. 40, the embodiment 1 of this invention will be explained.

<Structure of Image Forming Apparatus>

As shown in FIG. 37, an image forming apparatus 370 is equipped with a CPU (Central Processing Unit) 111 for centrally controlling the pertinent structural elements of the whole image forming apparatus, a RAM (Random Access Memory) 112 for temporarily storing information, a ROM (Read Only Memory) 113, a display section 114 for displaying various kinds of information, a scanner 115 for reading image information on a printing object, an image formation section 116 for forming an image on a transfer sheet A, a paper feed section for supplying a paper sheet A to the image formation section 116, a fixing device 700 for fixing a toner image as a developed image on a transfer sheet A formed in the image formation section 116, and an abnormal temperature detecting device 600 for detecting an abnormal temperature of a heating roller 701 of the fixing device 700.

The RAM 112, the ROM 113, the display section 114, the scanner 115, the image formation section 116, the paper feed section 117, and the fixing device 700 are connected to the CPU 111 through a system bus line BUS. The image formation apparatus 370, under the control of the CPU 111, reads image information of a printing object by means of the scanner 115, transmits the image information of said printing object to the image formation section through the RAM 112, forms an image on a transfer sheet A supplied from the paper feed section 117 on the basis of the image information of said printing object, and fixes the toner image formed on the transfer sheet A by means of the fixing device 700.

<Structure of Fixing Device>

In FIG. 38, an example of the structure of the fixing device 700 of this invention is shown. The fixing device 700 is a device for fixing a toner image formed on a transfer sheet A in the image forming apparatus.

The fixing device 700, as shown in FIG. 38, is equipped with a heating roller 701 as a heating member containing a heating means 703 such as a halogen lamp heater inside, and a pressing roller 702 as a pressing member in pressing contact with the heating roller 701 for forming a fixing nip; the heating roller 701 is driven to rotate by a drive source (not shown in the drawing), and the pressing roller 702 is rotated in compliance with the heating roller. The heating roller 701 and the pressing roller 702 heat and press a transfer sheet A during the conveyance of it gripped by the fixing nip, and fuse to fix a toner image on the transfer sheet A. In addition, for the heating means 703, besides a halogen lamp heater, an induction heater or the like may be used.

For detecting the surface temperature of the heating roller 701, the fixing device 700 is equipped with two non-contact type sensors, a detection temperature sensor (hereinafter referred to as the first temperature sensor) 604 for detecting the temperature due to the heat radiation from the heating roller 701 and a compensation temperature sensor (hereinafter referred to as the second temperature sensor) 605 for detecting the ambient temperature of the first temperature sensor 604. For the first and second temperature sensors 604 and 605, a temperature measuring resistor (for example, a thermistor or the like) can be used.

The first temperature sensor 604 is fitted at a position where the heat radiation from the heating roller 701 is directly incident in a casing 705 with a proper orientation. The second temperature sensor 605 is fitted at a position on the member fitted with the first temperature sensor 604 where the heat radiation from the heating roller 701 is not directly incident and the ambient temperature of the heating roller 701 can be detected.

<Structure of Abnormal Temperature Detecting Device>

FIG. 39 shows an example of an abnormal temperature detecting device 800 for the fixing roller 701. As shown in FIG. 39, the abnormal temperature detecting device 800 is composed of a temperature detecting means 601, an abnormal temperature detecting means 602, and a processing circuit 603.

The temperature detecting means 601 has a structure equipped with the first temperature sensor, the second temperature sensor, a pull-up resistor R1 and a pull-up resistor R2.

In the temperature detecting means 601, the pull-up resistor R1 and the first temperature sensor 604 are serially connected with the voltage between the power source Vc and the ground GND applied, and the connection point between the pull-up resistor R1 and the first temperature sensor 604 is connected to the positive-side input terminal of a buffer 606 of the abnormal temperature detecting means 602, which makes the divisional voltage produced by the pull-up resistor R1 and the first temperature sensor 604 be inputted to the buffer 606. In the same way, the pull-up resistor R2 and the second temperature sensor 605 are serially connected with the voltage between the power source Vc and the ground GND applied, and the connection point between the pull-up resistor R2 and the second temperature sensor 605 is connected to the positive-side input terminal of a buffer 607 of the abnormal temperature detecting means 602, which makes the divisional voltage produced by the pull-up resistor R2 and the second temperature sensor 605 be inputted to the buffer 607.

The abnormal temperature detecting means 602 has a structure equipped with the buffers 606 and 607, a differential amplifier 608, comparators 609, 610, and 611, and reference voltage elements Vref1 to Vref3.

The output terminal of the buffer 606 is connected to the input terminal of the comparator 609. In the comparator 609, a detection signal value TD from the first temperature sensor 604 through the buffer 606 is compared with the reference voltage Vref1, and the result of the comparison is outputted. The output terminal of this comparator 609 is connected to the processing circuit 603, and the result of the comparison is outputted to the processing circuit 603.

The output terminal of the buffer 607 is connected to the input terminal of the comparator 610. In the comparator 610, a detection signal value TC from the second temperature sensor 605 through the buffer 607 is compared with the reference voltage Vref2, and the result of the comparison is outputted. The output terminal of this comparator 610 is connected to the processing circuit 603, and the result of the comparison is outputted to the processing circuit 603.

Further, the output terminal of the buffer 607 is connected to the processing circuit 603, and the detection signal value TC from the second temperature sensor 605 through the buffer 607 is outputted to the processing circuit 603.

To the positive-side input terminal of the differential amplifier 608, the output terminal of the buffer 607 is connected through a resistor R4, and a detection signal value TC from the second temperature sensor 605 through the buffer 607 is inputted. On the other hand, to the negative-side terminal of the differential amplifier 608, the output terminal of the buffer 606 is connected through a resistor R3, and a detection signal value TD from the first temperature sensor 604 through the buffer 606 is inputted.

The differential amplifier 608 calculates the difference TF between the positive-side input TC and the negative-side input TD and outputs it. The output terminal of the differential amplifier 608 is connected to the processing circuit 603, and a difference value TF is outputted to the processing circuit 603.

Further, the output terminal of the differential amplifier 608 is connected to the input terminal of a comparator 663.

The comparator 663 compares the difference value TF of the differential amplifier 608 with the reference voltage Vref3, and outputs the result of the comparison. The output terminal of this comparator 663 is connected to the processing circuit 603, and the output signal from the comparator 663 is outputted to the processing circuit 603.

The processing circuit 603 has a structure equipped with a ROM having stored various kinds of program such as a temperature control program for calculating the surface temperature of the heating roller 701 on the basis of a difference value TF from the differential amplifier 608 and a temperature detection value TC from the buffer 607, and practicing the temperature control for the heating roller 701, and a program for an abnormality judgement processing A of this invention, a RAM for making the above-mentioned various kinds of program run, an A/D converter for converting an inputted analog signal into a digital signal, etc., and in cooperation with a program stored in the CPU and the ROM, it functions as a judgement means for carrying out the temperature control of the heating roller 701 and making an abnormality judgement concerning the heating roller 701 and the temperature detection.

The operation of abnormality detection in the above-mentioned structure will be explained.

A detection signal value TD from the first temperature sensor 604 is inputted to the comparator 609, and is compared with the reference voltage Vref1. The result of the comparison as an output signal from the comparator 609 is inputted to the processing circuit 603. The processing circuit 603 judges a temperature abnormality or an abnormality of the first temperature sensor 604 on the basis of the output signal from the comparator 609, and outputs a control signal D to instruct the stopping of the electric current application to the heating means 703 etc.

For example, the reference voltage Vref1 is determined to be a value equivalent to the highest temperature within the range where the heating roller 701 is not broken. If the output signal from the comparator 609 is an output signal in the case where the detection signal value from the first temperature sensor 604 exceeds the reference voltage Vref1, the processing circuit 603 regards this output signal as an abnormality signal, judges that it indicates a temperature abnormality of the heating roller 701 or an abnormality of the first temperature sensor 604, and output a control signal D as described above.

Further, the value of the reference voltage Vref1 is determined to be, for example, a value equivalent to the lowest temperature within the range where the fixing ability of the fixing device 700 can be secured. If the output signal from the comparator 609 is an output signal in the case where the detection signal value from the first temperature sensor 604 does not exceed the reference voltage Vref1, the processing circuit 603 regards this output signal as an abnormality signal, judges that it indicates a temperature abnormality of the heating roller 701 or an abnormality of the first temperature sensor 604, and output a control signal D as described above.

In this case, as regards the judgement of an abnormality by the processing circuit 603, it is desirable that the processing circuit 603 judges it to be abnormal the case where an abnormality signal from the comparator 609 is outputted continuously for a period not shorter than a previously determined reference time. In the following, an abnormality detection time will be used as a synonym of the reference time previously determined to be a period of time from the input of an abnormality signal up to the judgement of abnormality in the judgement means.

For example, in the case where the value of the reference voltage Vref1 is determined to be a value equivalent to the lowest temperature within the range where the fixing ability of the fixing device 700 can be secured, an abnormality detection time is determined with the time from the turning-on of the heating means 703 up to the completion of warm-up taken into account. Further, for example, in the case where the value of the reference voltage Vref1 is determined to be a value equivalent to the highest temperature within the range where the heating roller 701 is not broken, an abnormality detection time is determined with it taken into account the period of time such that the breakage of the heating roller 701 comes to happen if the roller temperature exceeding a temperature equivalent to the reference voltage Vref1 lasts longer.

FIG. 40 shows an abnormality judgement processing A by the processing circuit 603 in the case where an abnormality detection time is set. This processing is a processing to be practiced when an abnormality signal from the comparator 609 is inputted.

When an abnormality signal is inputted from the comparator 609, time counting is started by a clock in the processing circuit 603. After the input of an abnormality signal, if the input of the abnormality signal lasts longer than a reference time set beforehand (step S1; YES), it is judged that the heating roller 701 or the first temperature sensor 604 is abnormal (step S2). After the input of the abnormality signal, if the input of abnormality signal does not last longer than a reference time set beforehand (step S1; NO), it is judged that the heating roller 701 or the first temperature sensor 604 is normal (step S3).

As described above, because the processing circuit 603 can judge an abnormality of the heating roller 701 or the first temperature sensor 604 on the basis of the result of the comparing of the detection signal value TD of the first temperature sensor with the reference voltage Vref1 set beforehand, even if the second temperature sensor 605 and the differential amplifier 608 are not used, an abnormality of the first temperature sensor 604 or the heating roller 701 can be detected.

Embodiment 2

Next, with reference to FIG. 39 and FIG. 40, the embodiment 2 of this invention will be explained.

In addition, because the circuit structure is the same as the structure of the embodiment 1 shown in FIG. 39, its explanation will be omitted.

In the following, an operation of abnormality detection in the embodiment 2 of this invention will be explained.

A detection signal value TD from the first temperature sensor 604 through the buffer 606 and a detection signal value TC from the second temperature sensor 605 through the buffer 607 are inputted to the differential amplifier 608, and the difference value TF is outputted. This difference value TF is inputted to the comparator 663, and is compared with the reference voltage Vref3 set beforehand. The result of the comparison as an output signal from the comparator 663 is inputted to the processing circuit 603.

If an output signal in the case where the difference value TF from the differential amplifier 608 does not exceed the reference voltage Vref3 is outputted as the result of the comparison by the comparator 663, the processing circuit 603 regards it as an abnormality signal and practices an abnormality judgement processing B. In addition, because the abnormality judgement B is a processing similar to the abnormality processing A shown in FIG. 40, it will be explained with reference to FIG. 40.

When an abnormality signal is inputted from the comparator 663, time counting is started by a clock in the processing circuit 603; after the input of the abnormality signal, if the input of the abnormality signal lasts longer than a reference time set beforehand (step S1; YES), it is judged that an abnormality has occurred (step S2). After the input of the abnormality signal, if the input of abnormality signal does not last longer than a reference time set beforehand (step S1; NO), it is judged that the process is normal (step S3).

The reference voltage Vref3 is determined to be a value of the difference, for example, at the time the detection value of the first temperature sensor corresponds to the lowest temperature within the range where the fixing ability of the fixing device 700 can be secured, and the abnormality detection time is determined with the time from the turning-on of the heating means 703 to the completion of warm-up taken into account.

Incidentally, for the case where the difference value TF from the differential amplifier 608 does not exceed the value of the reference voltage Vref3 within a reference time set beforehand, the following cases can be cited.

(1) A case where the detection signal value TC of the second temperature sensor 605 indicates a normal value, and the detection signal value TD of the first temperature sensor 604 indicates a value of no more than the detection signal value TC of the second temperature sensor 605. In this case, it can be considered that the first temperature sensor 604 is abnormal, or the heating roller 701 is abnormal to give no temperature change.

(2) A case where the detection signal value TD of the first temperature sensor 604 indicates a normal value, and the detection signal value TC of the second temperature sensor 605 indicates a value approximately equal to the detection value TD of the first temperature sensor 604. Because the difference between the detection signal value TD of the first temperature sensor 604 and the detection signal value TC of the second temperature sensor 605 should keep a certain value even if the target temperature has been reached, in such a case, it can be considered that an abnormality of the second temperature sensor has occurred.

(3) A case where the difference value TF of the differential amplifier 608 is abnormal. In this case, for example, it can be considered that the temperature of the heating roller 701 is abnormal and no temperature rise has occurred.

By the above-mentioned embodiment 2 of this invention, by a judgement being made by the processing circuit 603 that it is abnormal a case where the state that the difference value TF between the detection signal value TD of the first temperature sensor 604 and the detection signal value TC of the second temperature sensor 605 does not exceed the reference voltage Vref3 lasts for a period not shorter than a reference time set beforehand, it is possible to detect an abnormality of the temperature of the heating roller, the first temperature sensor 604, and the second temperature sensor 605.

Embodiment 3

Next, with reference to FIG. 39 and FIG. 41, the embodiment 3 of this invention will be explained.

In addition, because the circuit structure is the same as the structure of the embodiment 1, its explanation will be omitted.

In the following, the operation of abnormality detection in the embodiment 3 of this invention will be explained.

A detection signal value TD from the first temperature sensor 604 through the buffer 606 is inputted to the comparator 609, and is compared with the reference voltage Vref1 set beforehand. The result of comparison as an output signal from the comparator 609 is inputted to the processing circuit 603.

A detection signal value TC from the second temperature sensor 605 is inputted through the buffer 607 to the comparator 610, and is compared with the reference voltage Vref2 set beforehand. The result of comparison as an output signal from the comparator 610 is inputted to the processing circuit 603.

The detection signal value TD from the first temperature sensor 604 through the buffer 606 and the detection signal value TC from the second temperature sensor 605 through the buffer 607 are inputted to the differential amplifier 608, and the difference value TF is outputted. This difference value TF is inputted to the comparator 663, and is compared with the reference voltage Vref3 set beforehand. The result of comparison as an output signal from the comparator 663 is inputted to the processing circuit 603.

When an output signal in the case where the detection signal value TD from the first temperature sensor 604 does not exceed the reference voltage Vref1 is outputted as the result of comparison by the comparator 609, the processing circuit 603 regards it as an abnormality signal of the first temperature sensor 604, time counting is started by a clock in the processing circuit 603, and if the input of the abnormality signal is continued for a reference time (t1) set beforehand, the processing circuit 603 judges it to be abnormal. Further, if an output signal in the case where the detection signal value TC of the second temperature sensor 605 does not exceed the reference voltage Vref2 is outputted as the result of comparison by the comparator 610, the processing circuit 603 regards it as an abnormality signal of the second temperature sensor, time counting is started by a clock in the processing circuit 603, and if the input of the abnormality signal is continued for a reference time (t2) set beforehand, the processing circuit 603 judges it to be abnormal. Further, if an output signal in the case where the difference value TF from the differential amplifier 608 does not exceed the reference voltage Vref3 is outputted as the result of comparison by the comparator 663, the processing circuit 603 regards it as an abnormality signal of the difference value TF, time counting is started by a clock in the processing circuit 603, and if the input of the abnormality signal is continued for a reference time (t3) set beforehand, the processing circuit 603 judges it to be abnormal. In the above description, the reference times t1, t2, and t3 are determined to satisfy the inequality $t1<t2<t3$.

FIG. 41 shows an abnormality judgement processing C to be practiced by the processing circuit 603. As shown in FIG. 41, when the duration of an abnormality signal of the first temperature sensor 604 reaches the reference time t1 set beforehand (step S11; YES), the processing circuit 603 judges the first temperature sensor 604 to be abnormal (step S12). In the case where the duration of an abnormality signal of the first temperature sensor 604 does not reach the abnormality detection time t1 (step S11; NO), the processing proceeds to the step S13, and when the duration of an abnormality signal of the second temperature sensor 605 reaches the reference time t2 set beforehand (step S13; YES), the processing circuit 603 judges the second temperature sensor 605 to be abnormal (step S14). In the case where the duration of an abnormality signal of the second temperature sensor 605 does not reach the abnormality detection time t2 (step S13; NO), the processing proceeds to the step S15, and when the duration of an abnormality signal of the difference value TF from the differential amplifier 608 reaches the reference time t3 set beforehand (step S15; YES), the processing circuit 603 judges the difference value TF to be abnormal (step S16). In the case where the duration of an abnormality signal of the difference value TF does not reach the abnormality detection time t3 (step S15; NO), the processing circuit 603 judges it to be normal (step S17).

As described above, in the embodiment 3 of this invention, because an abnormality is judged by the use of the outputs from the two sensors and the difference value of the tow outputs, an abnormality can be detected more accurately. Further, by the setting of the abnormality detection times in such a way that the abnormality detection time of the first temperature sensor 604 is shortest, the abnormality detection time of the second temperature sensor 605 is next short, and the abnormality detection time of the difference value TF is longer than both the above-mentioned abnormality detection times of the two sensors, it is possible to carry out an abnormality judgement in the order of the importance of the abnormality detection.

Embodiment 4

Next, with reference to FIG. 42, the embodiment 4 of this invention will be explained.

As shown in FIG. 42, an abnormal temperature detecting means 2A is equipped with a differential amplifier 612. To the positive-side terminal of the differential amplifier 612, the output terminal of a buffer 607 is connected through a resistor R4, and a detection signal value TC of the second temperature sensor 605 is inputted through the buffer 607. On the other hand, to the negative-side terminal of the differential amplifier 612, the output terminal of a buffer 606 is connected through a resistor R3, and a detection signal value TD of the first temperature sensor 604 is inputted through the buffer 606.

The differential amplifier 612 calculates the difference value TF between the input value TC to its positive-side terminal and the input value TD to its negative-side terminal and output it. To the differential amplifier 612, power source voltages, namely a positive power source voltage VP and a negative power source voltage VN is supplied from a positive-negative power source supplying means (not shown in the drawing), and it is possible to output a negative voltage value in the case where the difference value TF becomes negative. The output terminal of the differential amplifier 612 is connected to a processing circuit 603, and a difference value TF from the differential amplifier 612 is inputted to the processing circuit 603.

Because the other circuit structure components are the same as those in the embodiment 1 described above, the explanation will be omitted.

In the following, the operation of abnormality detection in this embodiment 4 of the invention will be explained.

A detection signal value TD from the first temperature sensor 604 and a detection signal value TC from the second temperature sensor 605 are inputted to the differential amplifier 612 through the buffers 606 and 607 respectively, and the difference value TF (TC−TD) is outputted. This difference value TF is inputted to the processing circuit 603.

If the difference value TF outputted from the differential amplifier 612 is negative, the processing circuit 603 judges it to be abnormal. However, although it is not particularly shown in the drawing, in cases where a negative voltage value is inputted to the CPU of the processing circuit 603, it sometimes occurs that the CPU operates in an anomalous way, a circuit protection is applied.

As regards the judgement made by the processing circuit 603, it is also appropriate to judge it to be abnormal a case where a negative value is outputted from the differential amplifier 612 continuously for a period of time not shorter than a reference time set beforehand. That is, when the difference value TF is inputted as a negative value, time counting is started by means of a clock in the processing circuit 603, and after the input of the negative value, if it lasts for a period not shorter than a reference time set beforehand, the processing circuit 603 judges it to be abnormal. If the input of a negative value does not last for a period not shorter than a reference time set beforehand after the input of the negative value, the processing circuit judges it to be normal.

Incidentally, because the first temperature sensor 604 detects a temperature due to the heat radiation from the heating roller 701, and the second temperature sensor 605 detects the ambient temperature of the first temperature sensor 604, in a normal operation, it never occurs that a detection signal value TC from the second temperature sensor 605 is less than a detection signal value TD from the first temperature sensor 604, which makes the difference value TF negative. That is, if the difference value TF becomes negative, it is considered that there is happened some abnormality in the circuit structure.

As explained in the foregoing, in the embodiment 4 of this invention, by the judgement to make it abnormal a case where the difference value TF of the differential amplifier 612 is negative, it is possible to detect an abnormality in the abnormal temperature detecting device 800.

Embodiment 5

Next, with reference to FIG. 43, the embodiment 5 of this invention will be explained.

In this embodiment, it is attempted to secure safety by a reconfirmation of an abnormality in the case where the processing circuit 603 judges that some abnormality has occurred as a judgement means in the above-mentioned embodiment 1 to embodiment 4. Accordingly, the processing circuit 603 practices as a control means an abnormality reconfirmation processing A shown in FIG. 43. In the following, with reference to FIG. 43, the abnormality reconfirmation processing A will be explained.

When the judgement means judges that some abnormality has occurred in the above-mentioned embodiment 1 to embodiment 4 (step 21; YES), a retry operation in which the operation of the heating means 703 is once stopped and later it is actuated again is carried out, and when the retry operation is finished (step S22; YES), a judgement concerning whether an abnormality has occurred or not is carried out again by the judgement means, and if the result of the judgement is that an abnormality has occurred (step S23; YES), an abnormal stop signal is outputted (step S24).

As described above, by the processing circuit 603 in the embodiment 5 of this invention, because whether or not an abnormality has occurred is confirmed by the practice of a retry operation after a judgement of an abnormality, it is possible to detect whether or not the abnormality is true more reliably.

Next, with reference to FIG. 44 to FIG. 46, the embodiment 6 of this invention will be explained.

In this embodiment 6 of the invention, it is attempted to secure safety by a reconfirmation of an abnormality in the case where the processing circuit 603 judges that an abnormality has occurred as a judgement means in the above-mentioned embodiment 1 to embodiment 4. Accordingly, the processing circuit 603 practices as a confirmation means an abnormality reconfirmation processing B shown in FIG. 44.

In addition, as shown in FIG. 45, in this embodiment 6, there is provided close to the heating roller or in contact with it an edge portion sensor 613 for detecting the surface temperature of the heating roller 701. A detection signal value TE from the edge portion sensor 613 is outputted to the processing circuit 603.

In the following, with reference to FIG. 44, the abnormality reconfirmation processing B will be explained.

When the judgement means judges that some abnormality has occurred in the above-mentioned embodiment 1 to embodiment 4 (step 31; YES), a detection signal value TE from the edge portion sensor 613 is compared with a reference value determined beforehand (step S32), and if there is a difference not smaller than a set value determined beforehand (step S33), the occurrence of an abnormality is confirmed, and an abnormal stop signal is outputted (step S34).

Further, by the practice of an abnormality confirmation processing shown in FIG. 46, it is possible to detect an abnormality more accurately. In the following, with reference to FIG. 46, an abnormality confirmation processing C to be practiced by the processing circuit 603 as a control means.

When the judgement means judges that some abnormality has occurred in the above-mentioned embodiment 1 to embodiment 4 (step 41; YES), a detection signal value TE from the edge portion sensor 613 is compared with a reference value determined beforehand (step S42); if there is a difference not smaller than a set value determined beforehand (step S43), the abnormality is confirmed, a retry operation in which the operation of the heating means 703 is once stopped and later it is actuated again is carried out. When the retry operation is finished (step S44; YES), the judgement whether or not an abnormality has occurred is made again, and the result of the judgement is that an abnormality has occurred (step S45; YES), the judgement of abnormality is reconfirmed, and an abnormal stop signal is outputted (step S46).

As described above, by the embodiment 6 of this invention, after a judgement of an abnormality is made, a detection signal value TE of the edge portion sensor 613 is compared with a reference value determined beforehand, and if there is a difference not smaller than a set value determined beforehand, an abnormal stop signal is outputted. In another case, after a judgement of an abnormality is made, a detection signal value TE of the edge portion sensor 613 is compared with a reference value determined beforehand, and if there is a difference not smaller than a set value determined beforehand, a retry operation is carried out, and whether or not an abnormality has occurred is judged again. Accordingly, it is possible to detect whether an abnormality is true or not more reliably.

Next, with reference to FIG. 47, the embodiment 7 of this invention will be explained.

FIG. 47 is a drawing showing the circuit structure as a switching means for changing the length of the abnormality detection time of a detection signal value TD of the first temperature sensor 604 in the processing circuit 603 shown in FIG. 39.

A connector 614 is a drawer connector or the like, and by the connection or non-connection of the connector, a short-circuit state and an open-circuit state are switched to each other.

When the connector 614 is connected, the circuit is brought in the short-circuit state, a switch element Q is turned off, and the reference voltage Vref0 becomes the divisional voltage produced by a voltage-dividing resistor R9 and a voltage-dividing resistor R10. That is, the reference voltage in the short-circuit state is expressed by the following equation (1).

$$Vref0=Vc\times R10/(R9+R10) \quad \text{Equation (1)}$$

When the connector is not connected, because the circuit is brought in the open-circuit state, the switch element Q is turned on, and a resistor R8 is put parallel to the voltage-dividing resistor R10. The reference voltage Vref0 comes to have a voltage value determined by the voltage dividing ratio of the voltage-dividing resistor R9 and the parallel-connected resistance of the voltage-dividing resistor R10 and the resistor R8. That is, the reference voltage Vref0 in the open-circuit state is expressed by the following equation (2).

$$Vref0=Vc\times Rf/(R9+Rf), \text{ and}$$

$$Rf=R8\times R9/(R8+R9). \quad \text{Equation (2)}$$

In this way, by the switching of the connector 14, the value of the reference voltage can be changed.

The output terminal of a comparator 609 is connected to the input terminal of a comparator 615 through an input resistor R0. An output signal TD1 from the comparator 609 is inputted to the comparator 615 through the charging and discharging of a capacitor C0, is compared with the reference voltage Vref0, and the result is outputted to the processing circuit as TD2.

When the output signal TD1 is an abnormal signal (for example, an H signal), because the capacitor C0 is charged at the time of rising of the signal, the rise of the input voltage to the comparator 615 is delayed by the time constant; therefore, the output of the detection signal to the processing circuit 603 is delayed. By this delay time and the change of the reference voltage due to the switching of the connector 614 between connection and non-connection, the abnormality detection time in the processing circuit 603 can be changed.

If signals for various destinations are produced by the switching of the switch element Q between on and off owing to the connection/non-connection of the connector 614 by means of the above-mentioned structure, by the switching of the connector 614 between connection and non-connection, for example, it is possible to set an abnormality detection time in accordance with the destination such as domestic market/oversea market.

In the same way, by the connecting of the output terminal of the comparator 610 to the input terminal of the comparator 615, and the connecting of the output terminal of the comparator 615 to the processing circuit 603, the length of the abnormality detection time of a detection signal TC from the second temperature sensor 605 in the processing circuit 603 shown in FIG. 39 can be changed. In the same way, by the connecting of the output terminal of a comparator 663 to the input terminal of the comparator 615, and the connecting of the output terminal of the comparator 615 to the processing circuit 603, the length of the abnormality detection time of the difference value TF in the processing circuit 603 shown in FIG. 39 can be changed. Further, by the connecting of the output terminal of differential amplifier 612 to the input terminal of the comparator 615, and the connecting of the output terminal of the comparator 615 to the processing circuit 603, the length of the abnormality detection time of the difference value TF in the processing circuit 603 shown in FIG. 42 can be changed.

As explained in the above, by the embodiment 7 of this invention described above, it is possible to switch the abnormality detection time of the processing circuit 603. Accordingly, for example, in cases where a uniform setting of the abnormality detection time results in a breakage of the fixing device 700 such as a case where there are different destinations, it is possible to set different abnormality detection times in accordance with the condition.

Up to now, the embodiment 1 to 7 of this invention have been explained; however, the content of the description in the above-mentioned embodiment, is a suitable example of an abnormality detecting device of the heating roller 701 in the fixing device 700 of this invention, and this invention is not to be limited to this. Further, concerning also the detailed structure and the detailed operation of the fixing device 700, they can be changed within the scope not deviating from the spirit of this invention.

According to the invention described in the structure (17), the abnormal temperature detecting device has a first temperature sensor for detecting the surface temperature of the heating roller and a second temperature sensor for detecting the ambient temperature of the first temperature sensor, compares the detection signal value of the first temperature sensor with a reference value set beforehand, and judges a temperature abnormality of the heating roller or an abnormality of the first temperature sensor. Accordingly, even if the second temperature sensor is not used, a temperature abnormality of the heating roller or an abnormality of the first temperature sensor can be detected.

(18) According to the invention described in the structure (18), in the invention of the structure (17), the abnormal temperature detecting device judges it to be abnormal a case where a state that the detection signal value of the aforesaid first temperature sensor does not exceed the aforesaid reference value set beforehand lasts for a period of time not shorter than a reference time set beforehand. Accordingly, it is possible to detect a temperature abnormality of the heating roller or an abnormality of the first temperature sensor more accurately.

According to the invention described in the structure (19), the abnormal temperature detecting device comprises a first temperature sensor for detecting the surface temperature of said heating roller and a second temperature sensor for detecting the ambient temperature of said first temperature sensor, differentially amplifies the detection signal value of said first temperature sensor and the detection signal of said second temperature sensor to obtain the difference value of both the signals, and judges it to be abnormal a case where a state that the difference value does not exceed a reference value set beforehand lasts for a period of time not shorter than a reference time set beforehand. Accordingly, it is possible to detect an abnormality concerning the heating roller or the two sensors.

According to the invention described in the structure (20), the abnormal temperature detecting device comprises a first temperature sensor for detecting the surface temperature of said heating roller and a second temperature sensor for detecting the ambient temperature of said first temperature sensor, differentially amplifies the detection signal value of said first temperature sensor and the detection signal value of said second temperature sensor to obtain the difference value of both said signals, and judges it to be abnormal a case where a state that the detection signal of the first temperature sensor does not exceed a first reference value set beforehand lasts for a period of time not shorter than a first reference time set beforehand, a case where a state that the detection signal of the second temperature sensor does not exceed a second reference value set beforehand lasts for a period of time not shorter than a second reference time set beforehand, or a case where a state that the difference value does not exceed a third reference value set beforehand lasts for a period of time not shorter than a third reference time set beforehand. Accordingly, because the abnormality is detected by the use of outputs from the two sensors and the difference value of the two sensors, it is possible to detect an abnormality more accurately.

According to the invention described in the structure (21), in the invention described in the structure (20), with the aforesaid first reference time denoted by t1, the aforesaid second reference time denoted by t2, and the aforesaid third reference time denoted by t3, these reference times are determined in such a way as to satisfy the inequality $t1<t2<t3$. Accordingly, it is possible to carry out the abnormality judgement in the order of the importance as abnormality detection.

According to the invention described in the structure (22), the abnormal temperature detecting device comprises a temperature detecting means having a first temperature sensor for detecting the surface temperature of said heating roller and a second temperature sensor for detecting the ambient temperature of said first temperature sensor, differentially amplifies the detection signal value of said first temperature sensor and the detection signal of said second temperature sensor to obtain the difference value, and judges it to be abnormal a case where the signal polarity of the difference value is negative. Accordingly, it is possible to detect an abnormality in the abnormal temperature detecting device such as an abnormality of the temperature of the heating roller, the two sensors, the circuit structure.

According to the invention described in the structure (23), in the invention described in the structure (22), the judgement means judges it to be abnormal a case where a state that the signal polarity of the aforesaid difference value is negative lasts for a period of time not shorter than a reference time determined beforehand. Accordingly, it is possible to detect an abnormality more reliably.

According to the invention described in the structure (24), in the invention described in any one of the structures (17) to (23), in the case where the result of the judgement by the judgement means indicates an abnormality, the control means once stops the operation of the heating means and later actuates it again, and if the judgement means judges again that an abnormality has occurred, the judgement means judges it to be abnormal. Accordingly, it is possible to detect whether the abnormality is true or false more reliably.

According to the invention described in the structure (25), in the invention described in any one of the structures (17) to (23), the abnormal temperature detecting device has a third temperature sensor placed at another position different from the placement position of the aforesaid first temperature sensor for detecting the surface temperature at the another position of the aforesaid heating roller, and confirms an abnormality on the basis of the detection signal value of said third temperature sensor and a third reference value set beforehand, in the case where the result of the judgement by the judgement means indicates an abnormality. Accordingly, it is possible to detect whether the abnormality is true or false more reliably.

According to the invention described in the structure (26), in the invention described in the structure (25), in the case where the result of the confirmation by the aforesaid confirmation means indicates an abnormality, the control means once stops the operation of the aforesaid heating means and later actuates it again and if said judgement means judges again that an abnormality has occurred, the judgement means judges it to be abnormal. Accordingly, it is possible to detect whether the abnormality is true or false more reliably.

According to the invention described in the structure (27), in the invention described in the structures (18) to (21), and (23), the abnormal temperature detecting device further comprises a switching means for changing the length of the reference time set in the aforesaid judgement means. Accordingly, in the case where a uniformly determined reference time results in a damage of the fixing device, for example, in the case where there are different destination lands, it is possible to set different reference times in accordance with the condition.

According to the invention described in the structure (28), by being equipped with an abnormal temperature detecting device of a fixing device as set forth in any one of the structures (17) to (27), an image forming apparatus can detect a temperature abnormality minutely over a broad range in diversified ways.

What is claimed is:

1. A fixing device of an image forming apparatus for thermally fixing a toner image formed on a transfer material, the fixing device comprising:

(a) a heating roller having a heating device; and (b) a temperature detector which is spaced away from the heating roller, and which comprises: a surface temperature detecting sensor for detecting a temperature of a surface of the heating roller, a compensation temperature sensor for detecting an ambient temperature of the surface temperature detecting sensor, and a casing having an opening portion at a first position and a portion enclosed by the casing at a second position, wherein the surface temperature detecting sensor is placed at the first position such that the surface temperature detecting sensor is directly exposed to heat radiation of the heating roller through the opening, and the compensation temperature sensor is placed at the second position, wherein the opening portion is disposed so as not to enter a region between a vertical plane containing a central axis of the heating roller and a tangential plane to a circumferential surface of the heating roller parallel to the vertical plane, and wherein a central portion of the surface temperature detecting sensor faces the central axis of the heating roller.

2. The fixing device of claim 1, wherein the second position is a position at which the heat radiation of the heating roller is not directly incident.

3. The fixing device of claim 1, wherein, for each of the surface temperature detecting sensor and the compensation temperature detecting sensor, an angle between (i) a straight line drawn from a central position of the sensor perpendicularly to the central axis of the heating roller, which represents a shortest distance between the central position and the central axis, and (ii) a plane containing a surface of the sensor, is 90 degrees ±5 degrees.

4. The fixing device of claim 1, wherein the casing for accommodating the two sensors of the temperature detecting device and a mounting member to be attached to the casing are made of a material having a good thermal conductivity.

5. The fixing device of claim 1, wherein, except for an area exposed by the opening portion, the two sensors are covered by the casing.

6. An image forming apparatus comprising:

(a) the fixing device set forth in claim 1;

(b) a calculating device for calculating the surface temperature of the heating roller on the basis of outputs of the two sensors; and (c) a controller for controlling a temperature of the fixing device according to the calculated surface temperature.

7. An image forming apparatus comprising:

(a) a fixing roller having a heater therein for fixing a toner image to a recording material;

(b) a temperature detector spaced apart from the fixing roller for detecting a temperature of the fixing roller and outputting a detected value of the temperature; and (c) a temperature controller for controlling the heater to control the temperature of the fixing roller to be a preset temperature, based on a preset reference temperature and the detected temperature, wherein during a still state of the fixing roller the temperature controller controls the temperature of the fixing roller based on a first value for the reference temperature, and based on a second value for the reference temperature during rotation of the fixing roller, said second value being obtained by adding a preset correction value $\alpha$ to the first value.

8. The image forming apparatus of claim 7, wherein when the fixing roller is rotated at a rotation speed slower than a rotation speed thereof during said rotation corresponding to the second value, the temperature controller controls the temperature of the fixing roller based on a third value for the reference temperature obtained by adding a preset correction value $\beta$ which is smaller than the correction value a to the first value.

9. An image forming apparatus comprising:

(a) a heating roller heated by a heating element;

(b) a roller heat detecting sensor for detecting heat radiated from the heating roller;

(c) an ambient temperature detecting sensor for detecting an ambient temperature of the roller heat detecting sensor;

(d) a surface temperature calculator for calculating surface temperature information of the heating roller; and (e) a heating controller for controlling the heating of the heating roller on the basis of the surface temperature information calculated by the surface temperature calculator, wherein the surface temperature calculator calculates the surface temperature information of the heating roller by making the detection information of the roller heat detecting sensor and the detection information of the ambient temperature detecting sensor to be in association with data table information in which the surface temperature information of the heating roller corresponds to the detection information of the roller heat detecting sensor and the detection information of the ambient temperature detecting sensor is written, and calculates an average value of the plural values of the surf ace temperature information calculated.

10. The image forming apparatus of claim 9, further comprising a storage device having a register and a memory, wherein the memory stores the data table beforehand, and the register has a capacity storing three or more of either one of an average value of detection information of both the roller detection sensor and the ambient temperature sensor and an average value of the surface temperature information.

11. The image forming apparatus of claim 9, further comprising:

a difference calculator for calculating a difference between detection information of the roller heat detecting sensor and detection information of the ambient temperature detecting sensor;

a comparing device for comparing an output value of the difference calculator with a predetermined value; and an abnormal detector for judging that the output value is abnormal when the output value is greater than the predetermined value.

12. A control method of an image forming apparatus, comprising:

(a) calculating moving average values of detection information obtained by a roller heat detecting sensor for detecting heat radiated from a heating roller heated by a heating element and of detection information obtained by an ambient temperature detecting sensor for detecting an ambient temperature of the roller heat detecting sensor;

(b) calculating surface temperature information of the heating roller corresponding to both the calculated moving average values calculated from a data table in which the surface temperature information of the heating roller corresponding to the detection information of the roller heat detecting sensor and the detection information of the ambient temperature detecting sensor is written;

(c) calculating the average value of the calculated surface temperature information to obtain a roller surface temperature; and (d) comparing the obtained roller surface temperature with the fixing roller target temperature; and (e) controlling a temperature of the heating roller on the basis of the comparison result.

13. An image forming apparatus comprising:

(a) a heating roller heated by a heating element;

(b) a roller heat detecting sensor for detecting heat radiated from the heating roller;

(c) an ambient temperature detecting sensor for detecting an ambient temperature of the roller heat detecting sensor;

(d) a surface temperature calculator for calculating surface temperature information of the heating roller;

(e) a heating controller for controlling the heating of the heating roller on the basis of the surface temperature information calculated by the surface temperature calculator;

(f) a difference calculator for calculating a difference between detection information of the roller heat detecting sensor and detection information of the ambient temperature detecting sensor, wherein the surface temperature calculator calculates the surface temperature of the heating roller by making output information of the difference calculator and the detection information of the ambient temperature detecting sensor to be in association with data table information in which the surface temperature information of the heating roller corresponding to the output information of the difference calculator and the detection information of the ambient temperature detecting sensor is written, and calculates an average value of the plural values of the surface temperature information calculated.

14. The image forming apparatus of claim 13, further comprising a storage device having a register and a memory, wherein the memory stores the data table beforehand, and the register has a capacity storing three or more of either one of an average value of detection information of both the roller detection sensor and the ambient temperature sensor and an average value of the surface temperature information.

15. The image forming apparatus of claim 13, further comprising:

a difference calculator for calculating a difference between detection information of the roller heat detecting sensor and detection information of the ambient temperature detecting sensor;

a comparing device for comparing an output value of the difference calculator with a predetermined value; and an abnormal detector for judging that the output value is abnormal when the output value is greater than the predetermined value.

16. A control method of an image forming apparatus, comprising;

(a) calculating a difference between output information obtained by a roller heat detecting sensor for detecting heat radiated from a heating roller heated by a heating element and output information obtained by an ambient temperature detecting sensor for detecting an ambient temperature of the roller heat detecting sensor through a difference calculator for calculating the difference;

(b) calculating a moving average value of the output information of the difference calculator and a moving average of the detection information of the ambient temperature detecting sensor;

(c) calculating surface temperature information of the heating roller corresponding to both the calculated moving average values from a data table in which the surface temperature information of the heating roller corresponding to the output information of the difference calculator and the detection information of the ambient temperature detecting sensor is written;

(d) calculating an average value of the values of the calculated surface temperature information, thereby obtaining a roller surface temperature;

(e) comparing the obtained roller surface temperature with a fixing roller target temperature; and (f) controlling a temperature of the heating roller on the basis of the comparison result.

17. An image forming apparatus comprising:

(a) a heating roller heated by a heating source;

(b) a detection sensor spaced apart from the heating roller sensor for detecting a surface temperature of the heating roller;

(c) a compensation sensor for detecting a temperature of the detection sensor;

(d) a storage device having an operation equation defined in correspondence with a region determined by the roller temperature range where normal printing is carried out;

(e) a calculator for calculating the surface temperature of the heating roller on the basis of detection outputs of the detection sensor and the compensation sensor using the operation equation; and (f) a controller for controlling an application of an electric current to the heating source on the basis of the calculation result and a target control temperature.

18. The image forming apparatus of claim 17, wherein the operation equation is a linear operation equation.

19. An image forming apparatus comprising:

(a) a heating roller heated by a heating source;

(b) a detection sensor spaced apart from the heating roller for detecting a surface temperature of the heating roller, wherein a roller temperature range in which a temperature of the heating roller is controller is undivided or divided into two or more temperature ranges;

(c) a compensation sensor for detecting the temperature of the detection sensor, wherein a detection output range of the compensation sensor is undivided or divided into two or more ranges;

(d) a storage device for storing respective operation equations defined in accordance with regions determined by the divided roller temperature ranges and the divided detection ranges of the compensation sensor;

(e) a selector for selecting an operation equation corresponding to one of the regions including a target control temperature and the detection temperature of the compensation sensor;

(f) a calculator for calculating the surface temperature of the heating roller using the selected operation equation on the basis of detection outputs of the detection sensor and the compensation sensor; and (g) a controller for controlling an application of an electric current to the heating source on the basis of the calculation result and the target control temperature.

20. The image forming apparatus of claim 19, wherein any one of the divided roller temperature ranges is a roller temperature range in which a normal printing is carried out.

21. The image forming apparatus of claim 19, wherein the detection output range of the compensation sensor is a detection output range of the compensation sensor in accordance with the temperature range of the detection sensor to control the temperature of the heating roller.

22. An image forming apparatus comprising:

(a) a heating roller heated by a heating source;

(b) a detection sensor spaced apart from the heating roller for detecting a surface temperature of the heating roller, wherein a roller temperature range in which a temperature of the heating roller is controlled, is divided into two or more temperature ranges;

(c) a compensation sensor for detecting the temperature of the detection sensor, wherein a detection output range of the compensation sensor is undivided or divided into two or more ranges;

(d) a storage device for storing respective operation equations defined in accordance with regions determined by the divided roller temperature ranges and the divided detection ranges of the compensation sensor;

(e) a calculator for calculating the surface temperature of the heating roller using the defined plural operation equations on the basis of a detection output of the detection sensor and the compensation sensor;

(f) a comparison judgment device for determining one having a smaller value to be a final surface temperature out of the plural calculation results; and (g) a controller for controlling an application of an electric current to the heating source on the basis of the final surface temperature and a target control temperature.

23. A control method of an image forming apparatus, comprising:

(a) reading a detection output of a detection sensor for detecting a temperature of a heating roller and a detection output of a compensation sensor for detecting a temperature of the detection sensor;

(b) reading an operation equation stored beforehand for calculating a surface temperature of the heating roller set within a roller temperature range where normal printing is carried out;

(c) calculating the operation equation in accordance with the detection output of the detection sensor and the compensation sensor, whereby obtaining the surface temperature of the heating roller as a calculation result;

(d) comparing the obtained surface temperature with a target temperature; and (e) controlling the temperature of the heating roller on the basis of the comparison result.

24. The control method of claim 23, wherein the operation equation is a linear operation equation.

25. A control method of an image forming apparatus, comprising:

(a) reading a detection output of a detection sensor for detecting a temperature of a heating roller and a detection output of a compensation sensor for detecting the temperature of the detection sensor;

(b) reading a plurality of operation equations stored beforehand for calculating a surface temperature of the heating roller set within a temperature range where a temperature control of the heating roller is to be carried out;

(c) selecting an operation equation corresponding to a target control temperature and a detection value of the compensation sensor out of the read operation equations;

(d) calculating the selected operation equation in accordance with the detection output of the detection sensor and the detection output of the compensation sensor, whereby obtaining a surface temperature of the heating roller;

(e) comparing the obtained surface temperature with a target temperature; and (f) controlling a temperature of the heating roller on the basis of the comparison result.

26. A control method of an image forming apparatus, comprising:

(a) reading a detection output of a detection sensor for detecting a temperature of a heating roller and a detection output of a compensation sensor for detecting a temperature of the detection sensor;

(b) reading a plurality of operation equations stored beforehand for calculating a surface temperature of the heating roller set within a temperature range where a temperature control of the heating roller is to be carried out;

(c) selecting a plurality of operation equations corresponding to the detection values of the compensation sensor out of the read operation equations;

(d) calculating the selected operation equations in accordance with the detection output of the detection sensor and the detection output of the compensation sensor, whereby obtaining a smallest one out of the calculation results as the surface temperature of the heating roller;

(e) comparing the obtained surface temperature with a target temperature; and (f) controlling the temperature of the heating roller on the basis of the comparison result.

27. An abnormal temperature detecting device of a fixing device of an image forming apparatus, for thermally fixing a toner image formed on a transfer material by a heating roller heated by a heating device, the abnormal temperature detecting device comprising:

(a) a temperature detector having a first temperature sensor for detecting a surface temperature of the heating roller and a second temperature sensor for detecting an ambient temperature of the first temperature sensor;

(b) a comparison device for comparing a detection signal value of the first temperature sensor with a preset reference value; and (c) a judgment device for judging a temperature abnormality of the heating roller or an abnormality of the first temperature sensor on the basis of the comparison result.

28. The abnormal temperature detecting device of claim 27, wherein the judgment device judges that a detected temperature of the heating roller or the abnormality Of the first temperature is abnormal in the case where a state that the detection signal value of the first temperature sensor does not exceed the preset reference value lasts for a period of time not shorter than a preset reference time as the result of the comparison.

29. The abnormal temperature detecting device of claim 28, further comprising a switching device for changing a length of the reference time set in the judgment device.

30. The abnormal temperature detecting device of claim 27, further comprising a controller for controlling the heating device to stop once and to actuate later when the judgment device indicates an abnormality, and for judging the detected temperature of the temperature of the heating roller or the ambient temperature of the first temperature sensor to be abnormal when the judgment device judges again that the detected temperature is abnormal.

31. The abnormal temperature detecting device of claim 27, wherein the temperature detecting device further comprises a third temperature sensor placed at another position different from a placement position of the first temperature sensor, for detecting a surface temperature at the another position of the heating roller, and the abnormal temperature detecting device further comprising a confirmation device for confirming an abnormality on the basis of a detection signal value of the third temperature sensor and a third preset reference value.

32. The abnormal temperature detecting device of claim 31, further comprising a controller for controlling the heating device to stop once and to actuate later when the judgment device indicates an abnormality, and for judging the detected temperature of the temperature of the heating roller or the ambient temperature of the first temperature sensor to be abnormal when the judgment device judges again that the detected temperature is abnormal.

33. An image forming apparatus comprising the abnormal temperature detecting device of the fixing device as set forth in claim 27.

34. An abnormal temperature detecting device of a fixing device of an image forming apparatus for thermally fixing a toner image formed on a transfer material by a heating roller heated by a heating device, the abnormal temperature detecting device comprising:

(a) a temperature detector having a first temperature sensor for detecting a surface temperature of the heating roller and a second temperature sensor for detecting an ambient temperature of the first temperature sensor;

(b) a differential amplification device for differentially amplifying a detection signal value of the first temperature sensor and a detection signal of the second temperature sensor to obtain a difference value; and (c) a judgment device for judging that a detected temperature of the surface temperature of the heating roller or the ambient temperature of the first temperature sensor is abnormal in the case where a state that the difference value does not exceed a preset reference value lasts for a period of time not shorter than a preset reference time.

35. An abnormal temperature detecting device of a fixing device of an image forming apparatus for thermally fixing a toner image formed on a transfer material by a heating roller heated by a heating device, the abnormal temperature detecting device comprising:

(a) a temperature detector having a first temperature sensor for detecting a surface temperature of the heating roller and a second temperature sensor for detecting an ambient temperature of the first temperature sensor;

(b) a differential amplification device for differentially amplifying a detection signal value of the first temperature sensor and a detection signal of the second temperature sensor to obtain a difference value; and (c) a judgment device for judging that a detected temperature of the temperature of the heating roller or the ambient temperature of the first temperature sensor is abnormal in the case where a state that the detection signal of the first temperature sensor does not exceed a first preset reference value lasts for a period of time not shorter than a first preset reference time, in the case where a state that the detection signal of the second temperature sensor does not exceed a second preset reference value lasts for a period of time not shorter than a second preset reference time, or in the case where a state that the difference value does not exceed a third preset reference value lasts for a period of time not shorter than a third preset reference time.

36. The abnormal temperature detecting device of claim 35, wherein t1, t2 and t3 are set so as to satisfy the following inequality:

$$t1 < t2 < t3$$

where t1 represents the first reference time, t2 represents the second reference time, and t3 represents the third reference time.

37. An abnormal temperature detecting device of a fixing device of an image forming apparatus for thermally fixing a toner image formed on a transfer material by a heating roller heated by a heating device, the abnormal temperature detecting device comprising;

(a) a temperature detector having a first temperature sensor for detecting a surface temperature of the heating roller and a second temperature sensor for detecting an ambient temperature of the first temperature sensor;

(b) a differential amplification device for differentially amplifying a detection signal value of the first temperature sensor and a detection signal of the second temperature sensor to obtain a difference value; and (c) a positive-and-negative source voltage supply device for supplying a positive source voltage and a negative source voltage for making an operation region of the differential amplification device to cover a range extending from a negative voltage to a positive voltage to the differential amplification device; and (d) a judgment device for judging that a detected temperature of the temperature of the heating roller or the ambient temperature of the first temperature sensor is abnormal in the case where a signal polarity of the difference value is negative.

38. The abnormal temperature detecting device of claim 37, wherein the judgment device judges that the detected temperature of the temperature of the heating roller or the ambient temperature of the first temperature sensor is abnormal in the case where a state that the signal polarity of the difference value is negative lasts for a period of time not shorter than a preset reference time.

* * * * *